United States Patent [19]

LaManna et al.

[11] Patent Number: 4,789,420

[45] Date of Patent: Dec. 6, 1988

[54] CREDIT CARD EMBOSSING SYSTEM

[75] Inventors: Richard J. LaManna, Whippany; James L. Hinton, Short Hills, both of N.J.; Edward L. Cucksey, Upper Nyack, N.Y.

[73] Assignee: National Business Systems, Inc., Ontario, Canada

[21] Appl. No.: 42,427

[22] Filed: Apr. 24, 1987

Related U.S. Application Data

[62] Division of Ser. No. 820,705, Jan. 21, 1986, Pat. No. 4,686,898.

[51] Int. Cl.[4] ..... E05G 15/00

[52] U.S. Cl. ..... 156/540; 156/234; 156/238

[58] Field of Search ..... 156/540-542, 156/238, 242, 234; 101/38

[56] References Cited

U.S. PATENT DOCUMENTS 3,001,310 9/1961 Brownlee ..... 156/541 X 4,264,394 4/1981 Izumihara ..... 156/540 X

OTHER PUBLICATIONS

Data Card Model 15000—Maintenance Manual—Selected Pages—May 1984.

*Primary Examiner*—David Simmons

*Attorney, Agent, or Firm*—Antonelli, Terry & Wands

[57] ABSTRACT

An embossing system is disclosed for embossing cards with characters of at least two pitches. A number of embossers equal to the number of lines of characters to be embossed on the card are positioned in line. Each embosser is dedicated to the embossing of a particular line of characters with a particular pitch. A common transport belt conveys the cards from an input hopper past the embossing stations of each of the in line embossers to a wait station. During embossing, the transport belt is moved from the current longitudinal position to the longitudinal position where the closest next character(s) are to be embossed by any one of the embossers. The embossed cards are conveyed from the wait station to a topper which applies topping to the embossed characters.

26 Claims, 35 Drawing Sheets

Microfiche Appendix Included
(2 Microfiche, 153 Pages)

FIG. 34.

| | DATA RECORD FOR CARD 1 STORED IN EMBOSSER BUFFER #2 | DATA RECORD FOR CARD 2 STORED IN EMBOSSER BUFFER #1 |
|---|---|---|
| DATA RECORD | 1 _ 2 _ 3 _ 4 * | 5 2 3 7 * |
| 7 PITCH | 0 10 20 30 40 50 60 | 0 10 20 30 |
| 10 PITCH | J O H N _ D O E * | S A M _ _ S M I T H * |
| | 0 7 14 21 28 35 42 49 | 0 7 14 21 28 35 42 49 56 63 |

| CURRENT BELT POSITION | BELT POSITION, CLOSET NEXT CHARACTERS AND CARD | | |
|---|---|---|---|
| 0 | 7, | "0" | (1) |
| 7 | 10, | "2" | (2) |
| 10 | 14, | "H" | (1) |
| 14 | 20 | "3" | (2) |
| 20 | 21 | "N" | (1) |
| 21 | 30 | "7" | (2) |
| 30 | 35 | "0" | (1) |
| 35 | 42 | "0" | (1) |
| 42 | 49 | "E" | (1) |

P5
P4
P3
P2
P2A

+5V
+12V
-5V
CS1
CS2
CS3
CS4
MR
CRVIN
Sh. 2
LS251
L290
LS74A
PAUSE
47K
R35
LS259
L291

45138
W1
W2
2732/
27128
6116
6116

P4
P9
P10
P11

+28V
L292
L290
L291
LS251
LS259
L5251
L5259
LS74
4.7K
R25
R28
15K
R47
RSHUTR
ESHUTR
MR
RIN
CTS 4
CTS 3
CTS 2
CTS 1
X OUT
P2
+5V
-12V
+12V
.01 uf
P12 CONTINUED
P3

CREDIT CARD EMBOSSING SYSTEM

This is a divisional application of parent Ser. No. 820,705, filed Jan. 21, 1986, now U.S. Pat. No. 4,686,898.

MICROFICHE APPENDIX

A Microfiche Appendix containing a source code listing of control programs for the master controller, embosser processors and hopper/topper processor of the present invention containing 2 microfiche having a total of 153 frames is attached hereto. The Microfiche Appendix contains subject matter which is copyrighted. A limited license is granted to anyone who requires a copy of the program disclosed therein for purposes of understanding or analyzing the present invention, but no license is granted to make a copy for any other purpose, including the loading of a processing device with code in any form or language.

BACKGROUND OF THE INVENTION

1. Field of the Invention

The invention relates to machines for embossing cards with alphanumerical text of the type used for credit cards, promotional cards and the like.

2. Description of the Prior Art

High speed card embossing systems are in wide spread use today which emboss hundreds of millions of cards per year. While prior art card embossing machines are capable of performing embossing at high speed with high reliability, these machines nevertheless suffer from several disadvantages. Many prior art commercially available embossers are high in price, sizeable, have a relatively high energy consumption because of the mass of the driven components and are complex because of requirements to emboss cards with different formats with multiple pitch characters.

U.S. Pat. No. 4,180,338, which is typical of prior art card embossers, discloses an embossing system which uses a single embossing wheel to emboss alpha numerical text on a plurality of vertically separated horizontally extending lines on a single card. The vertically separated horizontally extending lines are embossed by the translation of a single carriage holding a card to be embossed in orthogonal directions to position on the card with respect to the embossing wheel at those positions which characters are to be embossed. To emboss each character, the card is translated to the correct embossing position between the punch and die wheels prior to the activation of an activating mechanism for the chosen punch and die. Many commercially available embossing machines use a single orthogonally movable carriage in cooperation with a single embossing wheel having characters of both a 7-pitch size (7 characters per inch) and a 10-pitch size (10 characters per inch) to emboss cards. The translation of the carriage in orthogonal directions and the activation of the single punch and die pairs of the embossing wheels require sophisticated electrical-mechanical control.

U.S. Pat. No. 4,378,733 discloses an embosser for credit cards which is powered by a horizontally disposed drive shaft and the height of the embossed characters is controlled by adjustment of the location of interposers located between pairs of punch and die character elements and reciprocated arms which power the embossing operation.

U.S. Pat. No. 4,519,600 discloses a credit card embossing system having a transport which picks up a single card from an input hopper, moves the card past an embossing station and releases the card after embossing of the card is complete. The transport has a pair of cam actuated jaws which grip the card during transport through the embossing station.

U.S. Pat. No. 3,820,455 discloses an embossing system having separate embossing units for respectively embossing OCR characters and two or more lines of A/N (alphanumerical) characters. The separate embossing units each have a separate transport track which conveys the cards past the embosser. A feeder mechanism transfers the cards between successive tracks. The transport track for conveying cards to be embossed with OCR characters is advanced at a different rate of speed than the transport track which conveys cards to be embossed with A/N characters.

U.S. Pat. Nos. 3,638,563, 3,861,299 and Re. 27,809 disclose a credit card embossing system having separate embossing units for embossing each line of characters on a credit card with lines of characters having at least two pitches. Different transport tracks drive the cards through the separate embossing units. The transport track for conveying cards to be embossed with OCR characters is advanced at a different rate of speed than the transport track which conveys cards to be embossed with A/N characters.

The Model 15000 embossing machine which is manufactured by Data Card Corporation uses a plurality of separate embossing units which each emboss a separate one of the vertically separated horizontally extending lines found on a conventional credit card or promotional card. The individual embossing units are dedicated to embossing characters of a single pitch which may be either 7 or 10 pitch size. A separate card transporting belt is provided with each embosser to move the card past the embosser with the card being transferred between the separate belts in order to emboss all of the lines of characters on the card which deleteriously affects throughput. The individual embossing units have a mechanism which continuously activates selected punch and dies positioned at the circumferential position of the embossing wheel where embossing takes place without interposers of the type used in the embossing wheel of U.S. Pat. No. 4,180,338. When a position on the horizontal line being embossed does not have a character to be embossed, the embossing wheel is rotated to a circumferential position which does not have a punch and die pair so that the mechanism which continuously activates the pairs of punch and die wheels does not have to be stopped. This embosser does not synchronously drive the individual embossing wheels from a common power source. The axis of the power drive for the embossers is horizontally disposed which prevents the individual embossers from being closely spaced horizontally in line with respect to each other which deleteriously affects the throughput of the system because of the time required to transport cards between successive embossing stations.

Commercial embossers for credit cards use a topper to apply a colored plastic coating to the top of the embossed characters for highlighting. These toppers heat fuse a layer of colored plastic borne on a foil to the embossed characters by the activation of a ram which drives a heated platen against the back surface of the foil to drive the front surface bearing the plastic coating into contact with the embossed characters. While these toppers produce a commercially acceptable topping, they have deficiencies. In the first place, the heated platen can cause the grease in the lubrication points of a ram which drives the platen to degrade because of the proximity of the platen to the ram which can necessitate shutdown for service. Moreover, the dissipation of heat from the platen to other mechanical parts can cause failure of these parts. The changing of the roll of plastic bearing foil is difficult because there is no access which permits a roll of foil to be threaded on the foil driving mechanism without feeding the leading edge of the foil sequentially over the foil guides along the path that the foil normally travels. Typically the foil is spliced onto the existing roll to avoid the threading process which is a time consuming and somewhat involved task.

SUMMARY OF THE INVENTION

The present invention is a card embossing system which has a high throughput of embossed cards, is smaller in size than prior art embossers used for embossing cards such as credit and promotional cards that use multiple embossing units, has low energy consumption, high embossing accuracy and is lower in cost than prior art card embossers used for embossing credit and promotional cards.

High throughput is achieved as a consequence of several attributes of the invention. Close spacing between multiple embossing units which each emboss a different line of characters minimizes transport time of cards between the successive embossing units. A single card transport mechanism is used to move cards between the multiple embossing units which eliminates the transferring of cards between successive belts which each move the card past a single embossing unit as in the prior art Data Card Corporation Model 15000. The card transport mechanism is synchronized with the operation of the multiple embossing units which eliminates wasted time that could be incurred from an asynchronous operation of the transport mechanism with respect to the embossing units. The movement of the transport unit from a current embossing position to the position of the closest next character to be embossed for all of the embossing units is the most time efficient manner of embossing which minimizes the time required to emboss multiple lines of characters on a card having characters of a different pitch or for multiple lines having a single pitch. The embossing of a plurality of lines of characters on a card with at least two pitches with the embossing units embossing different pitches being driven at different phases with respect to a common drive for the embossing units minimizes the time required to emboss different lines with different pitches.

The driving of the individual embossers with a vertically disposed drive shaft permits the embossing units to be closely spaced horizontally together with an in line configuration. A horizontally disposed drive shaft used for each of the individual embossing units in the prior art embossers having multiple embossing units for embossing separate lines of characters on a single card prevents multiple embossers from being closely spaced horizontally together to minimize the distance that the individual cards must be transported between the units. Minimizing space between the multiple embossing units minimizes the transport time required for cards between the units which enhances throughput. Moreover, the embossing units have a mechanism that adjusts for embossing cards of varying thickness to maintain the uniform height of embossed characters while the units continue to operate.

The topper of the present invention is easy to maintain and produces cards with a high quality topping. The mounting of a heated platen on a parallelogram suspension, which dissipates and conducts the heat from the platen away from the mechanism for driving the platen, lessens the frequency of service on the bearings of a ram for driving the platen which occurred in the prior art from grease being degraded by heating. The parallelogram suspension also provides for the positioning of the platen in a plane parallel with the face of the card being topped to produce a uniform high quality topping. Moreover, the control of the force applied by the topper as a function of the number of characters on a card to be topped insures that the amount of topping is uniform regardless of the number of characters on the card. A vertical opening between the platen and the surface at the topping station which supports the card during topping permits the changing of a roll of foil bearing plastic topping by moving a leader of a new roll through the opening sidewise between the heated platen and the surface at the topping station without requiring the leader of the new roll of foil to be fed over the foil guides along the path that the foil normally travels or requiring the new leader to be spliced to the existing roll of foil.

An embossing system for embossing blank cards with a plurality of vertically separated horizontally disposed lines on which characters are to be embossed with at least one line being embossed with characters of a first pitch and at least one line being embossed with characters of a second pitch includes a card supply for feeding blank cards to be embossed; a card transport for receiving blank cards to be embossed from the card supply and for transporting the cards received from the card supply along a transport path to a plurality of separate embossing positions and to a position where embossing is completed; a plurality of embossing units each disposed at a separate one of the embossing positions disposed along the transport path, each embossing unit being vertically positioned with respect to the transport path to emboss a different one of the horizontally disposed lines of characters on each card, at least one of the card embossing units embossing a character set of a first pitch on one of the horizontally disposed lines and at least another of the card embossing units embossing a character set of a second pitch on another of the horizontally disposed lines; and a controller coupled to the card supply, the card transport and plurality of card embossing units for controlling the card supply to feed blank cards to the card transport, the transporting of the cards received by the card transport to the separate embossing positions along the transport path and the position where embossing is completed and the plurality of card embossing units to emboss the plurality of lines on each blank card. The controller compares a current longitudinal position of the cards being embossed by each of the card embossing units determined with respect to a datum point with a longitudinal position of a next character to be embossed on the cards being embossed by each of the card embossing units on each of the horizontally disposed lines to identify a longitudinal position of the one or more closest next characters to be embossed on any of the horizontally disposed lines which are closest to the current longitudinal position, causes the card transport to move to the longitudinal position of the closest one or more next characters to be embossed, and activates the one or more embossing units which are to emboss the closest one or more next characters to emboss the one or more closest next characters. Data records for each card to be embossed are sequentially transferred within a queue of buffers having a plurality of embosser buffers with each embosser buffer being associated with a separate embossing unit. Each embosser buffer has storage locations for storing a data record comprised of all of the characters of the vertically disposed lines to be embossed for a single card, each data record including a field of characters for each line of characters to be embossed on the card with each field to be embossed by a single associated card embossing unit. A means is provided for shifting the data records sequentially from an input through the queue of embosser buffers in the order in which the embossers are located along the transport path to an output. A means is coupled to each of the embossing buffers for sending a command to emboss the closest next character to its associated card embossing unit with each embossing unit receiving commands to emboss only characters in the field of characters associated with that embossing unit. The transport unit is movable in increments equal to a unit length divided by the product of the pitches being used for embossing. The closest next character to be embossed is displaced from the current longitudinal position of the transport unit by a distance equal to an integer times a unit length divided by the product of the pitches being used for embossing. The controller further comprises a comparator for comparing the current longitudinal position of the blank cards being embossed with the data records stored in each embosser buffer to identify the position of the next character to be embossed in each data record in the field of characters being embossed for each data record. Each embosser buffer stores the position along the transport path of the next character to be embossed by its associated card embossing unit which is determined by the comparator and a comparator is provided for comparing the current longitudinal position of the transport unit with the longitudinal position stored in each embosser buffer to identify the one or more closest next characters which are closest to the current longitudinal position of the transport unit.

Each embossing unit described, supra, has a pair of rotatable wheels mounted on a common shaft which have a space through which a blank card to be embossed is moved by the transport unit, one of the wheels being a punch wheel carrying male embossing elements of each of the characters of the character set embossed by the punch wheel which are movable from a retracted position to an embossing position and the other wheel being a die wheel carrying female embossing elements of each of the characters of the character set embossed by the die wheel which are movable from a retracted position to an embossing position. The pair of wheels have embossing elements of each of the characters to be embossed which are disposed at different circumferential positions along the wheels and a space without embossing elements at a circumferential position which is separate from the circumferential positions of characters which is the circumferential position of the wheels when a space is to be left on a blank card. A shaft encoder is provided for producing a signal encoding the circumferential position of the wheels with respect to a reference position; and a motor is provided for rotating the wheels to any one of the circumferential positions in response to a command from the controller to position the wheels for embossing a particular character which is a next character to be embossed by the embossing unit or to leave a space.

Each embossing unit described, supra, further includes first and second rams which are movable from a first position to a second position, the first position of the first and second rams not causing the embossing elements of the wheels to emboss a character, the second position of the first ram extending to a position to contact one of the male embossing elements to cause the embossing of a character if the circumferential position having the space is not aligned therewith and the second position of the second ram extending to a position to contact one of the female embossing elements to cause the embossing of a character if the circumferential position having the space is not aligned therewith, the second position of the rams causing a single male-female pair of embossing elements of a character to move toward each other to emboss a blank card disposed therebetween. A mechanism is provided for continuously causing the rams to move from the first position to the second position and back to the first position independent of characters being embossed. The mechanism to cause the rams to continuously move comprises first and second pivotably mounted arms, each arm having first and second ends and a pivot point between the first and second ends, the first end of the first arm engaging an end of the first ram remote from an end of the first ram which engages a male element of the punch wheel and the first end of the second arm engaging an end of the second ram remote from the end of the second ram which engages a female element of the die wheel. Third and fourth pivotably mounted arms are provided each having a fixed pivot point with the third and fourth arms each having a cam follower mounted at a point offset from the fixed pivot point. A rotatably driven cam is provided having an integer number of pairs of diametrically spaced lobes which cyclically move the cam followers of the third and fourth arms, the cam having an axis of rotation which is perpendicular direction of movement of the card transport. The third arm has a mechanism for engaging the second end of the first arm when one of the diametrically spaced lobes is engaging the cam follower of the third arm to cause the first ram to move from the first position toward the second position and the fourth arm has a mechanism for engaging the second end of the second arm when one of the diametrically spaced lobes is engaging the cam follower of the fourth arm to cause the second ram to move from the first position towards the second position. A motor drive is provided for rotating the cam. Each of the cam followers is a rotatable wheel with its periphery being in rolling contact with the cam at least when the lobes are engaged and the mechanism of the third and fourth arms which respectively engages the second ends of the first and second arms is a cylindrical pin with the cylindrical surface of the pin engaging the second ends. Movement of a point of contact of the pin of the third and fourth arms respectively with the second end of the first and second arms is equally disposed about the centerline of the third and fourth arms defined by the pivot point, center of the cam follower and center of the pin when the centerline is fixed by it being orthogonal to the common shaft.

Each of the embossing units, as described supra, has a height adjustment for adjusting the vertical position of the horizontally disposed line which is embossed on a card being transported by the transport unit.

A mechanism is provided for rotating each of the cams from a drive powered by a single motor to maintain a constant rotational velocity and phase between each of the cams with respect to the drive. The means for rotating each of the cams is a gear wheel coupled to the cam. The gear wheels are coupled to a belt which is motor driven. The width of the gear wheel is sufficiently wide so that the belt completely engages the peripheral surface of each gear wheel of the plurality of embossing units regardless of the set vertical position of the embossing units. Each embossing unit which embosses a line of characters of a first pitch is activated by a cam having lobes rotated with a first phase and each embossing unit which embosses characters of a second phase is activated by a cam having lobes rotated with a second phase. Preferably, the first cam is rotated 90° out of phase with the rotation of the second cam.

The transport unit comprises a belt having a plurality of card grippers each holding a blank card to be embossed which are spaced apart by a uniform distance. The card embossing units are also spaced apart along the transport path from each other by the uniform distance. The transport unit further includes a motor having a pulley for driving the belt with a single revolution of the belt being equal to an integer multiple of the uniform distance. Preferably, the circumference of the pulley is an integer multiple of the uniform distance.

Each card embossing unit has a pair of rotatable wheels mounted on a common shaft which have a space through which a blank card to be embossed is moved by the card transport, one of the wheels being a punch wheel carrying male embossing elements of each of the wheels of a character set embossed by that wheel which are movable from a retracted position to an embossing position and the other wheel being a die wheel carrying female embossing elements of each of that wheel which are movable from a retracted position to embossing position, the pair of wheels having embossing elements of each of the characters to be embossed which are disposed at different circumferential positions around the wheels and a space without embossing elements at a separate circumferential position which is the circumferential position of the wheels when a space is to be left on a blank. A shaft encoder is provided for providing a signal encoding the circumferential position of the wheels with respect to a reference position. A motor rotates the wheels to any one of the circumferential positions in response to a command to position the wheels for embossing a particular character of the character set or to leave a space. The controller controls the sending of commands, to emboss one or more characters of a first pitch or to leave a space of the first pitch and to emboss the one or more characters of a second pitch or to leave a space of the second pitch, to the respective card embossing units for embossing the characters in a timed relationship with respect to a control signal having a cycle comprised of a high and a low level. Commands for embossing characters of the first pitch or to leave a space of the first pitch are sent and embossed during intervals when the control signal is high and commands for embossing characters of the second pitch or to leave a space of the second pitch are sent and embossed during intervals when the control signal is low. Commands to emboss a character of a pitch or leave a space of that pitch are sent during a first cycle of the control signal and the embossing of the character which was commanded to be embossed during the first cycle is embossed during a second cycle of the control signal. A second control signal is generated synchronously with each level of the first signal with the second signal having high and low levels with the transport unit being moved toward the longitudinal position of the one or more next characters during the first level of the second control signal and the embossing the next one or more closest characters being embossed during intervals when the second control signal is at the second level. Means are provided for generating the first and second control signals which is driven synchronously with the mechanism for activating the card embossing units. Preferably, the means for generating the first and second control signals is a disk attached to one of the cams for activating the embossing units which has two concentric sectors each having alternating light and dark sectors and a sensor for respectively sensing a change in light reflected from the sectors.

The transport unit has a belt having a plurality of card holding units each for holding a blank card to be embossed with are spaced apart by uniform distance. The card embossing units are spaced apart along the transport path from each other by the uniform distance; and the cycle of the first control signal is equal to or greater in duration than the time required for the embossing unit for each pitch to emboss a single character.

An embossing unit for embossing blank cards with the line of characters extending along a line in accordance with the invention includes a pair of rotatable wheels mounted on a common shaft which have a space through which a blank card to be embossed is moved by a card transporting unit, one of the wheels being a punch wheel carrying male embossing elements of each of the characters of the character set to be embossed by the punch wheel which are movable from a retracted position to an embossing position and the other wheel being a die wheel carrying female embossing elements of each of the characters of the character set to be embossed by the die wheel which are movable from a retracted position to an embossing position. The pair of wheels have embossing elements of each of the characters to be embossed which are disposed at different circumferential positions around the wheels and a space at a circumferential position which is the circumferential position of the wheel when a space is to be left on a blank card. A shaft encoder provides a signal encoding the circumferential position of the wheels with respect to a reference position. First and second rams are provided which are movable from a first position to a second position, the first position of the first and second rams not causing the embossing elements of the wheels to emboss a character, the second position of the first ram extending to a position to contact one of the male embossing elements to cause the embossing of a character if the circumferential position having the space is not aligned therewith and the second position of the second ram extending to a position to contact one of the female embossing elements to cause the embossing of a character if the circumferential position having the space is not aligned therewith. The second position of the rams causes a single male-female pair of embossing elements of a character to move toward each other to emboss a blank card disposed therebetween. First and second pivotably mounted arms are provided each having first and second ends and a pivot point between the first and second ends, the first end of the first arm engaging an end of the first ram remote from an end of the first ram which engages a male element of the punch wheel and the first end of the second arm engaging an end of the second ram remote from the end of the second ram which engages a female element of the die wheel. Third and fourth pivotably mounted arms are provided each having a fixed pivot point, the third and fourth arms each having a cam follower mounted at a point offset from the fixed pivot point. A rotatably driven cam having an integer number of diametrically spaced lobes cyclically moves the cam followers of the third and fourth arms to cause the third and fourth arms to pivot about the fixed pivot points. The cam has an axis of rotation which is orthogonal to a direction of motion of the card held in card transport unit. The third arm has a mechanism for engaging the second end of the first arm when one of the diametrically spaced lobes is engaging the cam follower of the third arm to cause the first ram to move from the first position towards the second position and the fourth arm has a mechanism for engaging the second end of the second arm when one of the diametrically spaced lobes is engaging the cam follower of the fourth arm to cause the second ram to move from its first position towards its second position. A motor is provided for rotating the cam.

The embosser further includes a mechanism for embossing blank cards of various thickness with characters of uniform height. The mechanism for embossing blank cards of varying thickness preferably includes a pivot shaft functioning as the pivot point for one of the first and second arms; a support member having a slot having first and second ends, the pivot shaft of the one of the first and second arms extending through the slot and is movable between the first and second ends of the slot; a mechanism for applying a biasing force to the one arm which forces the arm toward the embossing wheels by movement of the pivot shaft within the slot to force the pivot shaft to contact the first end of the slot; the biasing force opposing a reaction force applied to the rams during embossing of a blank card so that a reaction force exceeding the biasing force causes the pivot shaft to move toward the second end. The force is preferably applied by a compressed spring. Preferably the support member is contained in a part of the common shaft for the punch wheel and die wheel with the slot being cut axially in the common shaft; and the pivot point for the remaining one of the first and second arms extends through another part of the common shaft.

A topper for applying a topping to embossed cards in accordance with the invention includes a card transporting unit for moving cards from a wait station to a topping station where topping is applied to characters on embossed cards; a support surface having a first end and a second end the support surface being rigid with respect to force applied between the first and second ends which is orthogonal to a surface of the card having the embossed characters; a flat surface for rigidly supporting a back surface of an embossed card located at the topping station and connected to the first end of the support surface, the back surface being the surface of the embossed card to which the topping is not applied; a heated platen which is movable from a first position remote from the surface of the card which has the embossed characters to be topped to a second position at which a surface of the platen forces a topping bearing foil into contact with the embossed characters to heat fuse the topping to the embossed characters, the platen having a face which contacts the topping bearing foil in the second position and which is substantially parallel to the flat surface in moving from the first position to the second position; a suspension for supporting the platen including a base having first and second ends and first and second parallel flexible members which have a cross section with an elongated dimension being orthogonal to the direction of motion between the first and second positions and which have first and second ends, the first ends of the first and second flexible members being connected respectively to the first and second ends of the base; an attachment plate carried by the platen having first and second parallel ends, the first and second ends of the attachment plate being respectively connected to the second ends of the first and secod flexible members; a mechanism for moving the platen from the first position to the second position which causes the flexible members to bend while maintaining a parallel relationship with each other and the surface of the platen substantially parallel to the support surface during movement from the first position to the second position, the means for moving the platen having a movable member which is connected to the platen and being connected to the second end of the support surface; and a source for providing topping bearing foil between the surface of the platen and support surface. Preferably, the flexible members are metallic and function to radiate and conduct heat from the heated platen. The topper further includes a rotatable support for a roll of topping bearing foil; a first foil guide mounted below the heated platen and support surface; a second foil guide mounted above the platen and set back from the support surface to cause the foil to form an acute angle between the card and surface of the foil between the second guide and the card at the time the heated platen has been withdrawn to its second position after the topping is fixed to the embossed characters of the card by the heated platen; and a foil take up for causing the foil to be unwound from the roll of foil, moved over the first foil guide, past the platen and support surface, over the second foil guide an to the take up. The topper further includes a slot which extends between the first and second foil guides and the support surface on one side of the platen to permit a continuous strip of foil to be routed over the guides from the one side and; an intermediate section joining the first and second ends of the support surface is disposed on the other side of the platen. The intermediate section may be narrower than the first and second ends in a direction orthogonal to the direction of motion of the platen. The second foil guide may be spring biased in a first position and is pivotable from the first position in a direction toward the second end of the support surface to a second position, the acute angle being greater for the second position of the second foil guide than the first position, the second foil guide being pivoted toward the second position when the foil take up is activated to cause the foil to be peeled away from contact with the embossed characters by the increase in the acute angle. The motor for driving the platen is controlled to cause a force to be applied by the platen against the embossed card to be topped which is proportional to the number of characters which are embossed on the embossed card. The take up may be programmed to set the amount of foil to be taken up after topping each card.

A transport mechanism is provided for moving embossed cards from the wait station to the topping station including a channel extending from the wait station to the topping station which engages an edge of an embossed card during movement from the wait station to the topping station and a drive unit for driving an edge of the card to be topped opposed to the edge engaged by the channel for moving an embossed card from the wait station to the topping station. The drive unit for engaging an edge opposed to the edge engaged by the channel comprises a plurality of driven rollers having their axes of rotation mounted in a line when contacting an edge of a card disposed above the channel. Each driven roller has a peripheral surface which engages the edge of an embossed card being driven from the wait station to the topping station and a drive mechanism for rotating each driven roller. Each driven roller has its axis of rotation mounted in a first position vertically spaced from the channel in a suspension which permits vertical deflection of its axis upward from the first position to a second position to permit cards of varying width to be moved from the wait station to the topping position without adjustment.

An embossing system for embossing blank cards with a plurality of vertically separated horizontally disposed lines on which characters are to be embossed in accordance with the invention includes a card hopper for holding blank cards to be embossed; a mechanism for removing a single card from the card hopper and moving the card to a card insertion position located before a pickup position at which the cards are held in a fixed position; a card transport for receiving blank cards at the card insertion position and for transporting the blank cards held in a fixed position at the pickup position along a transport path to a plurality of embossing positions and to a position where embossing is completed, the transporting mechanism having a driven belt having a plurality of evenly spaced card gripping units attached thereto for receiving successive cards at the insertion position and during driving of the belt the individual card gripping units moving along the transport path to move cards held thereby in a straight line; each card gripping unit including a leading edge gripper and a trailing edge gripper which are attached to the belt at spaced apart locations, each card gripper having a slot having an opening for receiving an edge of a card being moved by the mechanism for removing and moving having two opposed spaced apart sides and a surface connecting the sides, at the pickup position the surface connecting the sides of each of the edge grippers being substantially in line with a retainer extending orthogonally outward from one of the sides of each of the edge grippers toward the other opposed spaced apart side, each retainer being biased to a first position at which a card is held in the fixed position and movable from the first position to a second position at which a card engages the surface connecting the two sides; a mechanism for causing the retainer of each pair of a leading edge card gripper and a trailing edge card gripper to move to their second position when the pair of a leading edge card gripper and a trailing edge card gripper are moved to the card insertion position at which the mechanism for removing and moving a single card pushes an edge of the card into engagement with each surface connecting the two sides of each of the edge grippers of a pair of a leading edge and a trailing edge gripper and for causing the retainers to move to their first position when each pair of a leading edge gripper and a trailing edge gripper moves to the pickup position; a plurality of embossing units located at separated embossing positions to emboss cards held by each pair of a leading edge and a trailing edge card gripper as the cards move through the embossing positions; and a controller to control the mechanism for removing and moving, the card transport and the card embossing units to control the movement of the cards from the hopper to the card insertion position, the movement of the card transport to move the cards to the embossing positions and the plurality of embossers to emboss characters on the cards as the cards are positioned at the embossing positions. The trailing edge card gripper has a mechanism for pushing a card to a reference position with respect to the transport path while the leading edge and trailing edge card grippers are at the card insertion position. Preferably, the mechanism for pushing the card to the reference position is a member which projects orthogonally outward from the trailing edge gripper through a plane contained within the slot of the leading edge and trailing edge card grippers. The member is mounted on the trailing edge card gripper at a point upstream of the surface connecting the spaced apart sides. The controller causes the mechanism for moving the card into contact with the surface connecting the two sides of the leading edge gripper and the trailing edge gripper to apply a predetermined force. The predetermined force is produced by a motor which pushes the card into contact with the surface connecting the two sides the leading edge gripper and the trailing edge gripper to stall the motor with a constant torque. The mechanism for causing the retainers of each pair of a leading edge card gripper and a trailing edge card gripper to move to the second position comprises a cam located at the card insertion position; and a cam follower carried by each pair of a leading edge card gripper and a trailing card gripper which engages the cam to move the retainers to their second position as long as the cam engages the cam followers. The embossing system further includes a mechanism located at the position where embossing is completed to cause the retainers of each pair of a leading edge gripper and a trailing edge gripper to move to their second position to release a card from engagement of the pair of leading and trailing edge grippers. The mechanism located at the position where embossing is completed includes a cam located at the position where embossing is completed which engages the cam followers carried by each pair of a leading edge card gripper and a trailing edge card gripper to move the retainers to the their second position as long as the cam engages the cam followers. The embosser further includes a flat reference surface which is parallel to the straight line of the transport path and each pair of a leading edge gripper and a trailing edge gripper is pushed into contact with the reference surface when the mechanism for removing and moving positions the card at the card insertion position so as to insure that the card engages the surface connecting the sides. Each of the leading edge and trailing edge grippers has a mechanism for suspending the grippers with rolling contact on the reference surface to minimize friction.

An embossing system for embossing blank cards with a plurality of vertically separated horizontally disposed lines on which characters are to be embossed in accordance with the invention includes a card supply for feeding blank cards to be embossed; a card transport for receiving blank cards to be embossed from the card supply and for transporting the cards received from the card supply along a transport path to a plurality of separate embossing positions and to a position where embossing is completed; a plurality of card embossing units each disposed at a separate one of the embossing positions along the transport path, each card embossing unit being vertically positioned with respect to the transport path to emboss a different one of the horizontally disposed lines of the characters on each card; and a controller coupled to the card supply, the card transport and the plurality of card embossers for controlling the card supply to feed blank cards to the card transport, the transporting of the cards received by the card transport to the separate embossing positions along the transporting path and the position where embossing is completed, the plurality of card embossing units to emboss the plurality of lines on each blank card, and comparing a current longitudinal position of the cards being embossed by each of the card embossing units determined with respect to a datum point of the transport unit with a longitudinal position of a next character to be embossed on the cards being embossed by each of the card embossing units on each of the horizontally disposed lines to identify a longitudinal position of one or more closest next characters to be embossed on any of the horizontally disposed lines which are closest to the current longitudinal position, moving the card transport to the longitudinal position of the closest one or more next characters to be embossed, and activating the one or more characters which are to emboss the closest one or more next embossers to emboss the one or more next closest characters.

BRIEF DESCRIPTION OF THE DRAWINGS

FIG. 34 illustrates an example of data records which are embossed by embossing units of the present invention.

DESCRIPTION OF THE PREFERRED EMBODIMENTS

Figure 1:
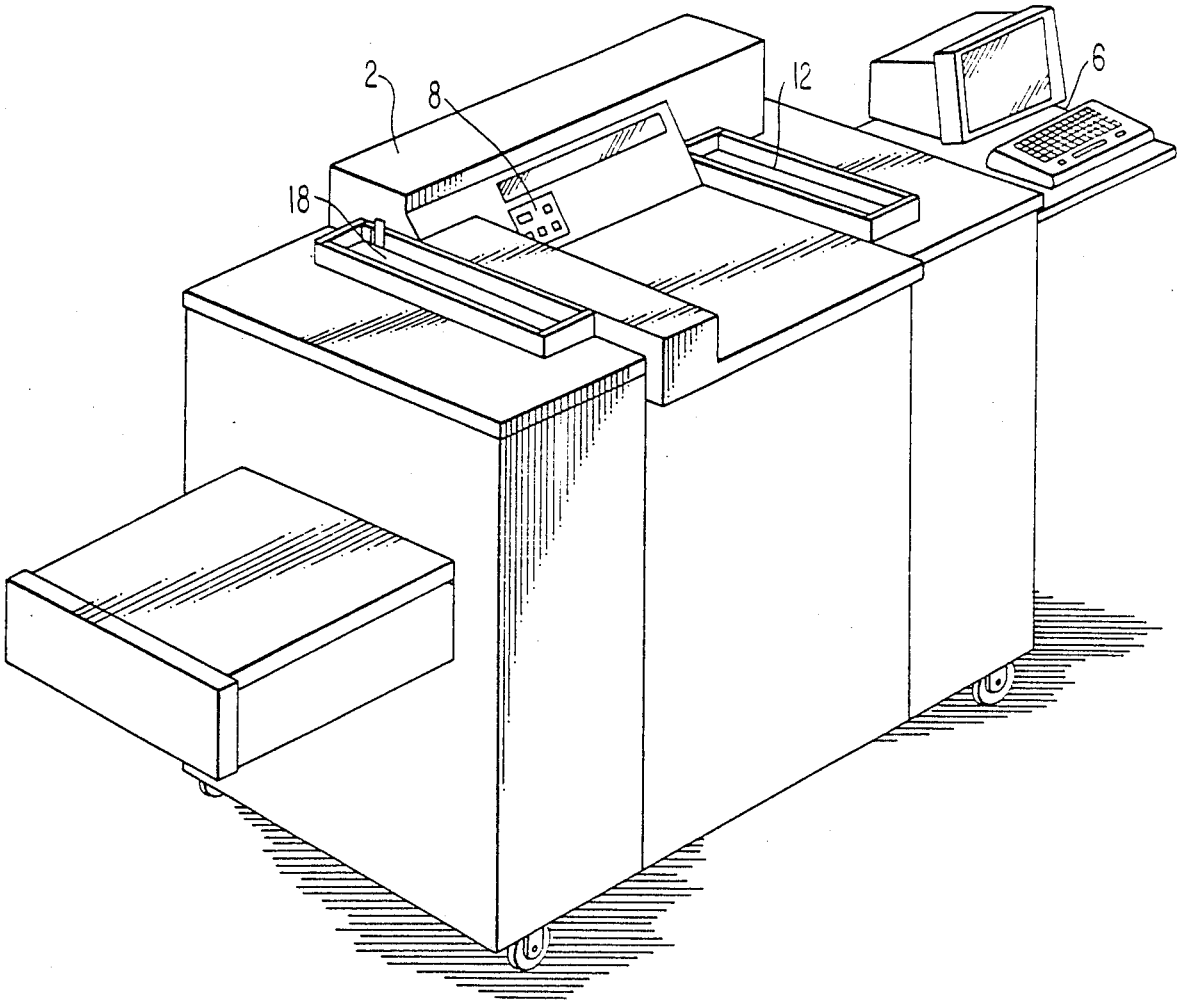
FIG. 1 illustrates a perspective view of a commercial embodiment of the present invention.

FIG. 1 illustrates a perspective view of a commercial embodiment of an embossing system in accordance with the present invention. The housing 2 covers many of the major components of the embossing system which are discussed in detail, infra. The input hopper 12 holds a plurality of blank cards to be embossed. The operator console 6 has a keyboard and CRT. The CRT displays various messages including the identification of the data records being processed at each of the parts within the system and error messages occurring at each of the parts. The keyboard is used for the entry of commands. The operator control panel 8 controls the activation of the system including the control of power. The magnetic tape drive for providing data records has been omitted from illustration because of its conventional nature. The operator console 6 and the control panel 8 are not discussed in further detail because of their conventional nature. The stacker 18 stores cards which have been embossed and topped.

Figure 2:
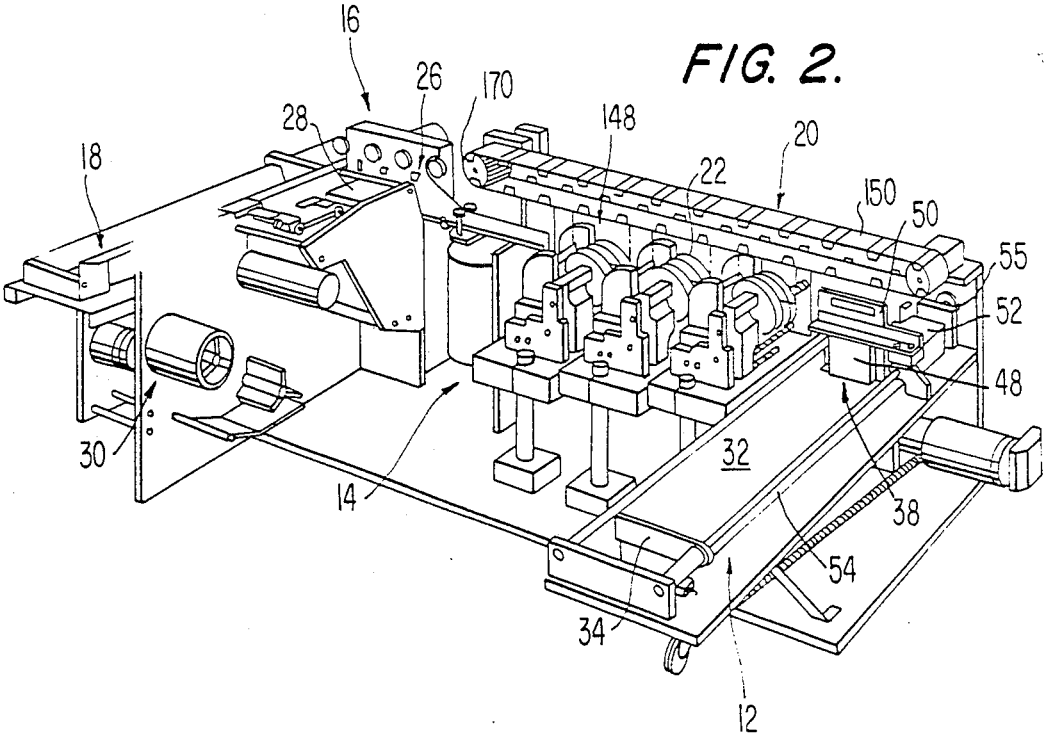
FIG. 2 is a perspective view of the preferred embodiment of the present invention.

FIG. 2 illustrates a perspective view of the major components of the embossing system 10 which are the input hopper 12, three in line embossing units 14, topper 16, output stacker 18 and card transport unit 20. The card transport unit 20 has a plurality of card grippers 148 which hold individual cards 22 to be embossed. The plurality of card grippers are attached to a belt 150 at uniformly spaced locations. Rotation of the belt 150 moves the individual cards past the embossing units 14. The three embossing units 14 are identical except for the pitch of the characters being embossed. Two of the embossing units 14 emboss 10 pitch A/N characters and the remaining embossing unit embosses 7 pitch OCR characters. The preferred form of the major components is described, infra. A pickup mechanism 38 elevates a single card at a time from the input hopper 12 to a card transport 20. The detailed construction of the input hopper 12 and pickup mechanism 38 is discussed with reference to FIGS. 2–6, infra. The detailed construction of the card transport 20 is discussed with reference to FIGS. 15–22. The card transport moves the cards past the individual embossing units 14 which each emboss a separate line of characters on each card. The preferred form of the individual embossing units 14 is described, infra, in conjunction with FIGS. 8–14. A transport unit 26 moves the individual cards from a wait station located to the left of the left-hand embossing unit 14 to topper 16 having a topping position where a heated platen 28 applies a heat fusible plastic material to the surface of the embossed characters to apply highlighting. The topper 16 has a foil drive unit 30 which advances foil (not illustrated) each time a card 22 is topped to position fresh topping in front of the heated platen 28. The detailed construction of the topper 16 is discussed with reference to FIGS. 25–31. The stacker 18 is located to the left of the topper 16 which stores the cards in an error free bin located in front of a movable gate and in a reject bin located to the rear of the movable gate which holds cards that contain errors. Error detection is discussed, infra.

The preferred embodiment of the embosser 10 embosses three lines of characters, which may be alphanumerical characters, including punctuation on a plastic card which may be a conventional credit card, promotional card or the like. The format of the individual lines of data is discussed, infra, in conjunction with FIG. 7. The preferred form of the individual embossing unit 14 for embossing OCR Characters has 10 selectable characters and the embossing units for embossing the A/N characters has 39 selectable characters. A single line on a card is embossed with characters of a single pitch.

The major components of the embosser 10 are controlled by microprocessor driven controllers. The electrical control circuitry for the major components including microprocessors is discussed, infra, in conjunction with FIGS. 40A–B, 41A–C, 42A–B, 43A–B and 44A–B. The preferred form of control program for each of the microprocessors used to control the major components is contained in a source code listing within the Microfiche Appendix referred to, supra, and will not be discussed in detail herein except to the extent necessary to understand the operation of the invention.

The electrical control circuitry (not illustrated) is mounted in the rear of the housing 4 of embosser 10 and consists of a master controller, three embosser controllers and a hopper/topper controller. The master controller is directly connected to the operator console, the magnetic tape drive and the card transport belt drive. The master controller is connected to the remaining controllers via a main communication bus (not illustrated) to supply timing signals, control information and data to be embossed. The controller for each embossing unit 14 has its own microprocessor to receive data from the master controller and to report status to the master controller. The hopper/topper controller operates a drive hopper, a drive for the topper transport 26, a drive for a topper 12 ram, and a drive for the output stacker 18. The master controller manages the communication tasks for all of the embosser controllers and the hopper/topper controller. Data is transferred between the master controller and the operator console via a full duplex serial interface operating at 9600 baud. Buffers are provided for both the data received and the data to be transmitted. The actual transfer of data takes place on an asynchronous basis controlled by interrupt logic.

Data transfer from the magnetic tape drive to the master controller is conducted by a parallel interface and control logic which is part of the master controller. The transfer occurs on a demand basis without the use of interrupts.

Data transfer between the master controller and the embosser and hopper/topper controllers is accomplished by a half duplex, serial, multi-drop system. The various processors are selected by combining a master timing signal with one of four communication channel signals. The relationship of the master control signal with these communication channel signals is discussed, infra, in conjunction with FIG. 35.

An overview of the embossing operation is described with reference to FIG. 2 as follows. The embossing operation begins when a card 22 is raised vertically from the input hopper 12 by a pickup mechanism 38 to a card insertion position on the card transport unit 20 which is located upstream from a card pickup position where individual cards are fixedly attached to a gripper 148 discussed, infra, in conjunction with FIGS. 19–22. The card transport 20 moves the cards horizontally to the left past the various embossing units 14. The card transport 20 is stopped at each position where any one of the plurality of embossing units 14 is to emboss a single character which is referred to hereinafter as the "closest next character(s)". The algorithm for controlling the stopping of the transport unit 20 at the various embossing positions is described, infra. After a card passes through the left-most embossing unit 14, the card enters a wait station which is a position where the card is detached from the card transport 20 to await pick up by the transport unit 26 of the topper 16. When the transport unit 26 is activated, an embossed card is transported to the left to a topping station where the card is stopped with its back surface resting against a vertically extending rigid flat surface. The heated platen 28 is moved into contact with a foil coated with a heat fusible plastic which is pushed into contact with the embossed characters of the card to heat fuse the plastic material to provide highlighting. As the heated platen 28 is withdrawn, the foil drive unit 30 is activated to advance fresh foil in front of the heated platen and to peel the foil, which is heat fused to the characters of the card, away from contact with the characters. After the topping action is complete, the card is transported by the transport unit 26 to the stacker 18. The stacker 18 is controlled by the hopper/topper controller to group the cards into the error free bin or bin containing cards with errors in a manner described, infra. The force applied by the heated platen 28 is controlled by the hopper/topper controller to be directly proportional to the number of characters on the embossed card to be topped to ensure uniform toping.

Input Hopper 12 and Pickup Mechanism 38

FIGS. 2-6 illustrate the preferred form of the input hopper 12 and card pickup mechanism 38. With reference to FIG. 2, the input hopper 12 has a tray 32, which has a capacity for holding 500 cards of 0.030 of an inch thickness, and a spring loaded plate 34 which maintains pressure on a stack of cards 36 (FIGS. 3–4) to force them toward a pickup mechanism 38 which sequentially lifts a single card 22 from the stack upward to the card insertion position of the card transport 20.

The pickup mechanism 38 consists of two racks 40 which are driven by a pair of pinion gears 42 connected to a common drive shaft 44 of rack drive motor 46. The rack drive motor 46 has a shaft encoder that produces 100 pulses per revolution of the drive shaft 44. Two complete revolutions of the drive shaft 44 elevate a card from the rear of the tray 32 to the card insertion position where it is subsequently moved to the card pickup position at which the card is fixedly gripped by a card gripper 148 of the card transport 20. A stop 45 limits the upward travel of the racks 40. The pickup mechanism 38 has a vertical plate 48 against which the rear surface of a card slides as it is lifted from the tray 32 to the card insertion position. A picker knife 50 is attached to a mounting block 52 which is connected to right-hand cylindrical guide 54 for the spring loaded plate 34. The position of the picker knife 50 with respect to the vertical plate 48 is adjusted by an adjustment mechanism 53 to be positioned in front of the vertical plate 48 by a distance slightly greater than the thickness of a card 22 to be embossed to provide a throat 55 to prevent more than one card at a time from being lifted from the tray 32 to the card insertion position. The adjustment mechanism 53 has a vertical member 53' which is fixedly attached to the base 53''. The mounting block 52, which carries the picker knife, is slidably mounted on rod 54. Shaft 56 threadably engages a nut 56' attached to vertical member 56'' and is slidably mounted within a smooth bore extending through vertical member 53'. Rotation of the knurled wheel 57 causes the mounting block 52 to slide on rod 54 to adjust the size of throat 55. Spring 57' is in a compressed state which causes the end 57'' of knurled wheel 57 to be biased against the vertical member 53'. The picker knife 50 contains a plurality of ball bearings 58 which are mounted within its body to minimize friction with a card during elevation to the card insertion position. The ball bearings 58 are retained by leaf springs 58'. Each of the racks 40 has a horizontal forward projecting edge 59 mounted on the front surface to engage the bottom edge of a card at the end of the stack of cards 36 which is to be elevated to the card insertion position. As a card held by the horizontal forward projecting edge 59 moves upward, the picker knife 50 prevents more than one card from being pushed through the throat 55 between the picker knife and the vertical plate 48. A sensor 60 is mounted on a bracket mounted on the vertical plate 48 for sensing when a card 22 has been elevated to the card insertion position. The activation of the rack drive motor 46 is controlled by the hopper/topper controller, described infra, so that the card is elevated when the card transport 20 is located at a predetermined position which preferably is the twentieth increment of the transport path with individual increments being defined in increments of 1/280th of the spacing between individual embossing units 14 and the circumference of the pulley 170 driving the belt 150 of the card transport 20. The control of the card transport 20 as a function of position increments is discussed, infra.

Figure 7:
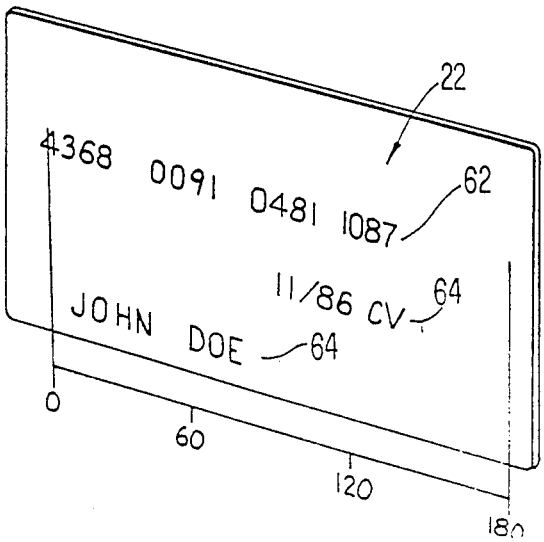
FIG. 7 illustrates a typical card 22 which is embossed by the present invention.

FIG. 7 illustrates a typical card 22 which may be embossed with an embosser 10 of the present invention. As illustrated, the card has a format of a conventional bank card having a single line 62 having OCR characters which are 7 pitch with a center-to-center spacing of 1/7 of an inch and two lines of A/N characters 64 of 10 pitch with a center-to-center spacing of 1/10 of an inch. Each line 62 and 64 is embossed by a separate one of the mbossing units 14. The vertical position of the lines is controlled by the vertical adjustment of the mounting assembly of the individual embossing units as described, infra, in conjunction with FIG. 10. The information for embossing each card 22 is stored sequentially on the magnetic tape unit as data records prior to loading into the memory of the master controller. During operation, the individual characters of the records are read by the controllers for the embossing unit 14 from the memory of the master controller as they are embossed. For the card 22 as illustrated, each stored data record has four fields with the first field being a six digit card identification number and the remaining fields containing the characters for the lines 62 and 64. Each possible character position is encoded as an actual character or a blank space character. The end of a line is encoded as an end of line command.

Embossing Units 14

FIGS. 8–14 illustrate the preferred construction of each of the embossing units 14. The embossing units 14 are of an identical construction except for embossing different pitch characters. However, it should be understood that the present invention may be used to emboss multiple lines with a single pitch.

Figure 13:
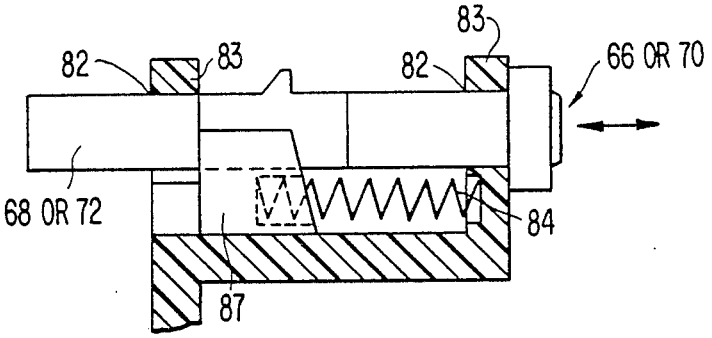
FIG. 13 illustrates the mechanism for mounting an individual character element within an associated wheel of an individual embosser unit in accordance with the present invention.

Each line 62 or 64 of a card 22 is embossed by one of the three embossing units 14. An embossing unit 14 has a punch wheel 66 carrying male character elements 68, which are movable from a retracted position to an embossing position, and a die wheel 70 carrying female character elements 72, which are movable from a retracted position to an embossing position, that are both mounted on a common shaft 74. The punch wheel 66 and die wheel 70 are ganged together by a flange 71 which rotates on the common shaft 74. A motor and shaft encoder 76 is attached to the shaft 74 to drive the pair of wheels 66 and 70 to a plurality of different circumferential positions at which characters are embossed or a blank is left. While each embossing unit 14 may have character sets for OCR characters or A/N characters, all of the wheels have a space 77 at a separate circumferential position from the characters which is the circumferential position of the wheel when a space is to be left on a blank card. With reference to FIG. 13, each male character element 68 and female character element 72 is mounted in an aperture 82 which extends through the pair of circular plates 83 which define wheel 66 or 70 to permit reciprocation from a retracted position to an embossing position and a spring 84 biases each of the male elements 68 and female elemnts 72 to their retracted position by engaging surface 86 of one of the circular plates 83 and a plastic block 87 which is attached to the male or female character element with the spring being in a compressed condition to force the element to its retracted position. A ram 88 is provided in association with each wheel which is movable from a first position which does not cause the character elements of the wheels to emboss a character to a second position which contacts one of the character elements to cause the embossing of a character if the circumferential position having the space for leaving a blank on the card is not aligned therewith. A retractor 89 is pivotably attached to each arm 90. The function of each retractor 89 is to withdraw the character elements 68 and 72 which can stick to the card 22. Each ram 88 is pushed by the vertically extending arm 90. Each ram 88 has a vertically projecting stud 91 which engages the retractor 89 to insure that it is withdrawn when the ram is moved back to its first position. The arms 90 are pivoted through separate parts of the common shaft 74. The arm 90, which is associated with the die wheel 70, has a fixed pivot shaft 92 and the arm 90 associated with the punch wheel 66 has a pivot shaft 93 which is axially movable along the common shaft 74 in a slot 96 contained therein. One end of compressed spring 98 contacts a sliding sleeve 97 which contacts the pivot shaft 93 to urge it to the first end of the slot 93 closest to the embossing wheel 66. Typically the slot 93 is 1/32 of an inch longer than the diameter of pivot shaft 93. The other end of compressed spring 98 contacts a nut 100 which is locked in a fixed axial position by nut 102 on a threaded portion (not illustrated) shaft 74. The end of the common shaft 74 over which the spring 98 is engaged is threaded to permit the adjustment of the degree of compression by adjustment of the nuts 100 and 102. The combination of the slot 96, which receives the pivot shaft of the punch wheel, the compressed spring 98, the nuts 100 and 102, and the threaded portion of the common shaft 74 functions as a mechanism for embossing blank cards of varying thickness with characters of uniform height during continued operation of the embosser. The shaft encoder 76 drives the ganged pair of the punch wheel 66 and die wheel 70 by a transmission 104 having three gears which couple the output shaft of the encoder 76 to the punch wheel 66. A sensor 106 is provided to detect if a card is associated with each of the individual embossers.

The mechanism for producing embossed characters of uniform height for cards of varying thickness is adjusted by adjusting the degree of compression of the spring 98 by locking of the nut 100 in a fixed position by locking nut 102. This adjustment sets the height of the embossed character independent of the thickness of the card by determining the maximum force to be applied during embossing. If a card 22 of a thickness greater than the thickness of a standard card thickness is to be embossed, without the mechanism for embossing cards of varying thickness with characters of uniform height, the thicker card would cause a character of a greater height to be produced as a consequence of greater penetration of the punch and die element of the character to be embossed into the card. With the mechanism for producing characters of uniform height for cards of variable thickness, any reaction force above that which is sufficient to produce a character of the uniform desired height, is relieved by the displacement of the pivot shaft 93 within the slot 96 away from the punch wheel 66. Thus, the appropriate set up of the spacing between the punch and die wheels 66 and 70 in combination with the choice of the right degree of compression of the compressed spring 98 ensures that cards of any thickness will be embossed with characters of the same height. This mechanism eliminates the necessity for manual set up of the embossing system each time cards are to be run of differing thickness and further produces uniform height embossed characters within a single run of cards which have varying thickness.

Each of the individual embossing units 14 is connected to a base by a front and a rear shaft 120 with height adjustment being made by a threaded jack 122. The threaded jack 122 is located adjacent to the front shaft 120 to permit the vertical adjustment of the individual embossing units 14 to adjust the vertical location of the lines of characters 62 and 64 on the individual cards 22 by positioning the vertical position of the embossing wheels 66 and 70 with respect to the cards held in the reference position by the card transport 20. The extended boss stud 124 joins the embossing unit 14 to the base 123 through the jack 122. The jack 122 adjusts the vertical height of the individual embossing units 14 by rotation of the knurled wheel 124 fixedly connected to threaded shaft 125 and a knurled locking wheel 126 with respect to the shaft to cause rotation of the threaded shaft within threads (not illustrated) of block 128. The rotation of wheel 126 into contact with the top surface of block 128 locks the vertical position of the embossing unit 14. The threaded shaft 129 is locked to the underside of the embossing unit 14 by nut 129'. Follower 129" is retained on the end of shaft 129 and engages the top surface of knurled wheel 124.

Figure 14:
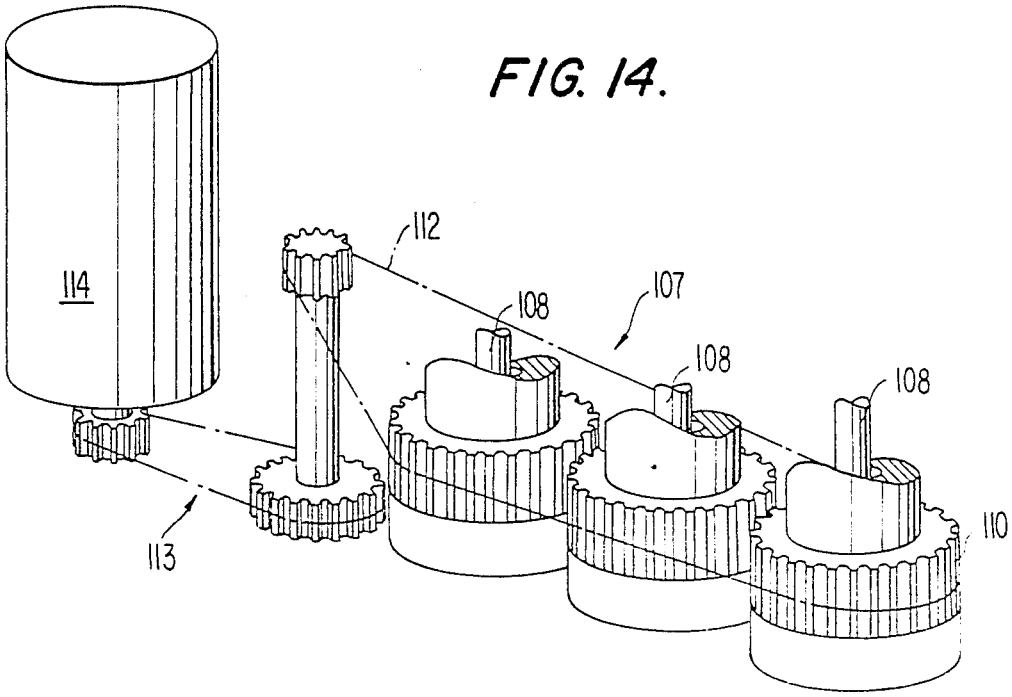
FIG. 14 illustrates the common drive unit for each of the embossing units of the present invention.
Figure 4:
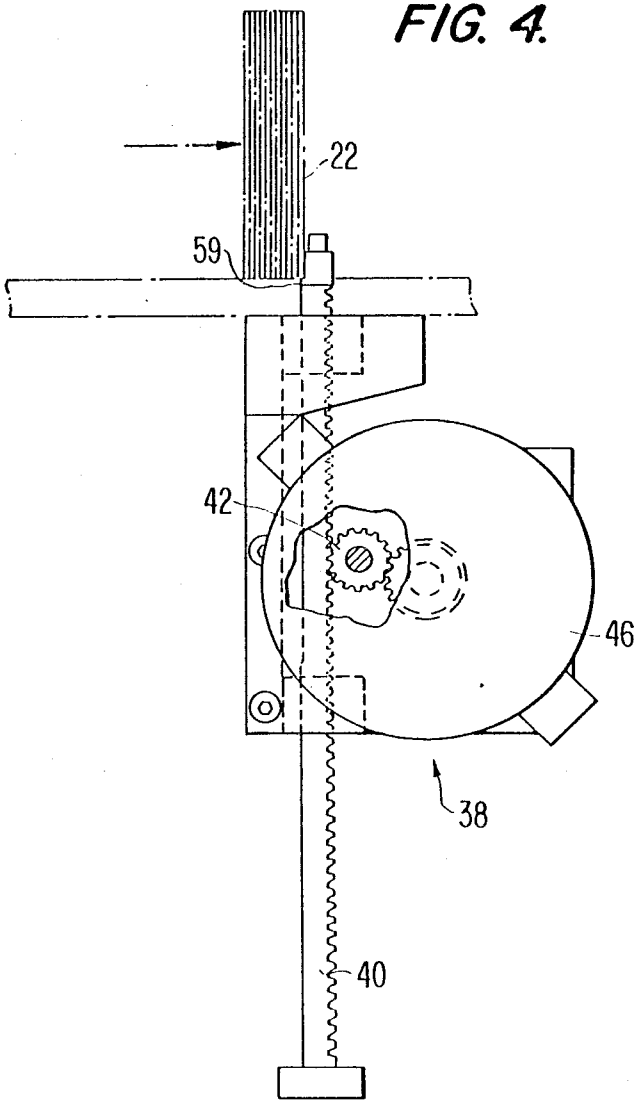
FIG. 4 is a side elevational view of the pickup mechanism.
Figure 3:
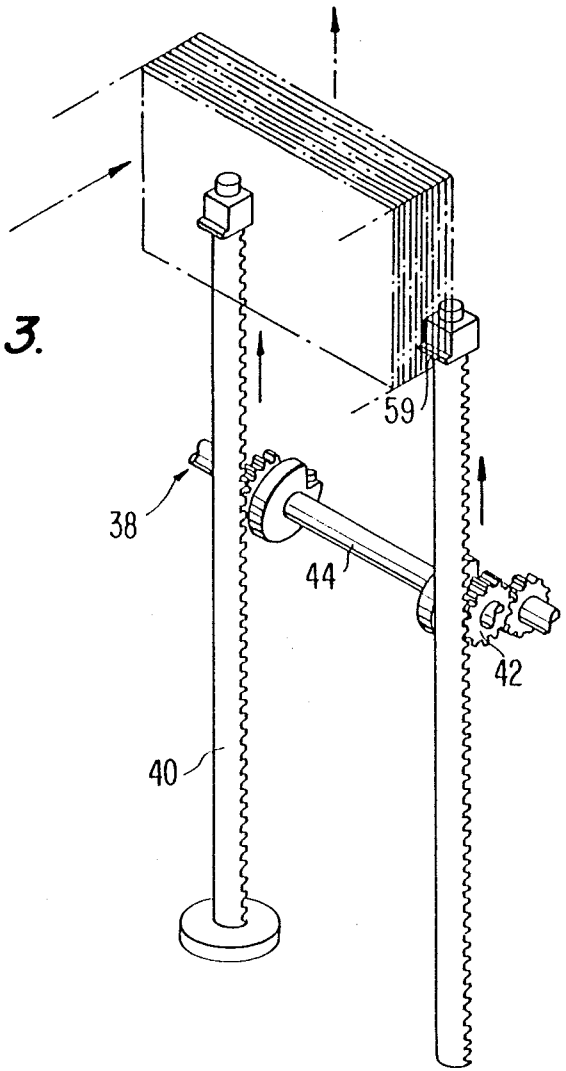
FIG. 3 illustrates a simplified perspective view of the pickup mechanism for moving individual cards from the input hopper to the transport unit.
Figure 5:
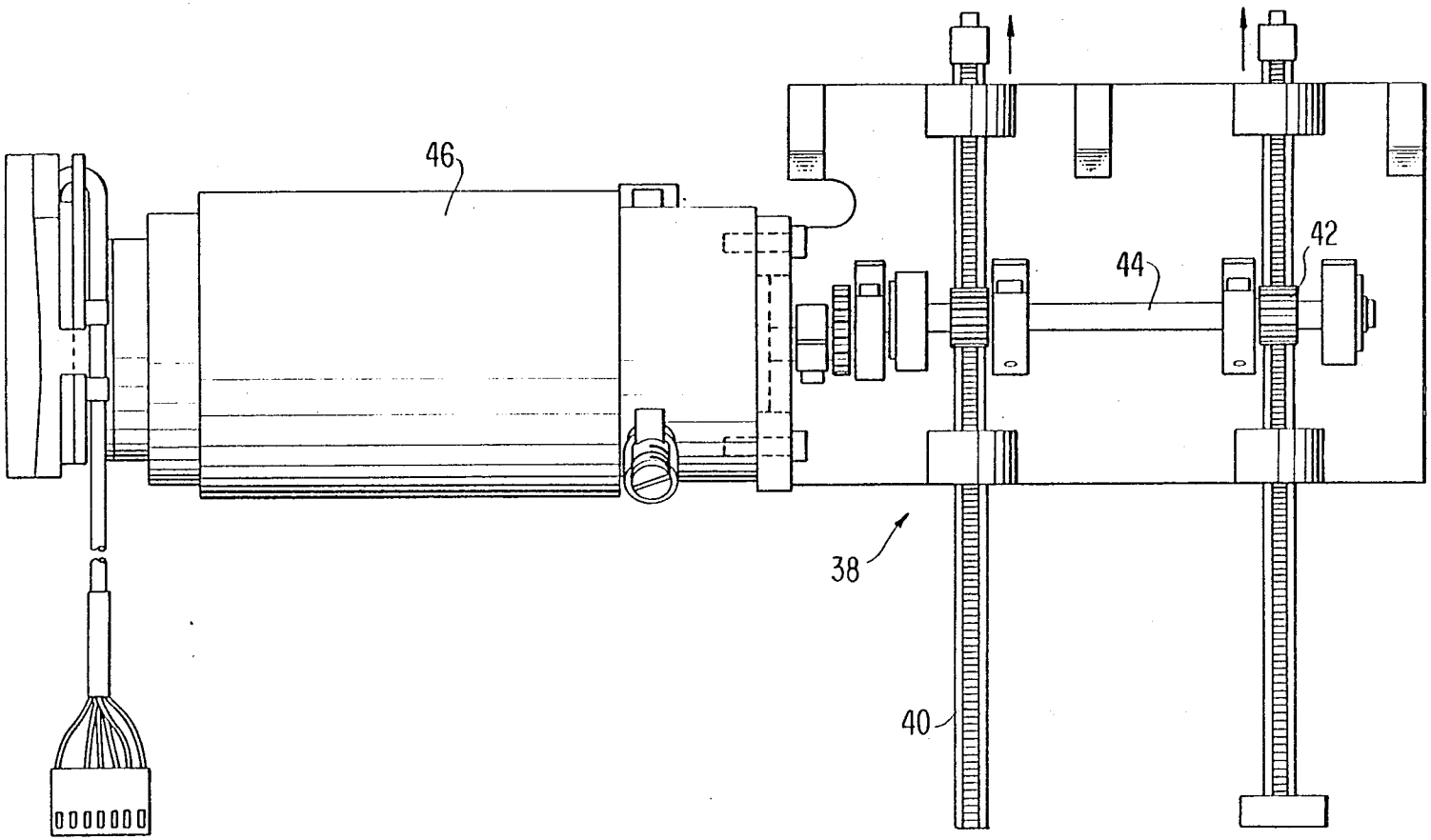
FIG. 5 is a rear elevational view of the pickup mechanism.
Figure 6:
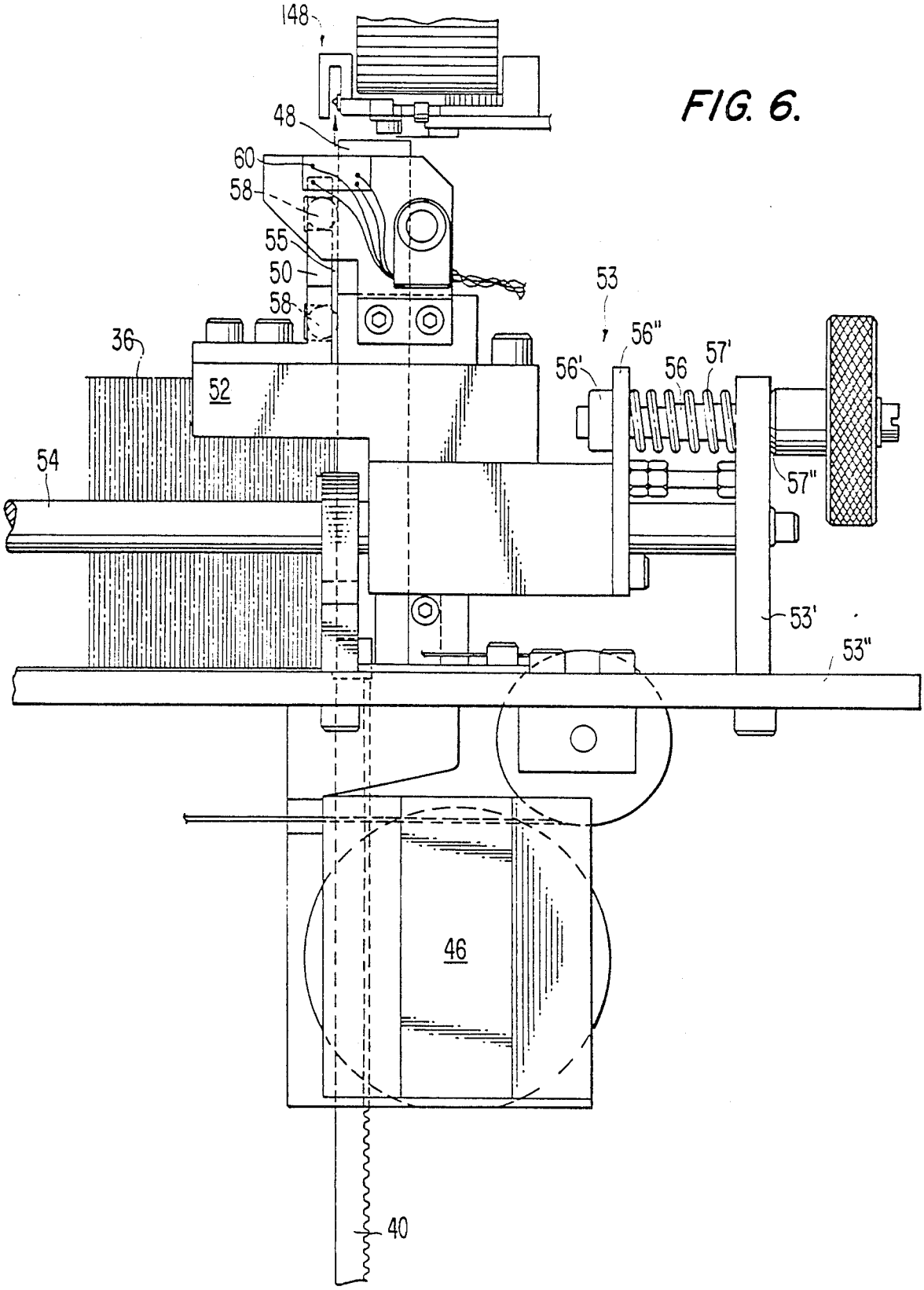
FIG. 6 is a side elevational view of the input hopper and pickup mechanism.
Figure 8:
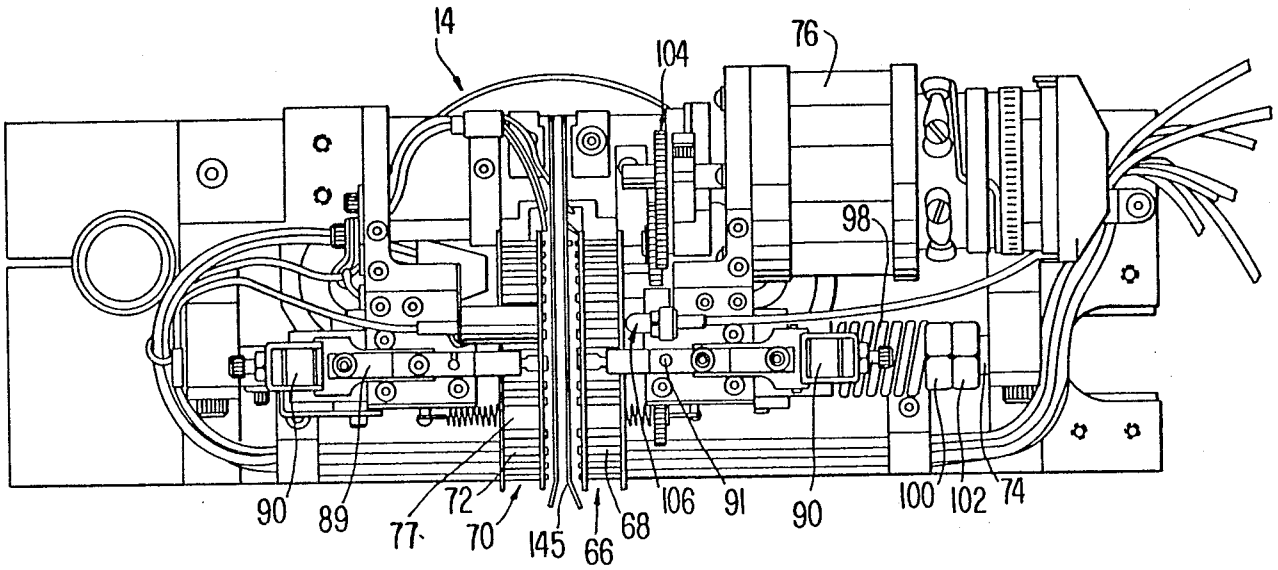
FIG. 8 is a top view of an individual embossing unit in accordance with the present invention.

FIG. 14 illustrates the common drive unit 107 for each of the embossing units 14. Each embosser has a vertically extending drive shaft 108 to which is connected a gear wheel 110 of a width which is substantially greater than the width of a common belt 112 used for synchronously driving each of the embossing units. The belt 112 is driven through a transmission 113 by a motor 114. The width of the gear wheel 110 being substantially greater than the width of the belt 112 permits the vertical position of the individual embossing units 14 to be adjusted without requiring vertical adjustment of the common drive for each of the embossing units. The vertical adjustment mechanism is discussed, infra. The gear wheel 110 is provided with sufficient mass so that its inertia carries the embossing wheels through the embossing operation without requiring the motor 114 to have a higher power output.

The spacing between the individual embossing units 14 is minimized as a consequence of the vertical axis of the drive shaft 108 of the individual embossing units 14. The vertically extending axis of rotation permits the gear wheels 110 to be driven in line with a single drive wheel mounted below the mechanism for activating the individual embossing units 14 which permits a close in line spacing that minimizes transport time of cards 22 between embossing units 14. A horizontally extending drive wheel for the individual embossing units 14 would preven the units from being closely spaced together. A close in line spacing permits higher throughput rates without using a higher powered drive for the card transport unit 20 to achieve higher transport velocity.

Figure 9:
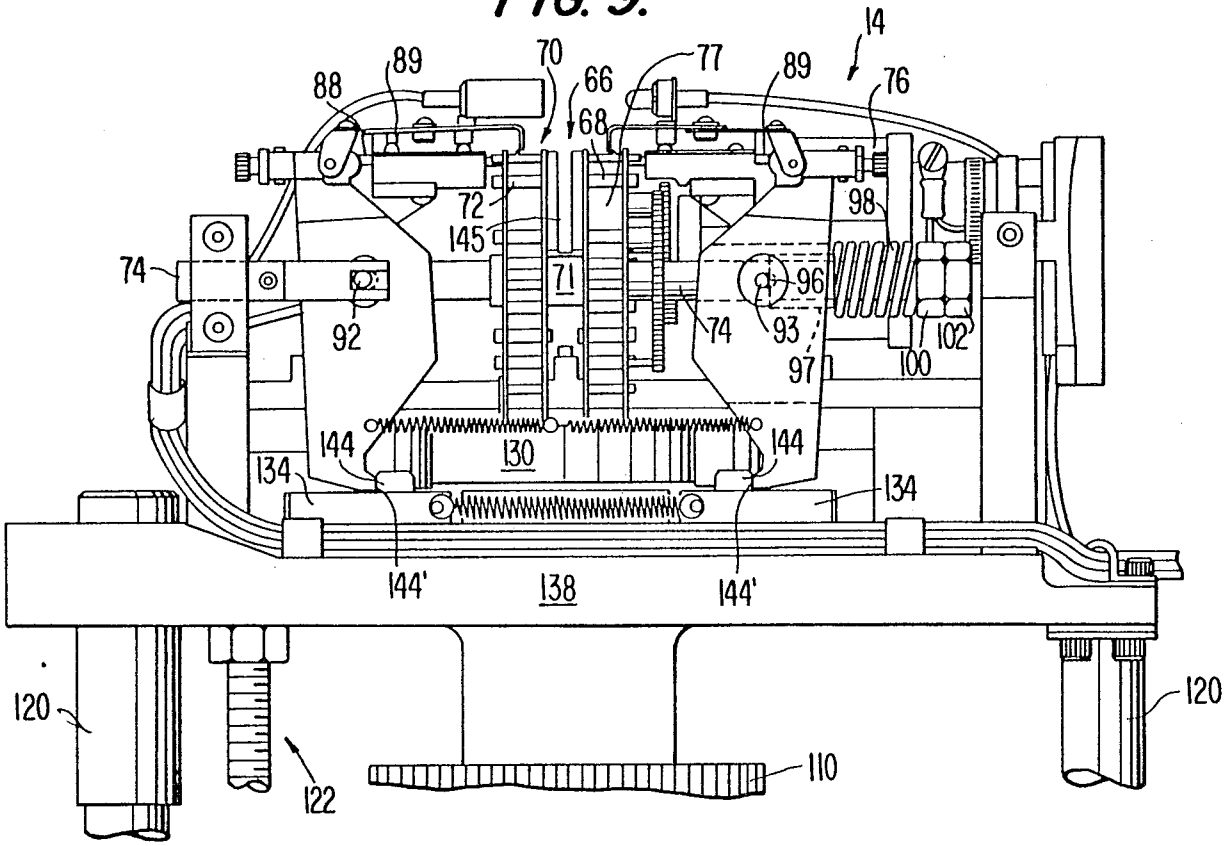
FIG. 9 is a side elevational view of an individual embossing unit looking toward the topper in accordance with the present invention.
Figure 10:
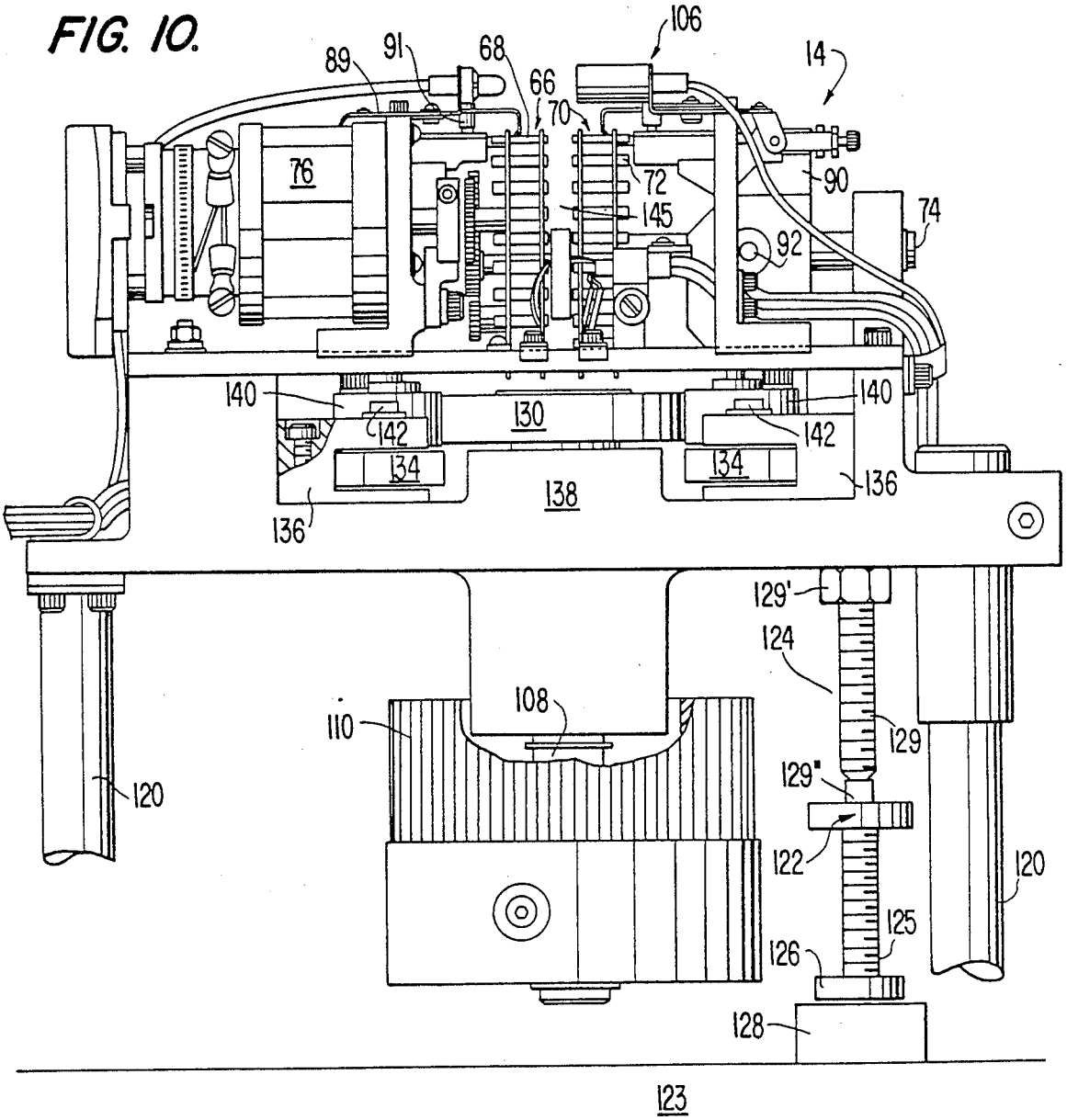
FIG. 10 is a side elevational view of an embossing unit looking toward the input hopper in accordance with the present invention.
Figure 12:
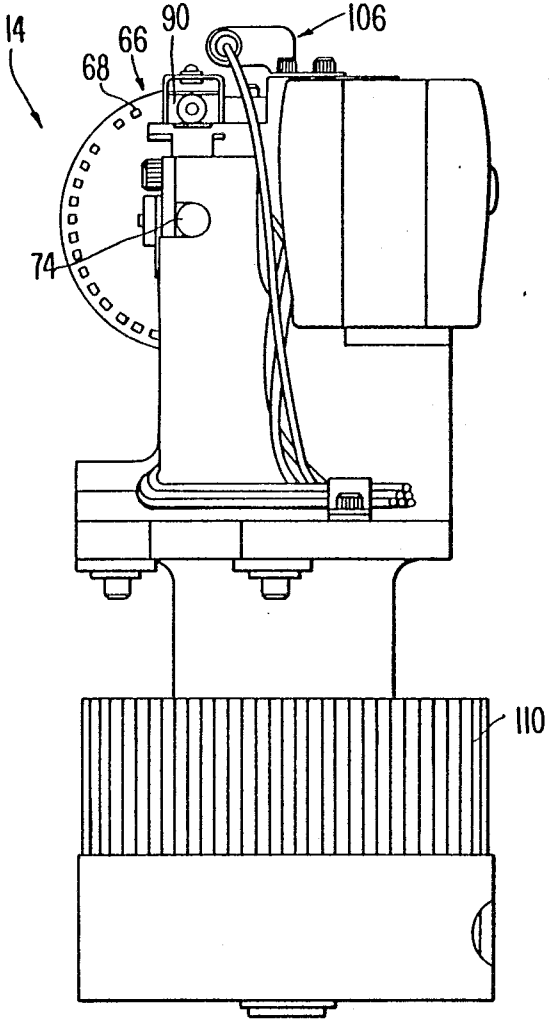
FIG. 12 is a rear elevational view of an embossing unit in accordance with the present invention.
Figure 11:
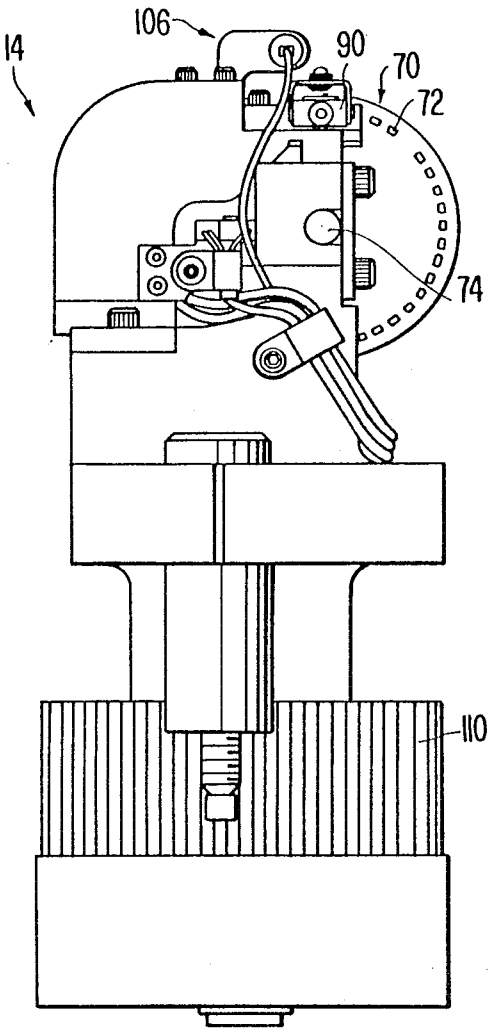
FIG. 11 is a front elevational view of an individual embossing unit in accordance with the present invention.

With reference to FIGS. 9 and 10, each drive shaft 108 has a cam 130 attached thereto which has a pair of lobes (elements 132 of FIG. 23) which activate the embossing mechanism twice for each rotation of the drive shaft. A pair of pivotably mounted horizontally extending arms 134 are mounted in blocks 136 which are attached to the base 138 of the embossing unit. A pair of rotatable wheels 140 are mounted on the respective arms 134 at a point intermediate the pivot point 142. A pin 144 projects orthogonally from the end of each arm 134 opposite the pivot point 142 which engages the ends of the arms 90 which are opposite the point of engagement of the arms 90 with the rams 88. The wheels 140 are in rolling contact with the peripheral surface of cam 130. As the cam 130 rotates to a position where the lobes 132 engage the wheels 140, the arms 134 are forced outward which causes the vertically projecting cylindrical pins 144 to force the ends of the arms 90 outward to cause the rams 88 to be forced from their first withdrawn position to their second embossing position to cause the embossing of a character on a card located between the punch wheel 66 and die wheel 70.

The movement of the point of contact 144' between the second end of arm 90 and the vertically projecting cylindrical pin 144 preferably is equally centered about the centerline extending through the pivot point 142, center of wheel 140 and pin 144 when the centerline is orthogonal to the shaft 74. This orientation minimizes sliding contact at point 144 by minimizing the height of the arc swung by the point of contact.

The synchronous drive of the drive shafts 108 by the common belt drive 112 powered by motor 114 illustrated in FIG. 14 causes the embossing mechanism to be continually activated in a cyclical manner when the lobes 132 of cam 130 engage the wheels 140 to produce two embossing cycles for each rotation of the drive shaft. The continuous activation of the embossing elements is produced without interposers as disclosed in U.S. Pat. No. 4,180,338 and necessitates that the movement of the card transport 20 holding the individual cards 22 must be accomplished during the period the lobes 132 are not engaging the wheels 140. A disk is attached to one of the cams 130, which is described, infra, in conjunction with FIG. 23, to produce timing signals which synchronize the operation of the embossing units 14 and transport unit 20. The synchronous operation of the embossing units 14 and card transport 20 minimizes the time required for embossing which enhances the throughput of the system which would not be present in a system using an asynchronous timing.

Card Transport Unit 20

FIGS. 15–18 illustrate the detailed construction of the card transport 20. The card transport 20 has 12 pairs of card grippers 148 which are attached at uniformly spaced locations to a belt 150 having teeth. The centers of the adjacent card grippers 148 are offset by the spacing between adjacent embossing units 14 which is equal to the circumference of the pulley 170 driving belt 150. The circumference of the belt 150 is equal to an integer multiple of the circumference of the pulley 170. Each card gripper 148 is comprised of a leading edge card gripper 152 and a trailing edge card gripper 154. The leading edge card gripper 152 and trailing edge card gripper 154 are of identical construction except that the trailing edge card gripper has a cylindrical pin 156 which is mounted within a bore of the trailing edge 158 to push a card 22 to a horizontal reference position at the card insertion position. The purpose of the pin is to establish the horizontal reference position with the belt 150 for each card 22 as the cards are transported through the in line embossing units 14. The vertical position of each card 22 in the card grippers, 148 is established by a slot 160 (illustrated in FIG. 20) having an opening for receiving the upper edge of a card 22 lifted by the pickup mechanism 38 previously described. The slot is formed by two spaced apart sides which are connected by a horizontally disposed surface at the bottom of the slot which joins the sides together. A horizontally disposed flat reference surface 168 is located above the individual card grippers 148 when they have rotated to a position of the lowest radius of drive pulley 170 and idler wheel 172 of the belt 150.

The drive pulley 170 is driven by drive motor 174 which has a shaft encoder attached thereto which provides 280 index pulses per revolution with a full revolution of the drive pulley 170 causing the belt to move 280 increments equal to 4 inches. Each increment of movement of belt 150 is, as a consequence of the 280 index pulses per revolution of the drive pulley 170, 1/70th of an inch (0.0143). The unit increment of distance (1/70th of an inch) moved by the pulley 170, idler wheel 172 and transport belt 150 is chosen to be equal to one divided by the product of the spacing per inch of each of the pitches. Encoding the movement of belt 150 in the increment unit of distance (1/70th of an inch) permits movement of the belt from its current position to the position of the closest next character(s) to always be measured for both the 7 pitch and 10 pitch embossing units 14 by counting in integer increments of the unit distance FIGS. 19-22 illustrate the detailed construction of an individual leading edge card retainer 152 and a trailing edge card retainer 154. As stated supra, the leading edge card retainer is identical to the trailing edge card retainer with the exception of the pin 156 which establishes the horizontal reference position for the individual cards.

Each of the card grippers 152 and 154 has a plastic body 176 which has an underside 178 which spans the width of belt 150. A front side 180 projects vertically upward from the underside 178 of body 176 to the front of belt 150. The front side 180 contains slot 160 which is comprised of spaced apart sides 162 and 164 and horizontally disposed surface 166 as previously described. The rear side 182 projects vertically upward from the underside 178 to the rear of belt 150. Each leading edge card gripper 152 and trailing edge card gripper 154 is attached to the belt 150 by an attachment mechanism 155 which is joined to the underside 178 and extends up through the belt. A front idler wheel 186 is joined to a front portion 187 of the underside 178 and a rear idler wheel 188 is joined to the rear portion 189 of the underside to provide a low friction rolling support on horizontally disposed surface 190 for the transport of cards 22 from the card pickup position through the embossing positions of the plurality of embossing units 14. A front idler wheel 192 is journalled in the top part 193 of the front side 180 above the belt 150 and a rear idler wheel 194 is journalled in the top part 195 of rear side 182 above the belt. The function of the idler wheels 192 and 194 is to provide a vertical reference established by horizontal reference surface 168 for a card contacting horizontally disposed surface 166 of a pair of a leading edge card gripper 152 and a trailing edge card gripper 154 which is movable with low friction over the horizontal reference surface while the pickup mechanism 38 is in its raised position. Each of the leading edge card grippers 152 and trailing edge card grippers 154 has a retaining pin 196 which is received within a pair of bores 197 within the underside 178 located respectively in the front side 180 and rear side 182. The retaining pin 196 is slidably mounted within the bores 197 to permit reciprocal motion into and out of the slot 160 respectively grip and release a card from grip. The end 198 of the retaining pin 196 has a small point which is driven into a plastic card to positively grip it in a fixed position when the individual retaining pins 196 are driven into the slot 160 by spring 200 in a manner described, infra. Each retaining pin 196 has a section 199 having a first diameter over which the coil spring 200 passes and a second section 201 having a second diameter which is larger in diameter than the coil spring that stops the coil spring. The coil spring 200 rides against the rear side 182 and the larger diameter section 201 of retaining pin 196 in a compressed condition to cause at least the point 198 of the retaining pin 196 to be biased into the slot 160.

Figure 15:
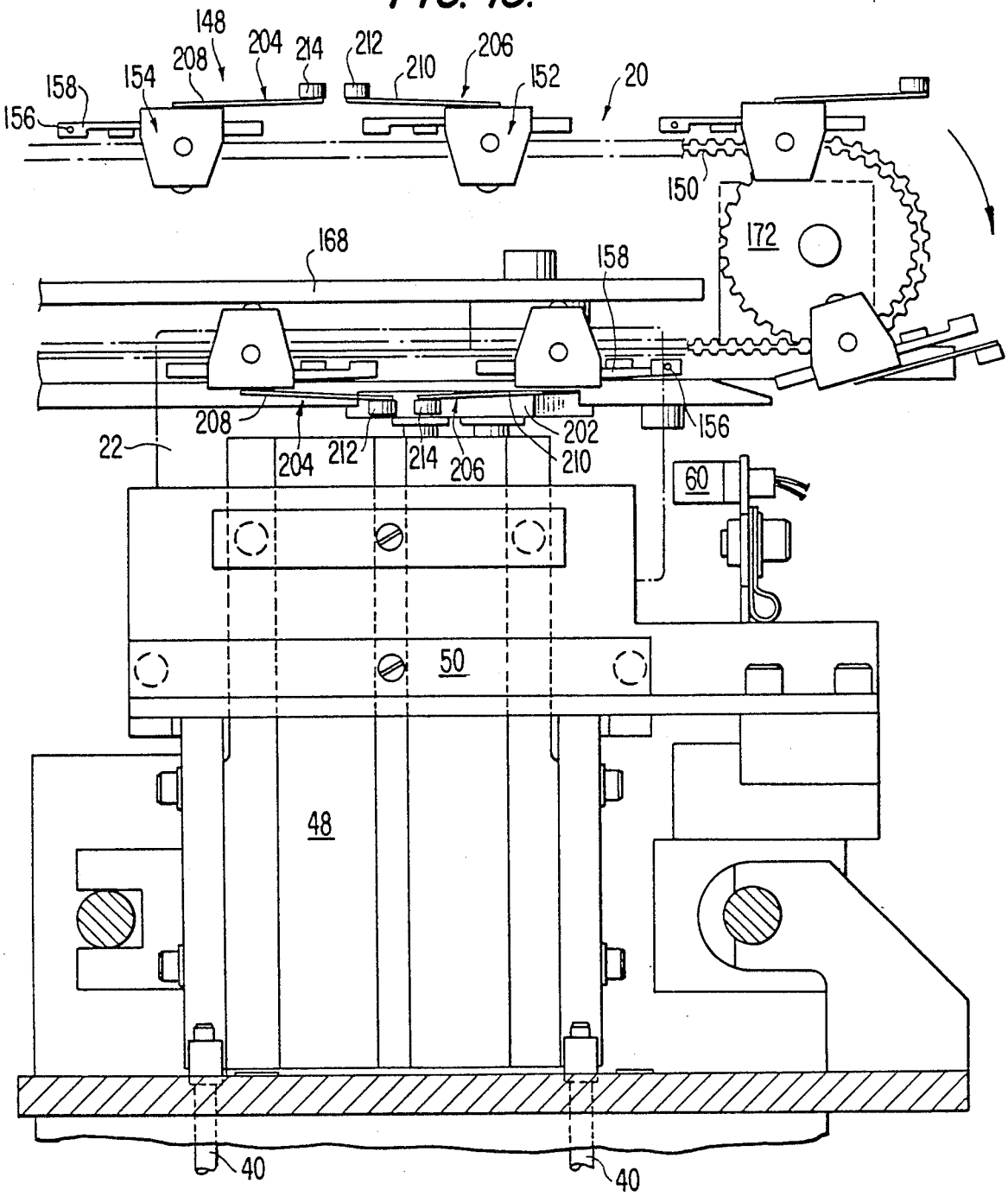
FIG. 15 illustrates a portion of the transport unit including the card insertion and pickup positions for individual cards.
Figure 16:
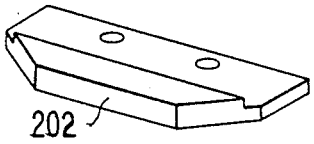
FIG. 16 illustrates the cam which is used to control the pickup of individual cards by the transport unit between the card insertion and pickup positions.
Figure 20:
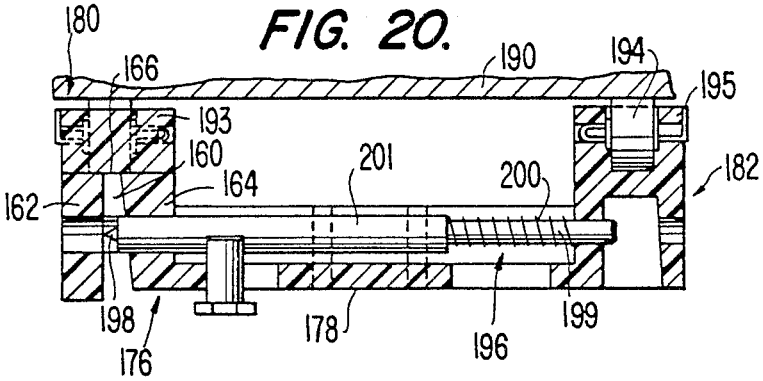
FIG. 20 is a cross-sectional elevation of an individual leading card retainer of the transport unit.
Figure 21:
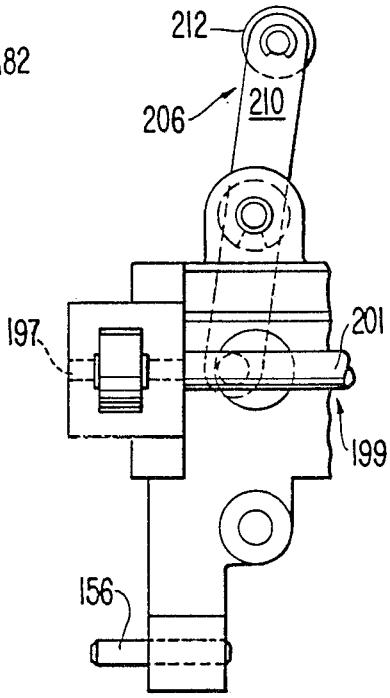
FIG. 21 is a partial top view of a trailing edge card retainer of the transport unit.
Figure 22:
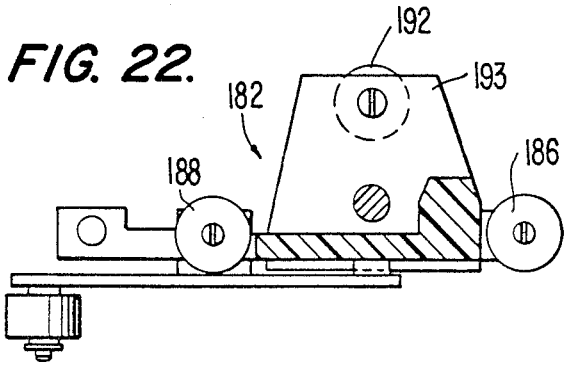
FIG. 22 is a sectional view of the rear of an individual leading edge card retainer of the transport unit.

The gripping of cards firmly by each pair of a leading edge card gripper 152 and a trailing edge card gripper 154 occurs at the card pickup position which is located downstream from the card insertion position. With reference to FIGS. 15 and 16, cam 202 is located at the card insertion position which causes a leading edge card gripper actuator 204 and a trailing edge card gripper actuator 206 to withdraw the respective retaining pins 196 from their first position, which projects at least the point 198 of each individual retaining pin 196 into the slot 160, to their second position in which the retaining pins are totally withdrawn from the slot. The actuators 204 and 206 are of identical construction with the exception that the arm 208 of the leading edge card gripper actuator 206 projects backward with respect to the direction of travel of the belt 150 while the arm 210 of the trailing edge card gripper actuator projects forward with respect to the direction of travel of the belt. Each of the arms 208 and 210 is pivotably attached to the underside 178. An idler wheel 212 is joined to the first end of arm 208 and an idler wheel 214 is joined to the first end of arm 210. The second end of arm 208 is joined to the retaining pin 196 of the leading edge card gripper 152 and the second end of arm 210 is joined to the retaining pin 196 of the trailing edge card gripper 154. As a consequence of the idler wheels 212 and 214 resting on cam 202, the top edge of a card 22 may be inserted within the slot 160 into engagement with the horizontally disposed surface 166 to achieve a vertical reference position with respect to the belt 150. In this position, the point 198 is withdrawn from the position as illustrated in FIG. 20. This vertical reference position is maintained by the pickup mechanism 38 being activated in its raised position at which motor 46 is stalled until the card 22 is moved to the pickup position by the card transport 20. The pickup mechanism 38 is lowered when the card transport 20 reaches the ninetieth belt position as described, infra. As the belt 150 moves, the cylindrical pin 156 engages the rear edge of the individual card to establish a horizontal reference position with respect to the belt. The card insertion position is illustrated in FIG. 15. At the card pickup position, which is downstream (to the left) from the card insertion position illustrated in FIG. 15, each of the idler wheels 212 and 214 no longer engages the cam 202 which permits the springs 200 associated with the individual retaining pins 196 to force the retaining pins to their first position, as illustrated in FIG. 20, in which at least the point 198 on the retaining pin 196 projects into the slot 160 to firmly grip an individual card 22 in a fixed horizontal and vertical position with respect to the belt 150.

Figure 17:
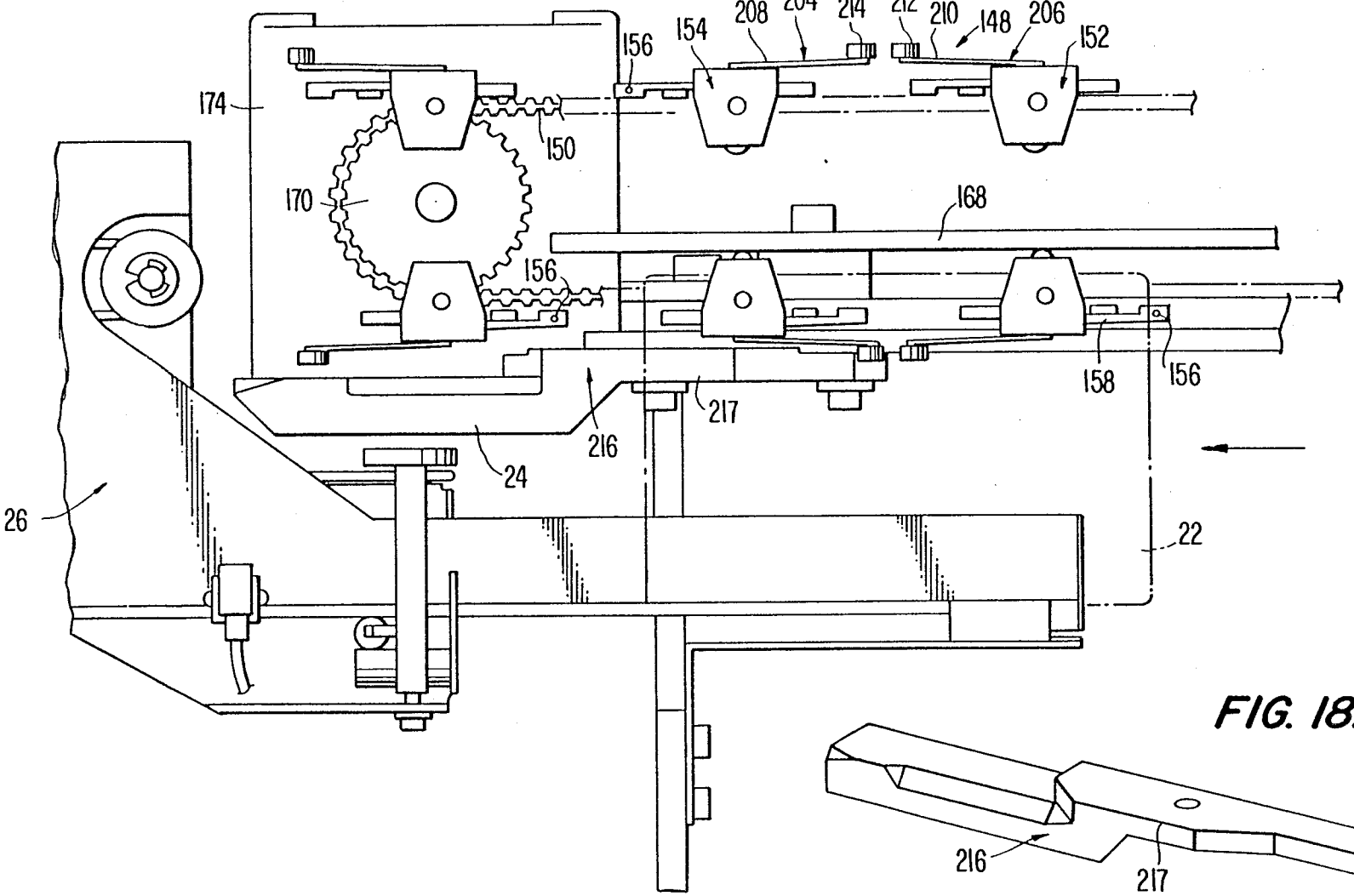
FIG. 17 illustrates a portion of the transport unit including the wait station.
Figure 18:
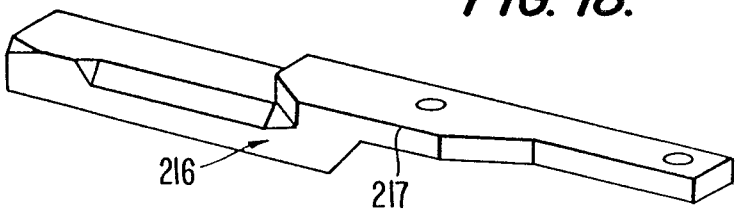
FIG. 18 illustrates the cam which is used to control the releasing of cards from the transport unit at the wait station.
Figure 19:
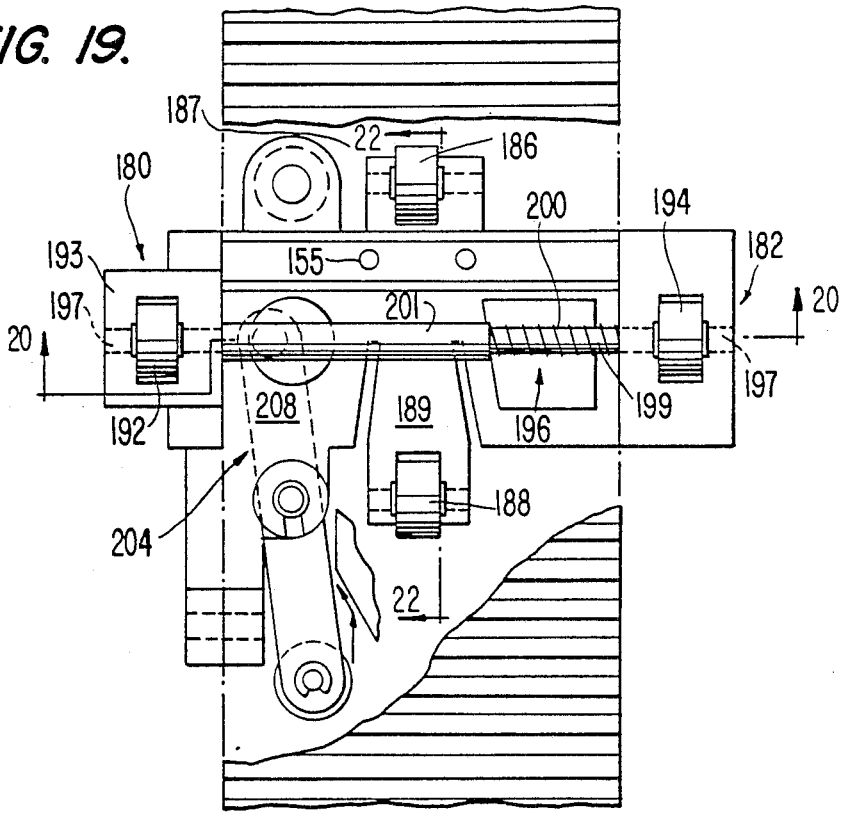
FIG. 19 is a top view of an individual leading edge card retainer of the transport unit.

As illustrated in FIG. 17, the individual cards 22 held by a pair of the leading edge card gripper 152 and a trailing edge card gripper 154, are transported past the embossing units 14 (not illustrated) to the wait station 24. Wait station 24 has a cam 216 which causes the individual retainers 196 of a pair of a leading edge card gripper 152 and a trailing edge card gripper 154 to release a card 22 from engagement when surface 217 is engaged by the idler wheels 212 and 214. Each card 22 which has been released from the card transport 20 at the wait station 24 awaits pickup by the transport unit 26 to transport the card to the topper 16 in a manner to be described, infra. However, it should be understood that preferably the pickup of the individual cards 22 at the wait station 24 is accomplished in a synchronous manner with the activation of the individual embossers and transport unit 20.

Synchronous Operation of Embossing Units 14

The activation of the individual embossing units 14 and card transport 20 is synchronized to the rotation of motor 114 which is the common drive for the embossing units as illustrated in FIG. 14.

Figure 23:
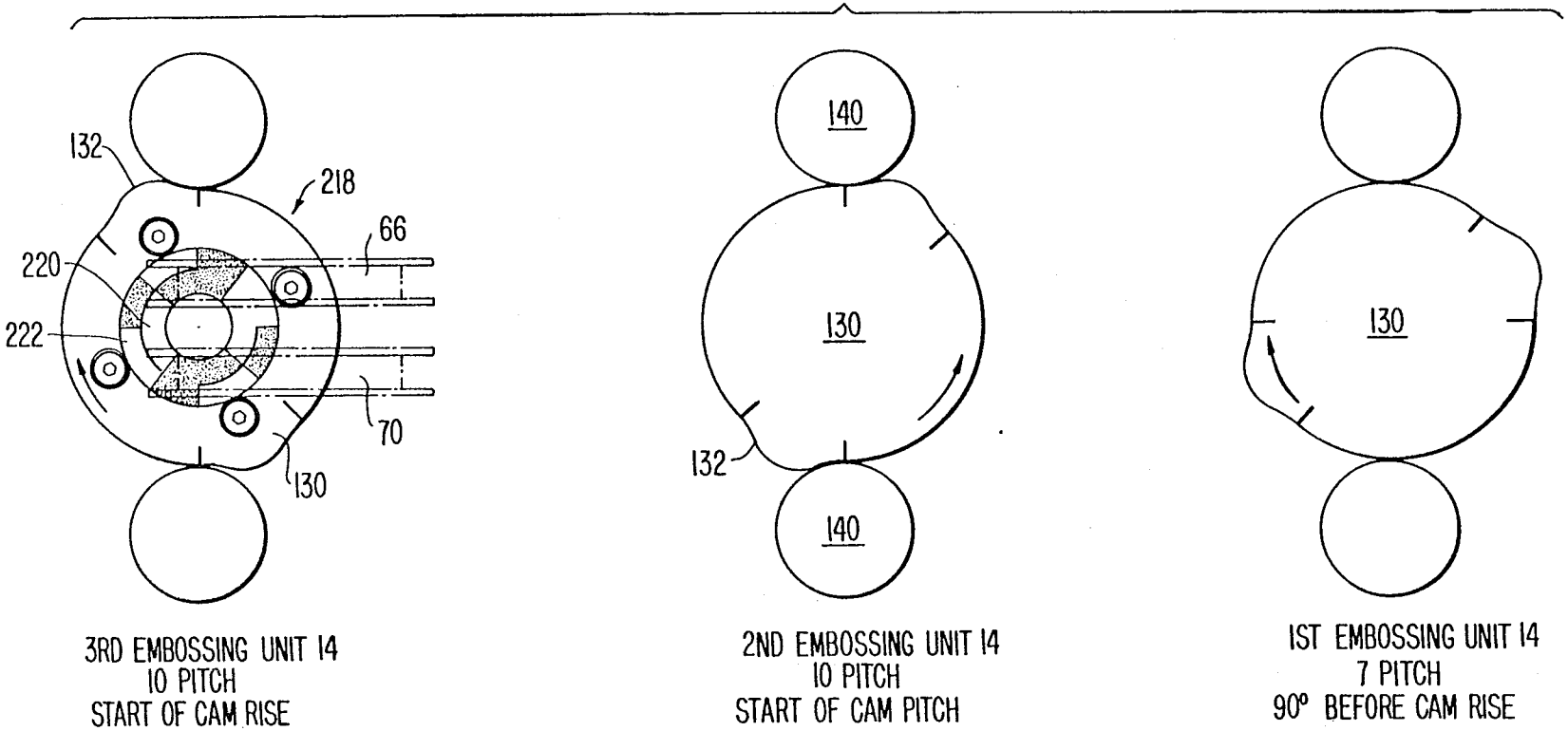
FIG. 23 illustrates the phase relationship between the cams for driving the individual embossing units.
Figure 35:
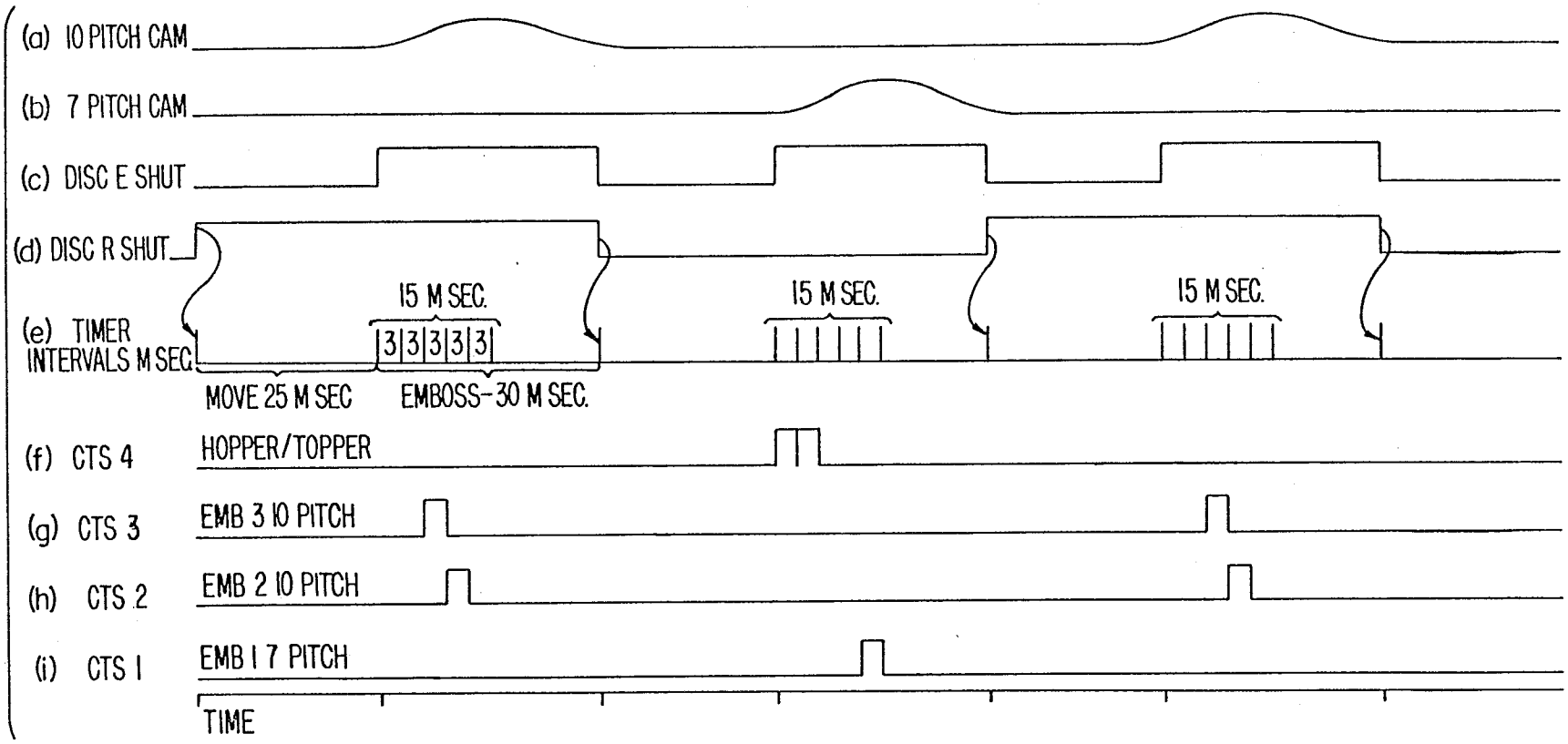
FIGS. 35(*a*)–(*i*) are oscillograms of various signals which are important in understanding the operation of the present invention.

As discussed, supra, each line of characters 62 and 64 of a card 22 is embossed by a separate one of the embossing units 14. The individual embossing units 14 are each continuously activated to cyclically emboss characters or to leave a space in timed relation with the rotation of the associated cam 130. The rotation of one of the cams 130 is used to generate the system timing signal RSHUT and the initial ESHUT timing signal with subsequent ESHUT signals being generated by the master controller. The RSHUT and ESHUT timing signals illustrated in FIG. 35(*c*) and (*d*), respectively, define timed intervals during which the belt 150 is moved from its current position to the position where the next closest character(s) are to be embossed which may be either a 7 or a 10 pitch character. FIGS. 35(*a*-)-(*d*) illustrate the preferred timing relationship between the cams 130 for embossing a card 22 having one line 62 of a 7 pitch OCR size and two lines 64 of a 10 pitch A/N size with respect to the RSHUT and ESHUT signals in which the cam 130 for activating the embossing unit 14 for embossing the line 62 of OCR format has a phase 90° before the phase of the cams 130 for embossing the lines 64 of A/N format. FIG. 23 illustrates the timing between the rotation of the cams 130 for driving 7 pitch and 10 pitch embossing units 14. With reference to FIG. 23, a timing disk 218 is attached to one of the cams 130 for generating the RSHUT and ESHUT signals. One revolution of the timing disk 218 produces two cycles of the RSHUT signal and four cycles of the ESHUT signal. The inner ring 220 of timing disk 218 generates the RSHUT signal and the outer ring 222 generates the ESHUT signal. A pair of photosensors, not illustrated, respectively generate the RSHUT and ESHUT signal.

The function of the RSHUT and ESHUT signals is described as follows. As illustrated in FIG. 23, the timing disk 218 is attached to one of the cams 130 with a position which will cause a transition of the RSHUT signal illustrated in FIG. 35(*c*) from a high level to a low level immediately after the lobe 132 of cam 130 has passed the wheel 140 mounted in arm 134. The RSHUT signal is square wave having a period of 110 milliseconds divided into a high period of 55 milliseconds and a low period of 55 milliseconds. As illustrated in FIG. 35(*c*), the ESHUT signal divides each of the 55 millisecond periods of the RSHUT signal into a high and a low period. The ESHUT signal is low for approximately 25 milliseconds immediately following a transition of the RSHUT signal and then high for the remaining 30 milliseconds. The RSHUT signal and ESHUT signal are used by the master controller described, infra, in the control of the embossing process. Transitions of the RSHUT signal generate an interrupt and synchronize an internal timer in the master controller. The internal timer is used to measure the 25 and 30 millisecond intervals and generate simulated versions of the RSHUT and ESHUT signals that are passed by the input hopper/-topper controller, and embossing unit controllers. The ESHUT signal from the disk is only used when starting the system to prevent movement of the wheels 66 and 70 or the card transport 20 when the arms 90 are pressing the rams 88 against the characters in the punch wheel 66 and die wheel 70.

When the motor 114 illustrated in FIG. 14 for driving the embossing units 14 is running, the RSHUT and ESHUT signals will be synchronized to the cam 130 with the timing disk 218 attached thereto. The common belt drive 112 insures that the other cams 130 and associated embossing units 14 are also synchronized. When the motor 114 is not running, the internal timer of the master controller simulates the signals to allow operation of the system without embossing. The RSHUT signal is used to maintain synchronism between the various processors and the cams 130. As illustrated in FIG. 35(*a*) and (*b*), during the high period of the RSHUT signal, only the 10 pitch A/N embossers will be embossed and during the low period, only the 7 pitch OCR embosser will be embossed. As illustrated in FIG. 35(*e*), the ESHUT signal defines the 25 millisecond period when the arms 90 are in the position which does not cause the rams 88 to contact the individual characters of the punch wheel 66 and die wheel 70. The 25 millisecond period of the ESHUT signal is referred to as the "MOVE" interval hereafter. As illustrated in FIG. 34(*e*), the ESHUT signal also defines the 30 millisecond period when communications occur between the master controller and the hopper/topper and embosser unit controllers. The 30 millisecond period when communications occur is referred to as the EMBOSS interval hereafter. During the MOVE period, the belt 150 is moved to position the card at the position of belt 150 of next closest character(s) to be embossed on any one of the horizontally disposed lines 62 or 64. During the EMBOSS period, the belt 150 cannot move if a character is being embossed at any one of the embossing units 14.

Initialization

When the system is started from a power-off condition or after an error, it is necessary to initialize each of the mechanisms. The wheels 66 and 70 in each embossing unit 14 are rotated until the position without embossing elements is at the embossing position. The belt 150 is moved to position 0. As illustrated in FIG. 7 at the position 0, a card that is properly attached to the belt 150 would be positioned at an embosser unit 14 such that the vertical centerline of the first embossed character would be 0.401 inches from the left edge of the card as discussed, infra. The rack motor 46 of the input hopper 12 is driven to a home position that will allow the first card to be selected from the supply in the hopper. The heated platen 28 in the topper 16 is moved to its fully retracted position and the stacker gate 302 is moved to the rearmost position.

Card Transport Control and Algorithm for Computing the Closest Next Character(s)

The embosser control algorithm, the preferred form of which is set forth in the source code listing of the Microfiche Appendix supra, functions to compare data records for the three cards being embossed by the in line embossing units 14 to determine the next closest character(s) to be embossed for all of the embosser units with respect to the current position of the belt 150 as measured in increments from 0 to 180 as illustrated in FIG. 7. The algorithm determines the position of the next closest character(s) with respect to the current position of the belt 150 (0-280) to identify the position to which the belt should be moved for embossing the next character. As has been described, supra, with regard to the card transport 20, the respective embossing units 14 are separated in line by four inches which is equal to the distance covered by one revolution of the drive pulley 170 of the drive motor and encoder 174 for the belt 150 and is broken up into 280 units per revolution. By choosing increments of 1/70th of an inch for moving the belt under the control of drive motor and encoder 174, the displacement of the belt 150 to the next closest character can be achieved by moving an integer number of increments regardless of whether the closest next character is a 7 pitch or a 10 pitch character.

The character placement on the card is determined by the number of increments moved from the current position of belt 150 to the position of the closest next character(s) before embossing takes place. FIG. 7 illustrates the embossing field on a card running from the 0 position of the belt to the 180 position of the card 22. The cylindrical pin 156 of the trailing edge card retainer 154 insures that each card 22 is gripped at the same position on the belt 150 for each of the card grippers 148. The first character of each line, which has a 0 reference position on the belt 150, is chosen to have its vertical centerline located at a distance of 0.401 inches from the left-hand edge of the card 22. The right-hand margin, spanning the position 180 and the right-hand edge of the card 150, is of width similar to the left-hand margin. Characters on a 10 pitch line will be embossed at positions 0, 7, 14, 21 . . . 168 and 175. These positions are separated by seven increments of the belt 150 equal to 0.1 inches. The characters on a 7 pitch line will be located at positions 0, 10, 20 . . . 170 and 180. These positions are separated by 10 increments of the belt 150 equal to 0.143 inches. Thus, the length of the field on which characters may be embossed on the individual cards 22 is 180 units long out of the total of 280 units moved per revolution of the drive pulley 170.

Movement of the belt 150 must be accomplished during the MOVE periods of the rotation of cam 130 when the arms 90 are not causing the rams 88 to contact the character elements within the punch wheel 66 and die wheel 70. The motor 174, which drives the belt 150, is capable of advancing the belt 10 increments in the normal 25 millisecond MOVE period. If the master controller has determined that there is no embossing activity at any embosser during the next EMBOSS period, it is possible to move the belt 150 a distance of 110 increments. This capability is due to the fact that even though the rams 88 are always cyclically pushed towards the character elements by the rams 88 during the EMBOSS period, the punch wheel 66 and die wheel 70 will be positioned under the control of the master controller to the circumferential position 77 described, supra, which contains no characters. The card will therefore be free to move and the MOVE period may be extended to include a MOVE, EMBOSS, and a MOVE period for a total of 80 milliseconds. When the MOVE period is entered, the motor 174 for the belt 150 is commanded to move the belt to a position number that has been computed during the previous RSHUT period as described, infra. This value may initiate a MOVE from 0 to 110 increments.

Figure 24:
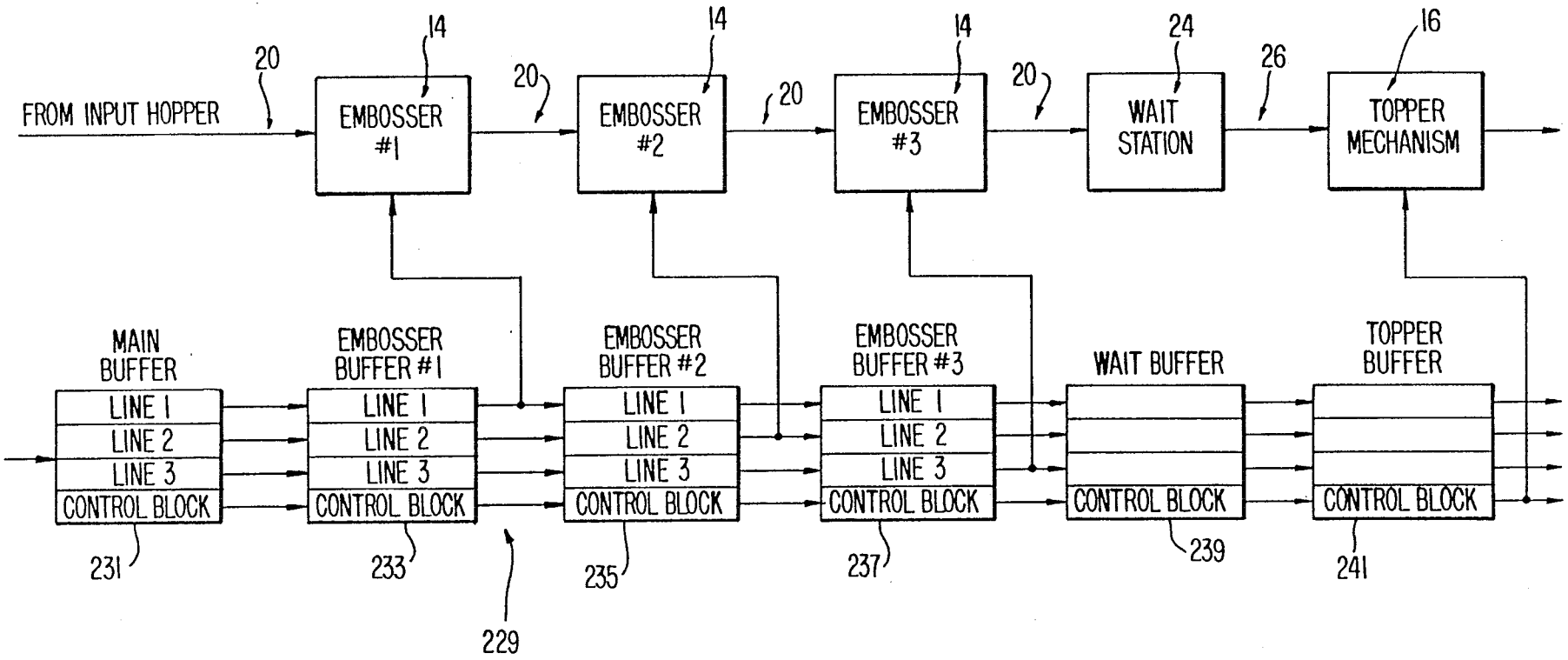
FIG. 24 illustrates the mechanisms involved in the flow of data records during embossing by the embossing units.

In the preferred embodiment illustrated in FIG. 2, where a total of three embossers are used to emboss three vertically separated horizontally disposed lines of characters, flow of card records within the system is illustrated as in FIG. 24. As illustrated in FIG. 24, individual cards 22 are moved by the card transport 20 which is illustrated as an arrow between the successively positioned embossers 14 to the wait station 24. The individual cards are moved to the topper mechanism 16 by the transport unit 26 which is also illustrated as a labeled arrow. A queue of data buffers 229, which is comprised of a main data buffer 231, first embosser buffer 233, second embosser buffer 235, third embosser buffer 237, wait buffer 239 and topper buffer 241 sequentially stores the individual records. The plurality of buffers are implemented in main memory by pointers which point to successive blocks of memory to produce the shifting operation of data which is indicated by the arrows pointing to the right from each of the buffers 231-241. Since a queue of buffers implemented in main memory is well known, the implementation will not be discussed in detail herein. The main memory is contained in the master controller discussed, supra. The wait buffer 239 is not involved in any control function.

The data is received from the tape in EBCDIC code and is translated into ASCII as it is placed into the main buffer 231 by a program implemented by the master controller. When the master controller is ready to accept a data record for embossing a card, it will transfer the contents of the main buffer sequentially into the embossing unit buffers 233-237, wait buffer 239 and topper buffer 241 by the time an end of line code has been detected in all of the buffers. The data for line 1 associated with the data record stored in embosser buffer 233 is coupled to embosser no. 1, the data record for line 2 associated with the data record stored in embosser 235 is coupled to embosser no. 2 and the data record for line 3 associated with the data record stored in embosser 237 is coupled to embosser no. 3. By the time an end of line command has been detected in the processing of the data records by each of the embosser buffers 233-237, the pointers of the embossers 1-3 are shifted to point to the area in main memory where the next data record to be embossed by the associated embossers is located. The shifting of the pointers effectively produces a shifting of the data records within the buffers which is synchronized with the physical passage of the card to be embossed between the successive embossing units 14 to produce the sequential embossing of the three lines of data on the card 62 and 64 of FIG. 7. The section of the main memory in the master controller which implements the queue of buffers 229 is updated with data records from the magnetic tape unit as cards are embossed. The preferred form of program for implementing the queue of data buffers in the memory of the master controller is contained in the Microfiche Appendix referred to supra.

The movement of the belt 150 is controlled by sending the belt position of the closest next character(s) to the encoder logic of the drive motor 174. The encoder logic of the motor 174 computes the number of steps to be moved to reach the position of the closest next character(s) and controls the movement of the belt to that position.

The closest next character(s)' belt position is defined as the closest position to the present position of belt 150 at which a character is to be embossed by any of the three embossing units 14. This position is determined by a search algorithm contained in the belt control section. This algorithm is invoked during the MOVE portion of the RSHUT signal of FIG. 35(*e*). The search algorithm uses several registers and flags in a belt control work space, as well as values contained in the control blocks for each of the embosser buffers, which are described, infra. The values of interest in the belt control work space are:

NUPOS Last position passed to encoder logic.
NXTPOS Next desired belt position.
NXTCOM Next position for communication.

The flags assigned are:

SLVRDY This flag is true when data has been received from the magnetic tape unit into the main buffer 231 and attached to the embossing queue.
SLVACT This flag is true if a card is being embossed and is false when no data is ready for embossing and the belt is idle.
SKPFLG This flag is true if the last MOVE passed to the encoder logic of the drive motor 174 requires more than one MOVE cycle to complete (i.e. if a MOVE was greater than 10 steps of the motor).
COMFLG This flag is true if an embossable character was communicated during the last communication cycle.

The control block of each of the buffers 231-241 described, supra, in FIG. 24 has an 8 register task control block (TCB) which contains the necessary parameters and pointers required for control of the embossing function. The definitions of the registers are:

TCFLG This register contains two eight bit characters. One character holds the status byte received from the device byte during each communication cycle. The other contains flags that are set by the user or the belt control program to facilitate control of the data transfer to this device. Definitions of these flags are:
FLG10 This flag signifies that a device is associated with a 10 pitch RSHUT signal.
FLG7 This flag signifies that a device is associated with a 7 pitch RSHUT signal.

EOBFLG This flag signifies that an end-of-line code has been found in the embosser buffer or that no buffer was assigned.

CHRFLG This flag signifies that a character is available in the embosser buffer 233-237 but has not yet been communicated to the embossing unit 14. Communications between the master controller and the controllers for each of the embossing units 14 are described, infra, in conjunction with the FIGS. 35(*e*)-(*i*).

TCCHR This register stores the next character to be transmitted to the embossing unit 14.

TCBUF This register contains the address in the main memory assigned to the particular embossing unit.

TCPTR This register contains the index to the next byte in the buffer to be outputted to its associated embossing unit 14. This value is an offset from the beginning of the buffer which ranges from 0 to 127 depending upon the address of the character to be outputted.

TCPOS This register contains the number of the belt position where the contents of the TCCHR which ranges from 0 to 280. This range represents the number of 1/70 inch increments to be moved by the drive motor 174 in the four inch spacing between embossing units 14.

TCCNT This register contains the count of characters embossed on this card. This value is used to compute the topper pressure value.

TCAFLG This register contains the inclusive 0R condition of all of the status bytes received from the embossing unit 14 during the processing of one line of data 62 or 64 on the card 22 as illustrated in FIG. 7.

TCPARM This register contains the character entered by the operator into the device status table to define the operation of embossing unit 14 as either a 7 pitch or 10 pitch unit.

The belt control program is entered at each transition of the RSHUT signal. The internal timer, referred to, supra, is set to measure the interval of 25 milliseconds that is defined by the MOVE cycle. The contents of the belt work space will now be examined to determine if a new position number of the belt 150 (0-280) should be sent to the encoder logic. If the values of the flags SLVACT and SLVRDY are both false, no further action takes place during the MOVE cycle. If the value SLVRDY is true, all values and flags will be initialized within the belt work space and the TCB's will be set to the starting conditions for a new line and the flag SLVACT will be set true. The flags SKPFLG and COMFLG will be set false. The values NUPOS, NXTPOS, NXTCOM will all be set to zero and the belt work space and the TCPOS register of each TCB will be set equal to zero. If an offset was entered in the embossing unit 14 status table by the operator, this value will be placed in the TCPOS register to adjust the line starting position. The control program will then execute the search algorithm to prepare for the communication cycle that follows.

If the SLVACT flag is true, the program will determine if a new position code should be sent to the encoder logic of the drive motor 174. If the value of the SKPFLG is false, and the contents of the NUPOS and NXTPOS are not equal, the contents of NXTPOS are sent to the encoder logic for motor 174 and transferred to the memory location NUPOS. If the SKPFLG flag is true, it will be set false and no transfer to the encoder logic of the motor 174 will occur.

The length of the move to be made is computed and if it is greater than 10 belt spaces, the SKPFLG flag will be set true. If the length is less than or equal to 10 steps, the contents of NXTCOM will be transferred to NXTPOS to prepare for the next move of the belt.

A maximum for the search range is computed by adding a value to the next belt position held in NUPOS. This value will be selected under the control of the COMFLG flag. IF the COMFLG flag is true indicating that communication occurred in the previous cycle, the value to be added is limited to 10 since a full stop will be required to emboss the closest next character that was transmitted to one or more of the embossing units 14. If the value of the COMFLG flag is false, the value added will be 110 since two move cycles are possible. This value is then established as the NXTCOM value to be used during the communication cycle.

The search algorithm is now invoked to test each embosser TCB to determine the next position of the belt 150 at which the closest next character(s) is to be embossed by one or more of the embossing units 14. The character located at the buffer location stored in the register TCPTR is tested to determine if it is a space character, an embossable character, or an end-of-line character. A space character causes the ganged punch wheel 66 and die wheel 70 to be rotated by the shaft encoder 76 to a position where no character is located and an embossable character causes the punch wheel 66 and die wheel to be rotated to a position by the shaft coder and motor 76 where a selected character will be embossed.

If a space character is found, the TCPTR register will be incremented by one to select the next character in the buffer and the TCPOS value will be incremented by 7 if the FLG10 flag is true or 10 if the FLG7 flag is true. The test will be repeated until either an embossable character or an end-of-line character is found. If an end-of-line character is found, the EOBFLG flag will be set and the value of TCPOS will be set to 280 representing the start of the next line. Thus, each time an end-of-line character is found, the position of the shaft encoder and motor 76 is reset to zero to start the processing cycle over.

If the character which is detected is embossable, the CHRFLG flag will be set true and the program will proceed to test the TCB associated with the next embossing unit 14.

After each TCB is searched, the TCPOS value in its TCB is compared to the NXTCOM value computed at the beginning of the search phase. If the TCPOS is less than the NXTCOM, than the TCPOS will be set as the new maximum.

Figure 36:
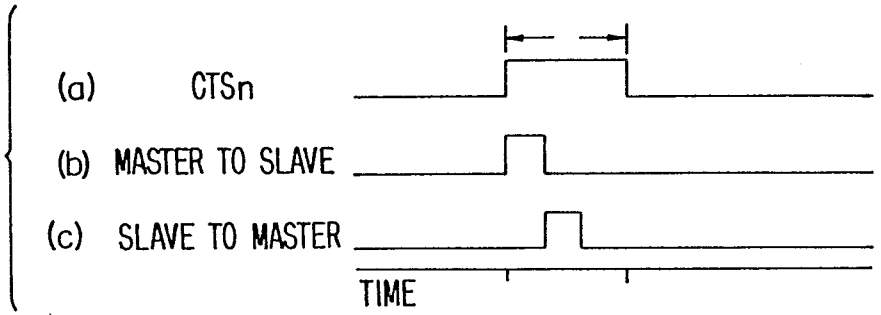
FIGS. 36(*a*)–(*c*) are oscillograms of signals involved in the communications between the master controller and the controllers of the embossing units, hopper and topper.

When all the TCB's have been searched, the program will wait for the end of the MOVE period and the beginning of the communication cycle. At the end of the 25 millisecond MOVE interval, the timer interrupt will cause the belt control logic to become active again. As illustrated in FIG. 35(*e*), five communication intervals are allowed during the EMBOSS interval of each ESHUT signal cycle for a total of 15 milliseconds in which to complete communications between the master controller and the hopper/topper processor or the embossing unit processors. The timer will be set to measure a communication interval of 3 milliseconds. This period is the time allotted for communication to each of the controllers of the embossing units 14 and the controllers controlling the hopper 12 and topper 16 which is illustrated in FIG. 35(*e*) by the reference numeral "|3|". As illustrated in FIG. 36(*a*), the communication interval "CTSn", which represents any one of the controllers controlling the hopper 12 and topper 16 and embossing units 14 is 3 milliseconds. As illustrated in FIGS. 36(*b*)–(*c*), during the 3 millisecond interval for each processor, a communication must occur between the master controller and the addressed controller and an acknowledgment from the addressed controller to the master must occur to prevent an error flag from being set.

At the beginning of the 15 millisecond communication phase within the EMBOSS interval of FIG. 35(*e*), a sequential list containing the belt positions where action is required by the input hopper 12 or the topper 16 is examined to determine if the belt has reached a position for transmission of the command. In some cases, the NXTCOM value, supra, will be replaced by a new value if a response is required from the hopper/-topper controller before the belt 150 can move past a certain point. This provides the mechanism for causing the system to wait for a card to be received from the input hopper 12 or the topper 16 to be clear.

The TCB's are examined during the communication phase in the order of the oscillograms of FIGS. 34(*f*)–(*i*) labeled "CTS4", "CTS3", "CTS2", and "CTS1". If the embossing unit 14 is embossing during this phase of the RSHUT signal, and the value of the TCPOS entry in the TCB associated with the embossing unit is less than or equal to the value in the NXTCOM register, the contents of the TCCHR register will be transmitted and the COMFLG flag will be set in the belt work space and the CHRFLG flag in the TCB will be reset. If the value in the TCPOS register is greater than the value in the NXTCOM register, a value of zero or a space code will be transmitted. The embossing unit 14 for which the character is intended is selected by setting the appropriate one of the CTS signals 1–3 to the activ condition. If the embossing unit 14 is not embossing during this phase of RSHUT, no communication is initiated and no adjustment of the flags occur.

The master controller will now wait for the end of the 3 millisecond communication interval and then examine the active TCB associated with the embossing unit 14 to which the communication should have taken place to determine if in fact the communication took place. If a character was sent, the CTSn signal associated with that embossing unit 14 is reset to an inactive state and the communication hardware is tested to see if a character was received. If no character was received, a flag is set in the TCB to indicate that a device timeout has occurred. The character received is placed in the TCFLG flag portions of the TCB associated with the embossing unit 14 to which communication is occurring to indicate the device status. After the last TCB has been processed, the system will wait for the next change of the RSHUT signal which restarts the complete procedure.

Topper 16

The topper 16 functions to apply a plastic topping material to the top of the embossed characters which have been embossed by each of the embossing units 14 to provide highlighting. The topper 16 is operated synchronously with the operation of the card transport 20 and is preferably activated when the belt has reached position 160.

Figure 25:
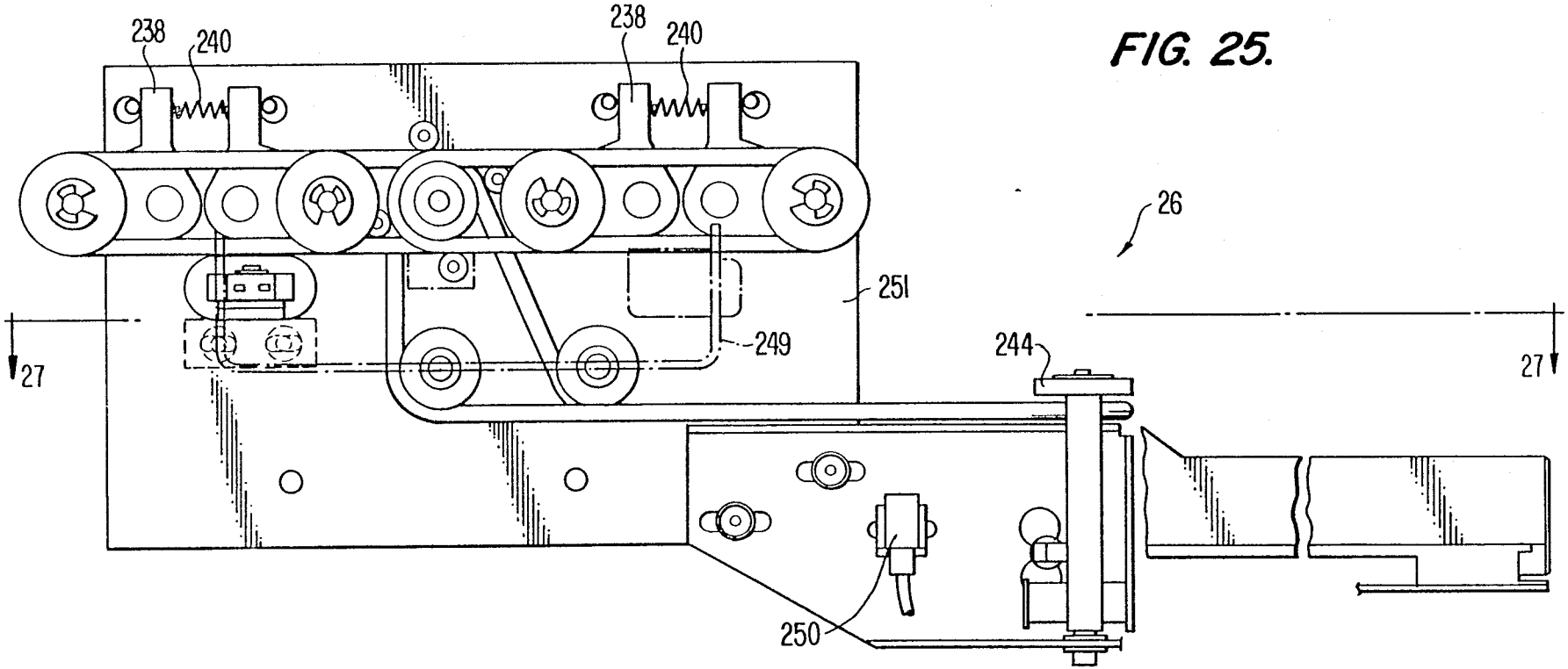
FIG. 25 illustrates a front view of the transport unit of the topper of the present invention.
Figure 26:
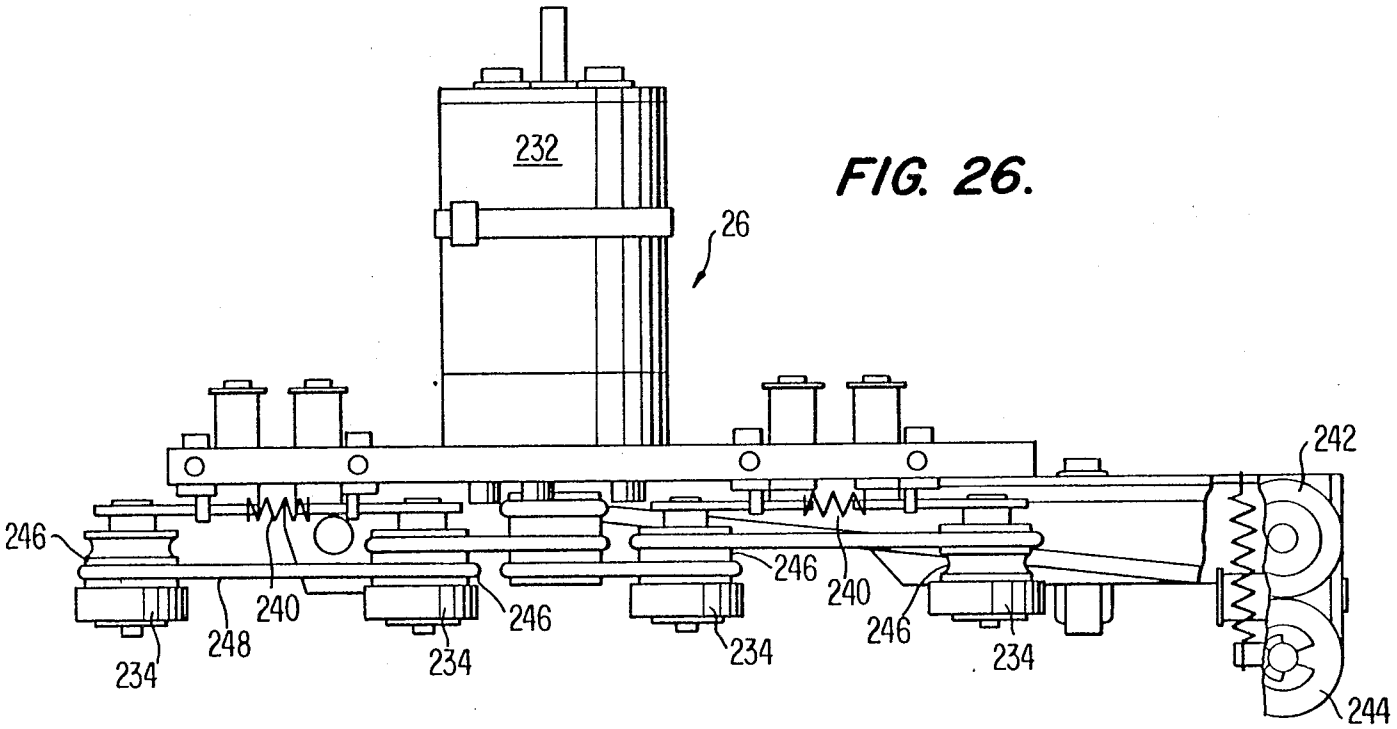
FIG. 26 is a top view of the transport unit illustrated in FIG. 25.
Figure 27:
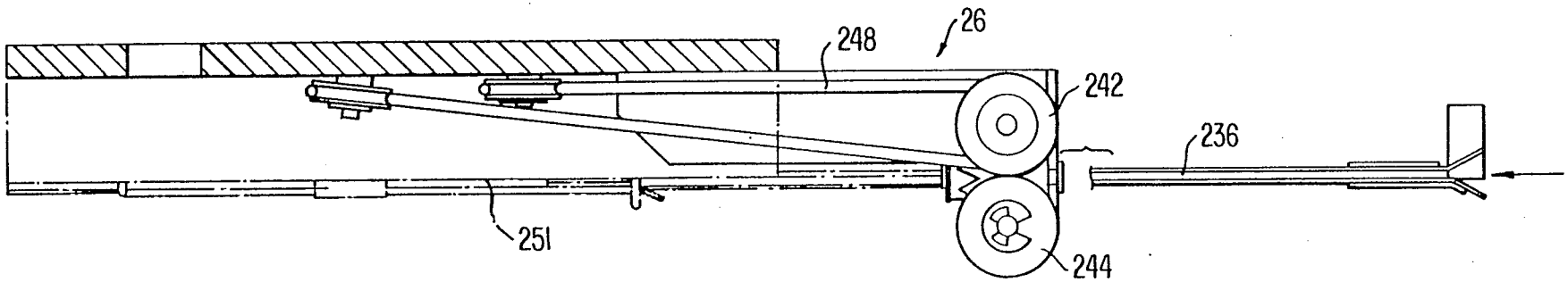
FIG. 27 is a sectional view of FIG. 25.
Figure 28:
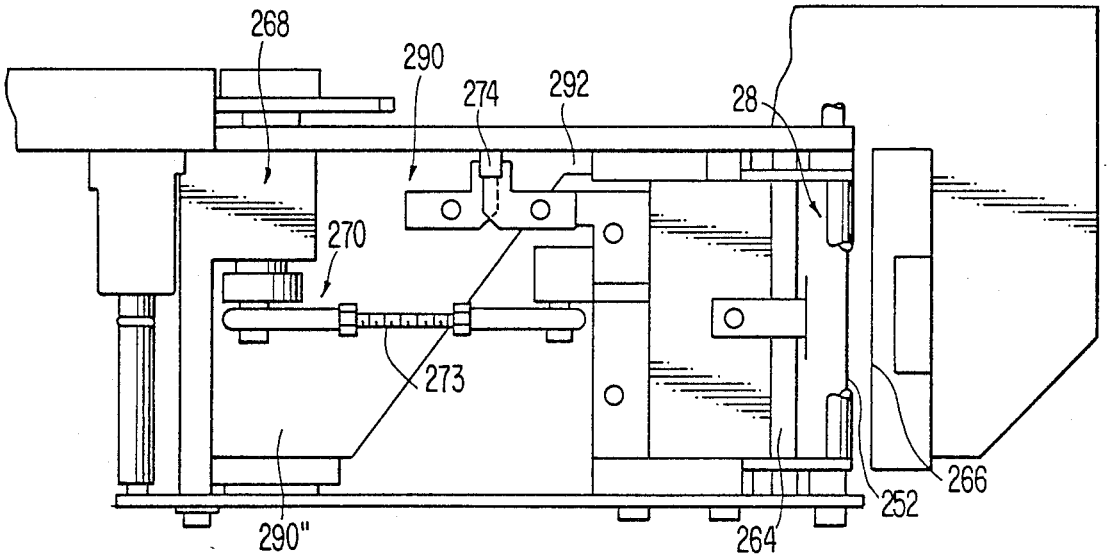
FIG. 28 is a top view of the topper illustrating the heated platen.

FIGS. 25–27 illustrate the transport unit 26 of the topper 16. The transport unit 26 of the topper consists of a DC motor 232, which activates belt driven rollers 234 and an additional belt driven roller 242. The periphery of the belt driven rollers 234 engages the upper edge of a card 22 to drive the card from the wait station to a topping position. The lower end of the card 22 engages a metal track 236 which guides the card from the wait station to the topping station. Each of the belt driven rollers 234 is mounted on a suspension consisting of a pivoted arm 238 which carries the individual rollers 234. The pivoted arm 238 is biased into a downward position, as illustrated, by spring 240 when a card is travelling along the metal track 236 of a conventional width, such as a credit card. The peripheral surface of the individual wheels 234 engages the upper edge of the card without substantial upward deflection. However, cards of a greater width than the standard width will cause the arm 238 to be pivoted upward against the action of spring 240 to permit movement of cards of a larger width without adjustment. The driven roller 242 located upstream from the rollers 234 cooperates with idler roller 244 to move the card from the wait station to the point of engagement of its upper edge with the rollers 234. Each of the driven rollers 234 and 242 is driven by a pulley 246 driven by belt 248 that is driven by DC motor 232. A spring retainer 249 maintains the cards in a vertical position against a vertical support surface 251.

The motor 232 operates at two speeds during the transport of the card 22 from the wait station 24 to the topping station. The motor 232 is stopped from the time interval that the card is located at the topping station until the belt 150 has reached the 160th increment. Position 160 is the point at which the belt 150 will be limited if the topper transport unit 26 is not clear and a card is presently in the wait station ready to enter the topper 16. If the transport unit 26 is clear, a control message will be sent to the hopper/topper controller indicating that a card presently in the wait station and the motor 232 should be activated. When the metal track 236 is empty, the motor 232 is operated at a higher speed. Sensor 250, which is located downstream from the upstream driven roller 242 and idler roller 244, detects the presence of the right-hand edge of a card 22 to signal the master controller that the speed of rotation of the DC motor 232 should be slowed down to the slower drive speed. A second sensor (not illustrated) senses when the left-hand edge of the card has reached the topping position in front of the topper at which topping will be performed. When the second sensor detects the left-hand edge of a card, the master controller commands the DC motor 232 to stop the card at the topping position.

FIGS. 28–31 illustrate the construction of the portion of the topper which performs the topping. The electrically heated platen 28 is supported by a parallelogram suspension 251 which permits the platen to be moved from a first position remote from the surface of a card which has the embossed characters to be topped to a second position at which a surface 252 of the platen forces a topping bearing foil 254 which is aluminum coated with a layer of heat fusible plastic on the surface facing the characters to be embossed. The movement of the heated platen 28 from its first position to its second position causes the active surface 252 to engage the back surface of the topping bearing foil 254 to cause the plastic bearing front surface of the foil to contact the embossed characters to heat fuse the topping material to the characters.

Figure 30:
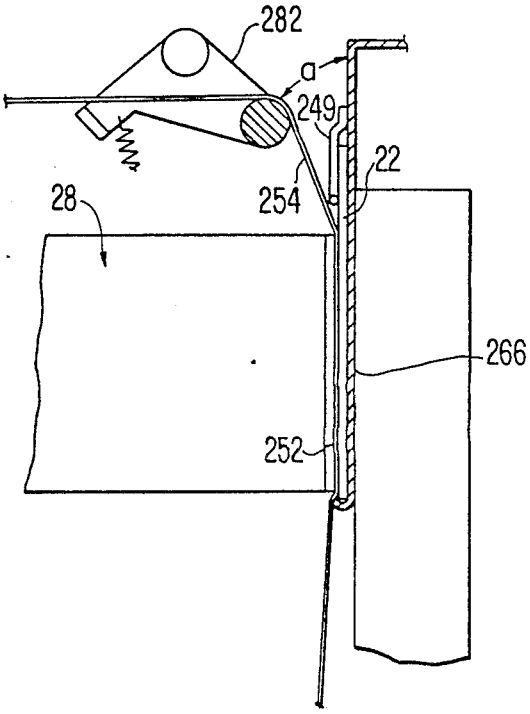
FIG. 30 illustrates the topper at the time the heated platen is heat fusing the topping material to a card at its extended position.
Figure 31:
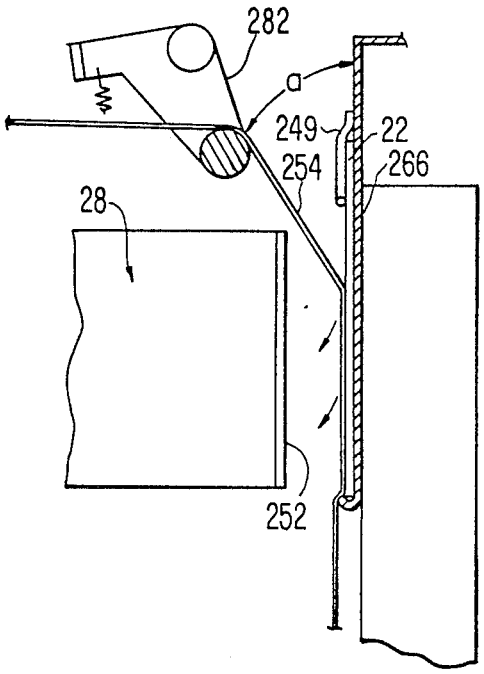
FIG. 31 illustrates the topper at the time the heated platen has withdrawn to its retracted position and the foil bearing the topping material is being peeled from contact with the embossed card.
Figure 29:
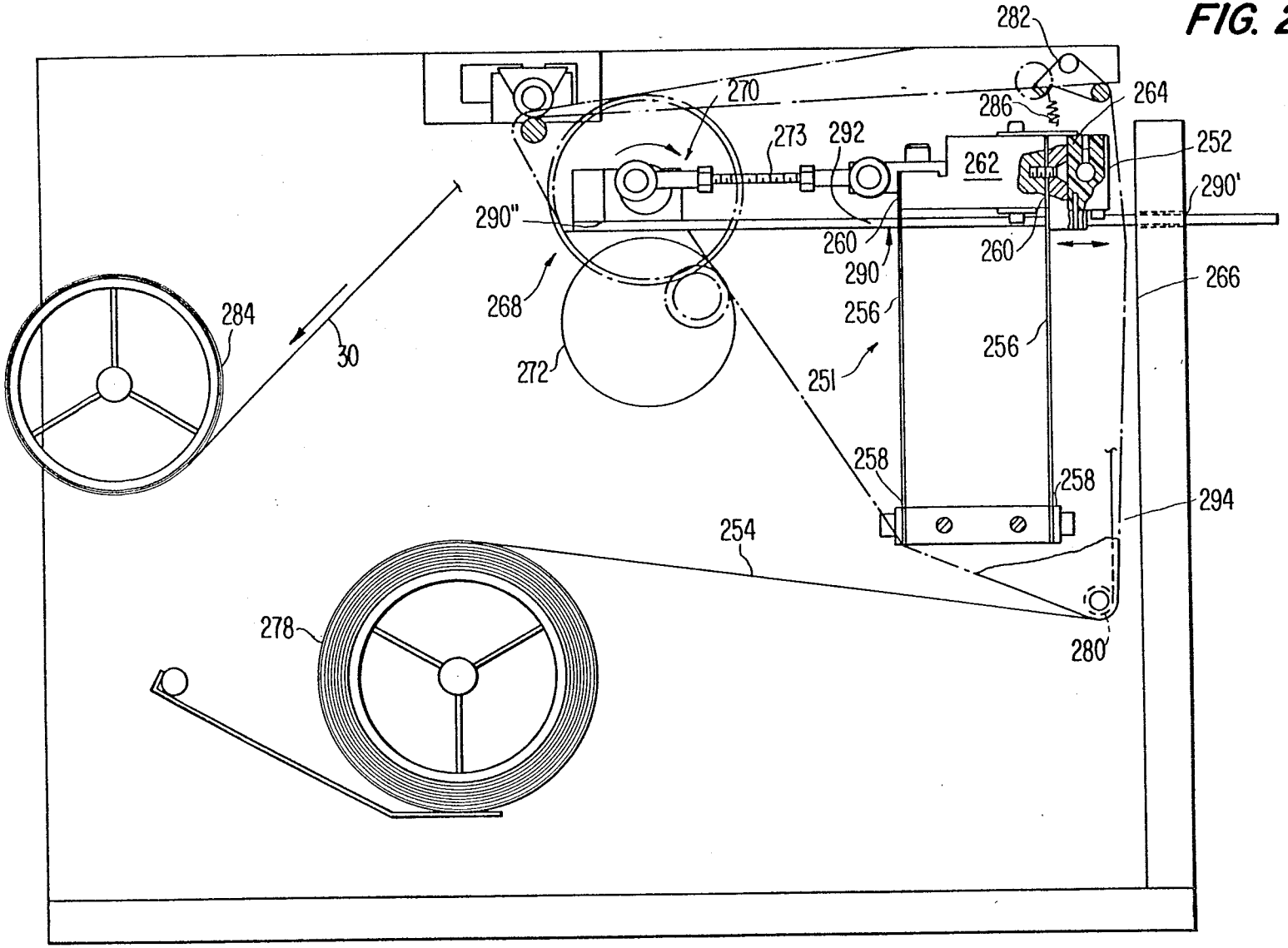
FIG. 29 is a side elevational view of the foil drive of the topper.

The parallelogram 251 suspension has a pair of thin, flat metallic flexor springs 256 which are mounted parallel to each other. The flexor springs 256 have first ends 258 which are joined to a fixed base 258 and second ends 260 which are joined to the heated platen 28. The springs 250 have an elongated cross section extending across the width of the platen parallel to the direction of motion of a card by the transport unit 26 of the topper. The spacing between the first ends of the flexor springs 256 at the point of connection to the base 258 is equal to the spacing of the point of connection of the second ends to a mounting block 262. The front surface of the mounting block 262 is connected to a plastic plate 264 which is connected to the heated platen 28. Because of the uniform spacing between the first ends and the second ends of the flexor springs 256 as respectively joined to the base 258 and the mounting block 262, movement of the heated platen 28 from the first position to the second position is accomplished with the active surface 252 being maintained parallel to the vertical support surface 266 which ensures that pressure will be uniformly applied by the drive 268 to all of the characters to be topped. The drive unit 268 has an eccentric drive 270 which is driven by an electric motor 272 which is controlled to produce a torque during topping which is a linear function of the number of characters which are embossed on the card. The control information of the amount of force to be applied by the motor 272 is obtained from the TCCNT register of the control block 241. The eccentric drive 270 has an eccentrically driven link 273 that drives the heated platen 28 from its first withdrawn position to its second position illustrated in FIG. 30 where the topping is applied to the embossed characters as a result of the motor 272 being stalled by a torque proportional to the number of characters which are embossed on the card. After the card is topped, the motor 272 is commanded to be reversed to withdraw the heated platen 28 from its second position back to its first position as illustrated in FIG. 31.

The topper motor 272 is controlled with two modes of operation. In the first mode of operation, the motor 272 drives the assembly towards the card to be topped until it passes sensor 274 at which point the second mode of operation is entered at which the command for the motor 272 is to drive the motor with a torque proportional to the number of characters embossed on the card to be topped.

The foil transport mechanism functions 30 to supply foil from a roll of foil 278 over a fixed foil guide 280 mounted below the heated platen 28, between the active surface 252 and the vertical support surface 266, over a deflectable foil guide 282 mounted above the heated platen and to a take up roll 284. The deflectable foil guide is spring biased into a first position by spring 286. The motor 272 stalls the heated platen 28 in contact with the backside of the foil for a time sufficient to heat fuse the plastic coating on the front onto the embossed characters of the card. Thereafter, when the motor 272 is commanded to be reversed by the master controller, an acute angle "a", as illustrated in FIGS. 30 and 31, is formed between the vertical support surface 266 and the foil located between a card and the deflectable foil guide 282. A motor powering the take up roll 284 is commanded to wind up the length of the foil which was heat fused to the card. The force exerted by the motor is sufficient to rotate the deflectable foil guide 282 from its first position to a second position to increase the acute angle "a" between the vertical support surface 266 and the foil located between the card and the deflectable foil guide to cause the foil 254 to be peeled away from contact with the embossed characters. A support surface 290, having a first end 290' a second end 290'' and an intermediate section 292 connecting the first and second ends provides a rigid support for the vertical support surface 266 joined thereto and the eccentric crank 270. The intermediate section 292' is located on the side of the platen 28 opposite a vertical slot 294 used for guiding a leader of a new roll 284 of film 254 over the foil drive unit 30 and is preferably narrower than the first end 290' and the second end 290''. The rigidity of the support surface 290 ensures that substantial parallelism will be maintained between the active surface 252 of a heated platen 28 and the vertical support surface 266 during the heat fusing of the topping material to the embossed characters on the card. Rigidity ensures that each of the characters is uniformly topped. The intermediate section 292 of the support surface 290 is located opposite a vertical slot 294 running between the active surface 252 of the heated platen 250 and the vertical support surface 266. The vertical slot 294 permits a new roll of topping bearing foil 254 to be threaded over the foil drive unit 30 without requiring splicing as in the prior art described, supra.

The plastic plate 264 and the flexor springs 256 isolate the drive mechanism 268 for the platen from the substantial heat generated by the heated platen 28 which lessens the likelihood of failure caused in the drive mechanism by heat such as with the heat degradation of grease in the prior art topping mechanisms. The flexor springs conduct and radiate substantial heat away from the drive mechanism. The parallelogram suspension 251 maintains the active surface 252 parallel with surface 266 to produce a uniform topping on all characters.

Two types of information are transmitted from the control block to the topper controller which are a flag that indicates whether the card has been processed without error and the count of embossed characters that appear on the card. If the error flag indicates that an error is present, the card is passed through the topper 16 without the motor 272 being activated which prevents it from being topped.

Stacker 18

Figure 32:
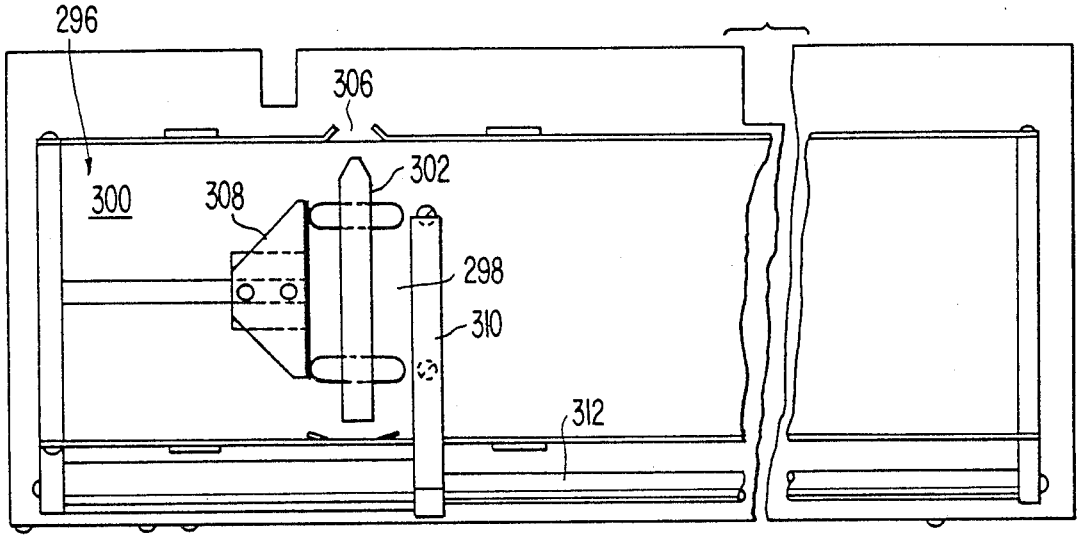
FIG. 32 illustrates a top view of the stacker of the present invention.
Figure 33:
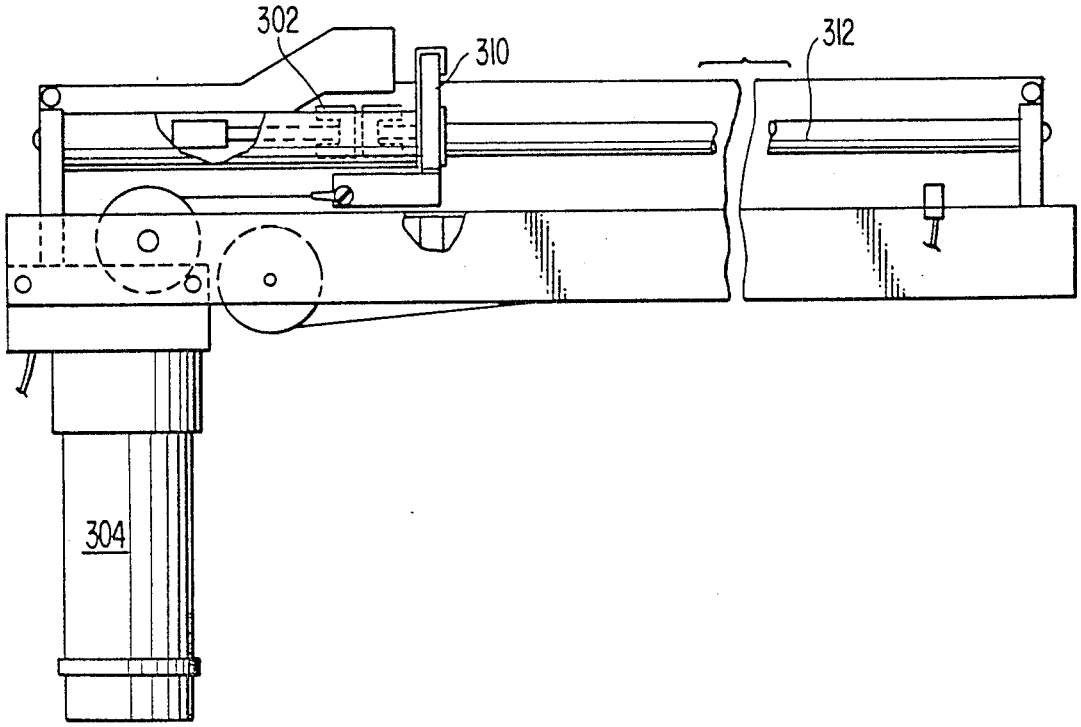
FIG. 33 illustrates an elevational view of the stacker of the present invention.

FIGS. 32 and 33 illustrate the preferred construction of the stacker 18. The stacker 18 contains a tray 296 which is divided into a front section 298 for receiving cards which have been embossed without an error and a rear section 300 which receives cards which have been embossed during an error condition. Error detection is conducted by the master controller to detect in the embosser units 14 data errors, transmission errors and functional errors. Data errors are found by checking that the data received from the magnetic tape source is within the range of characters that may be embossed. This test is accomplished by a translation table in the master controller that converts the EBCDIC format of the tape to the ASCII format used within the system. If a character is received from the tape that cannot be translated into ASCII, it will cause the system to halt with a message displayed on the operator console indicating the error. Checking for data errors occurs when the characters are transmitted to the various embossing units 14. Each embossing unit 14 will check the characters against a table that contains all legal characters contained on its punch wheel 66 and die wheel 70. If the received character is not found in the table, it will be translated into a space and an error signal will be transmitted to the master controller that an illegal character was received. Embossing will then continue until the belt 150 has arrived at position 0 prior to starting the next card and the system will then stop. The cause of error will be displayed on the operator console 6 in association with the unit in the system that detected it. Transmission of data between the master controller and the other controllers follows the standards for serial, asynchronous transmission. Each character is transmitted as a 10 bit group wherein the first and last bits represent a start and a stop framing bit. The other 8 bits form the character that is to be transmitted. The receiving circuits become active upon the detection of the start bit, accept the next 8 bits as a character and then check to ensure that there is a valid stop bit. If an error is detected, it will be reported to the master controller and embossing will continue until the card is complete as described, supra.

Another type of error that may occur during transmission is the case where a character is transmitted from the master controller to one of the other controllers and that controller requires that the system be restarted since it is assumed that a controller requires repair or replacement.

Functional errors in the hopper/topper controllers are detected by measuring the interval of time required for a specific device to perform a function. These time intervals are measured by counting cycles of a repetitive program loop that monitors the activity of all devices. Whenever the controller initiates a function by starting a motor, a counter is set to a value that represents the number of cycles that are allowed for the motor to successfully complete the operation. This counter is decremented by the controller at the end of each cycle if it is found to be non-zero. If the counter goes to zero during the decrementing process, it will indicate that the function was not completed in the allowed interval. If the function were to complete before the interval expires, the counter would be set to zero by the control logic for the function.

Functional errors of the above type are reported to the master controller and will cause an immediate stop and reset of the system to prevent damage to the mechanism. The cause of error is reported on the CRT in the area associated with the hopper or the topper depending on which device caused the failure.

The embosser controllers and the section of the master controller for the drive of belt 190 use the signals from the timing disk 218 to detect functional faults in the drive motors. The embossers receive characters to be embossed during the RSHUT interval assigned to them by the pitch at which they will emboss. When the RSHUT signal changes state, the embosser module will start to drive the type wheel to the selected position. This motion must be completely accomplished before the ESHUT high state of the next RSHUT interval that selects this embosser occurs. A failure to complete is defined as a selection error and reported to the master controller. The master controller will begin to drive the belt 150 to the next seleceed position as the RSHUT signal changes state. All motion must be accomplished before an ESHUT high state occurs at an active embosser. Failure to accomplish this will cause an error condition that will require a complete restart to properly initialize the belt and embosser encoders.

The master controller will also initiate a time counter when embossing of a line begins. The embossing of the line must be completed by the end of the interval allowed or it is assumed that the belt has become jammed and the system is shut down.

As described, supra, sensors are provided at the throat 55 of the input hopper 12 and at each of the embosser units 14 to detect the presence of a card. If a card is not present at the throat sensor 60 after the rack 40 has moved to the top of its stroke, the feed cycle will be automatically repeated. If a card fails to appear on the second cycle, an error message will be sent to the master controller indicating the condition. The system will then stop and wait for the operator to reinitiate embossing after correcting the fault.

If a card fails to appear at one of the embossing units 14 when it should, the fact will be detected by the sensor 106. This test is made as the belt arrives at position 0 and the system will stop at this point until the operator restarts it.

Detection of errors which cannot be corrected without restarting operation of the system causes a stacker gate 302 to be moved by the activation of motor 304 to align the exit slot 306 from the topper 16 with the rear section 300 of the tray 296 to receive cards which are erroneous. During the normal mode of operation, the stacker gate 302 is positioned to couple the exit slot 306 to the front section 298 of tray 296. A spring loaded plate 308 pushes the rejected cards against the back side of gate 302. A spring loaded plate 310, which is guided by rod 312, pushes the properly embossed cards against the front side of the gate 302. The error flag stored in the control block of the hopper/topper buffer controls the motor 304 to position gate 302.

Significant Control Positions of the Belt 150

The operation of many of the parts of the embossing system of the present invention is synchronized with the movement of the belt 150 through reference positions. Significant belt positions are stored in a table which are pointed to sequentially by a pointer. The significant belt positions are 20, 50, 90, 160 and 180. Belt positions 50, 160 and 180 establish stops for the belt 150 that may not be passed until certain conditions are met. Position 20 is the point at which the pin 156 has moved clear of the input hopper 12 and a command may be sent to start the feed cycle of the rack drive motor 46. When it is determined that the next MOVE period will advance the belt past position 20, the command for starting the rack drive motor 46 will be transmitted to the hopper/topper processor. The transmission of this command will occur only during the low RSHUT period when the embossing unit for 7 pitch characters is active as illustrated in FIG. 34(*d*). Position 50 is the position when a pair of a leading edge card gripper 152 and a trailing edge card gripper 154 are positioned in the card insertion position directly above the input hopper 12 as described, supra. The belt 150 will not advance past this point until status information from the hopper/topper processor indicates that a card has been placed into the slot 160 into engagement with the horizontally disposed surface 166. This condition is determined by the master controller checking if the rack drive motor 46 has stalled which signifies that the top edge of a card has contacted the horizontally disposed surface 166. The rack motor 46 is maintained in the stalled condition until the belt 150 has moved to position 90 and then a command is issued to drive the rack 40 to its lower position. Position 160 is the position at which the belt 150 will be stopped if the sensor 274 does not detect the right edge of a card which signifies that a card is presently in the wait station 24. If the sensor 274 is clear, a control message is sent to the hopper/topper controller to activate the motor 232 to transport a card from the wait station. Position 180 is a point at which the belt 150 will wait for one cycle of the cam 130 to allow time for the motor 232 to move a card fully from disengagement with the pair of a leading edge card gripper 152 and a trailing edge card gripper 154 by front idler wheel 186 and rear idler wheel 188 engaging cam 216. This action is initiated by the card entering the engagement with driven roller 242 and idler roller 244 between positions 160 and 180.

Example of Embossing of 7 and 10 Pitch Characters on a Card

FIG. 33 illustrates an example of the embossing of a single line of 7 pitch OCR numbers from a data record from a second card and of a single line of A/N characters from a data record for a first card as they are processed by an embossing system having two in line embossers instead of the three embossers illustrated in the preferred embodiment of FIG. 2 of the present invention. The example demonstrates the operation of the algorithm to identify the closest next character for embossing single lines on two cards. However, it should be understood that the preferred embodiment operates in the same manner as the example described below except that one additional embosser unit 14 and embosser buffer are involved. The data record which is being processed to produce OCR numbers is "5237" and the data record which is being processed to produce A/N characters is "JOHN DOE". By the time embossing of these lines is complete, the data records are changed such that the data record for card number two is discarded because its A/N characters "SAM SMITH" would have been previously embossed before the embossing of the "JOHN DOE" record described with the example, the data record for card 1 becomes the data record for card 2 and another previously unprocessed data record would become the data record for card number 1. This transfer is accomplished by shifting the pointers to the embosser buffers to the correct locations in the main memory where the new records are stored. The reference to "buffer number 1, buffer number 2" refers to the corresponding buffers illustrated in FIG. 24. The legend "Data Record" identifies the rows of 7 pitch and 10 pitch data which are contained in the respective fields of cards 1 and 2. It should be noted that the six digit card identification number which appears in each data record has been omitted and that further the third field which would be resent in the embossment of a data record having the format of FIG. 7 has been omitted for purposes of simplifying the example. A command to leave a blank space on a card is indicated by an underscored line. The number appearing vertically below the number or character is the location on the belt 150 at which the number or character is to be embossed. An asterisk indicates an end-of-line command which signals that processing of that line is complete.

The column headed by "current belt position" identifies the current position of the belt 150 and the column labelled "belt position, closest next characters and card" respectively identify the current position of the belt 150 and the position of the closest next character, the character's identification as signified by quotation marks and the data record to which the character belongs as identified by the parenthetical reference to 1 or 2 which signifies card 1 or 2.

The control of the belt 150 is as follows in the example. At current belt position zero while embossing the "J" of the card 1 and the "5" of card 2, the closest next character's belt position is seen to be position 7 where the letter "0" from the JOHN DOE record of card number 1 is contained. When the current position of the belt 150 is 7, the position of the closest next character is position 10 which corresponds to the numeral "2" of the "5237" record of card number 2. At the position 10 of belt 150, the closest next character is at belt position 14 wherein the letter "H" from the JOHN DOE record of card number 1 is located. A blank space is not considered to be a character which causes the pointer to the current character in the buffer to be advanced. Processing for each sequential belt position occurs in the following manner until the end-of-line command is reached in the "JOHN DOE" record at which time shifting of the pointers to the memory occurs to change the contents of buffers 1 and 2 as described above. More than one character from multiple data records may be the closest next character(s) when a plurality of embossing units 14 are being used to emboss characters of the same pitch as is the case with the data record illustrated in FIG. 1.

Figure 37:
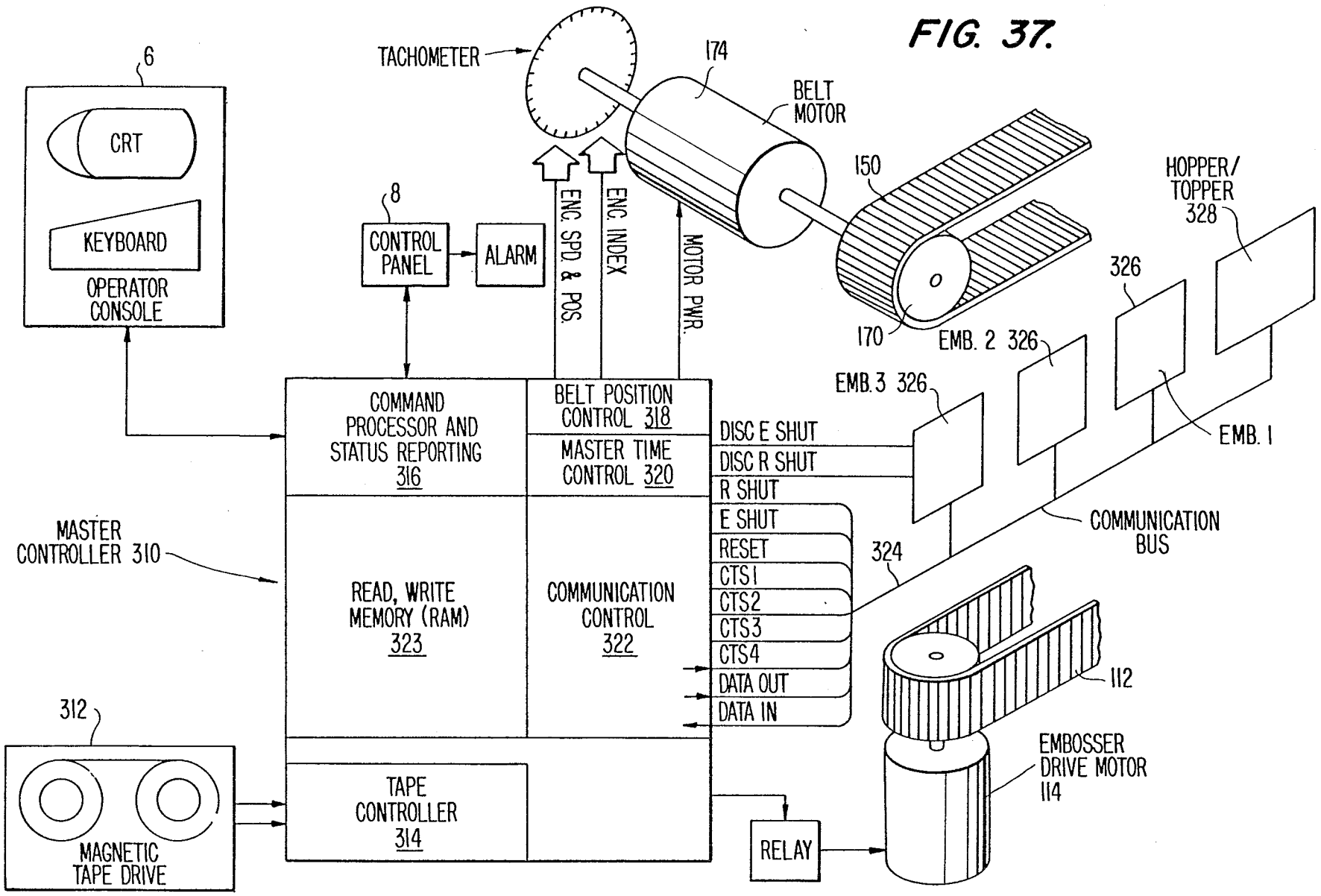
FIG. 37 is a simplified mechanical-electrical schematic of the master controller of the present invention.

FIG. 37 illustrates a simplified schematic of the master controller 310 used by the present invention. The actual circuitry for implementing the master controller 310 is illustrated in FIGS. 41A-C and 42A-B. The function of the master controller 310 is to control communications throughout the system. Identical reference numbers are used herein to identify the same parts identified by the same reference numerals in the previous figures. Input communications are received from the operator console 6, magnetic tape drive 312 and control panel 8. The master controller 310, which includes a programmed microprocessor which operates with a control program set forth in the Microfiche Appendix, supra, performs the functions of managing input communications by a tape controller section 314 and a command processor and status reporting section 316. The belt position control section 318 controls the operation of the drive motor 174 in the manner described, supra. The master time control section 320 responds to the RSHUT and ESHUT signals generated by the timing disk 218 attached to the cam 216 of the third embossing unit 14. Transitions of the disk generate the RSHUT signal, generate an interrupt, and synchronize the internal timer for generating the ESHUT signal which is generated internally by the master time control section. As described, supra, the disk generated ESHUT signal is only used when starting the system to prevent movement of the punch wheel 66 and die wheel 70 or card transport belt 150 when the rams 88 are pressing the punch and dies against a card. The communication control section 322 communicates the labelled output signals to the communication bus 324 which is coupled to three identical embosser controllers 326 and a hopper/topper controller 328. A read-write memory 323 stores information generated dynamically during operation. The preferred electrical circuitry for implementing the individual embosser controllers 326 is described, infra, in conjunction with FIGS. 43A-B. The preferred circuitry for implementing the hopper/topper controller 328 is described, infra, in conjunction with FIGS.

44A-B. The master controller 310 also controls the embosser drive motor 114 which, through belt 112, provides power for each of the in line embossing units 14.

Figure 38:
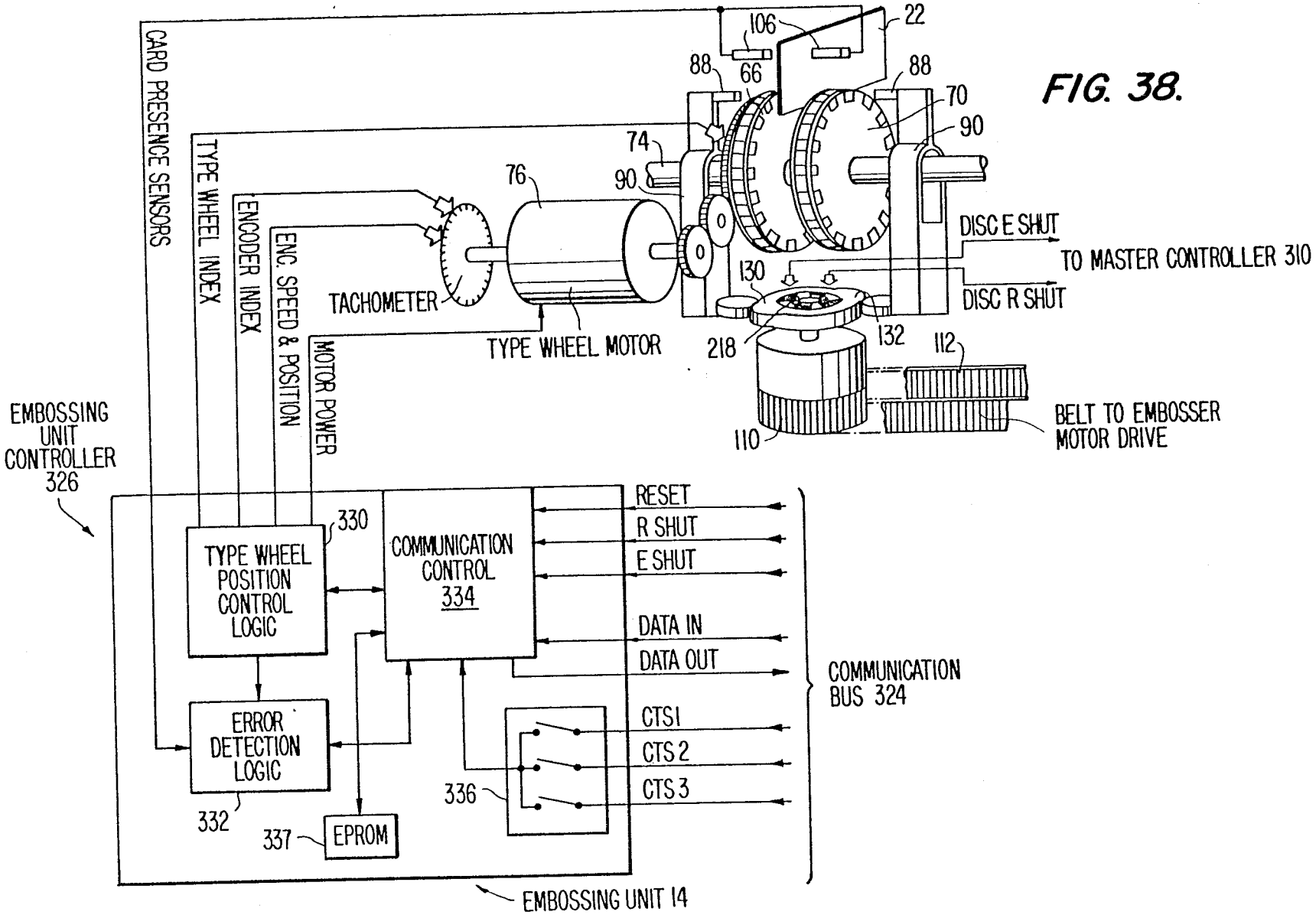
FIG. 38 is a simplified mechanical-electrical schematic of an embosser controller of the present invention.

FIG. 38 illustrates a simplified schematic of the embosser controller 326 of FIG. 37. FIG. 38 illustrates the embosser controller 326 used in conjunction with embosser number 3 from which the RSHUT and ESHUT signals are generated by timing disks 218. Identical reference numbers are used herein to identify the same parts identified by the same reference numerals in the previous figures. Each embosser controller 326 has a type wheel position control logic 330 which controls the positioning of the punch wheel 66 and die wheel 70 to ensure that appropriate characters are embossed as described, supra. The error detection logic 332 controls the detection of card position errors sensed by sensor 106 and position errors of the punch wheel 66 and die wheel 70 which must be rotated to the desired position at which a character is to be embossed or a space is left before the next ESHUT high state of the next RSHUT interval. A failure to complete the positioning within this time interval is reported as an error to the embosser controller 326. The communication control 334 controls the communications to and from the embosser controller 326. A device selection switch 336 is provided to program the individual embosser processors 326 to function to receive one of the timing signals CTS 1-3 which the individual embosser controller 326 is programmed to respond to assume the function of the control processor for any one of the embossing units 14. A section of EPROM 33 stores a control program for the embosser controller 326. The preferred form of control program is set forth in the Microfiche Appendix discussed, supra.

Figure 39:
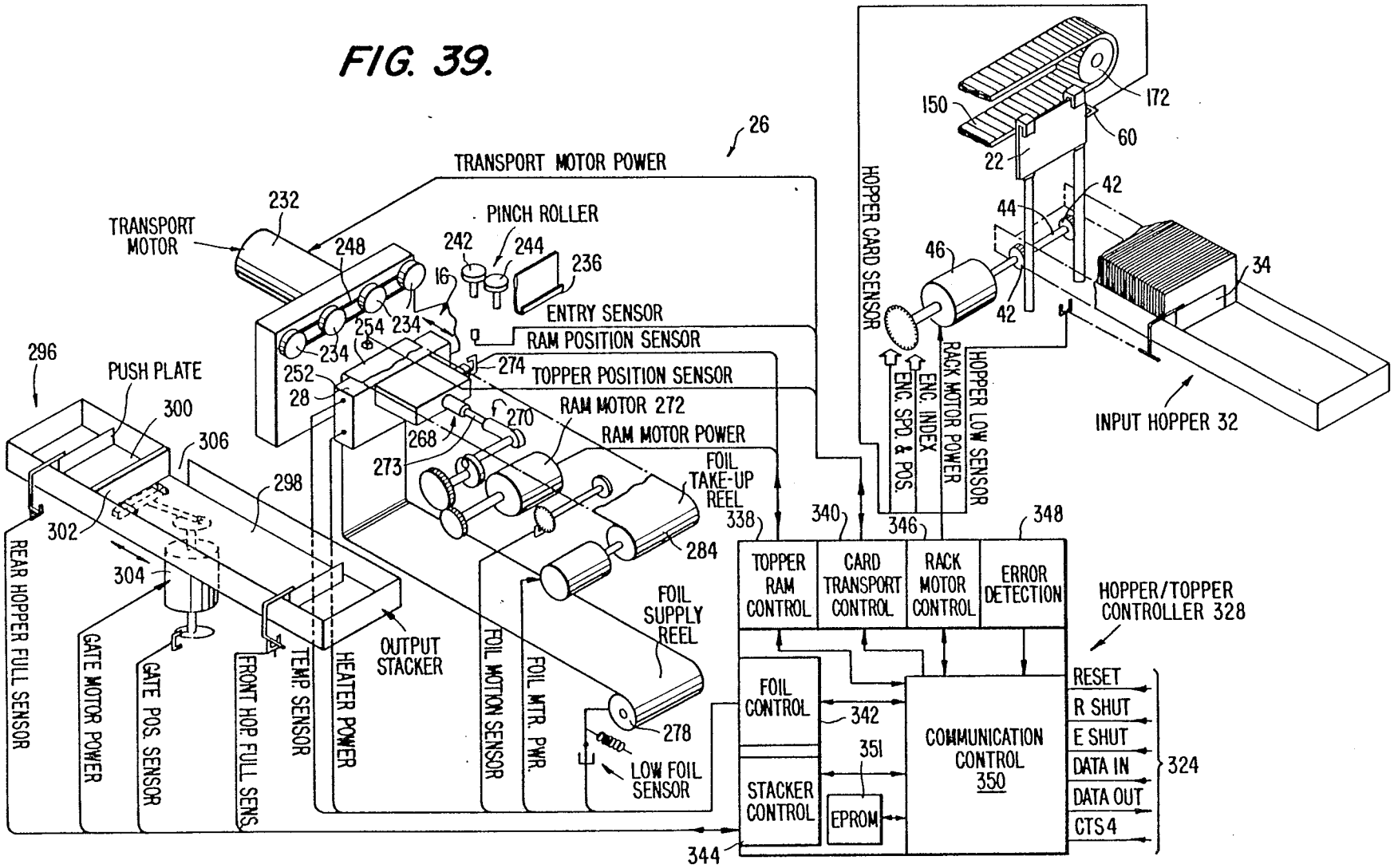
FIG. 39 is a simplified mechanical-electrical schematic of the hopper/topper controller of the present invention.

FIG. 39 illustrates a simplified schematic view of the hopper/topper controller 328. Identical reference numerals are used herein to identify the same parts identified by same reference numerals in the previous figures. The hopper/topper controller 328 has a topper ram control section 338 which is used to control the driving of the heated platen 28 between its first position to its second position at which an embossed card is topped. A card transport control section 340 controls the movement of the card by the transport unit 26 from the wait station 24 to the topping station of the topper 16 by controlling the activation of the transport unit 26 of the topper 16. A foil control section 342 controls the advancement of the foil in the topper. A stacker control 344 controls the movement of the stacker gate 302 in response to the error flag from the control block of the hopper/topper buffer 240 so that cards which are improperly embossed or which have been embossed with erroneous information are stored in the rear section 300 of the tray 296. The rack motor control section 346 controls the activation of the rack motor 46 to move cards from the input hopper 12 to the card insertion position. The error detection section 348 monitors the performance of the input hopper 12 and the topper 16 to detect error conditions. The communication control section 350 controls communications between the input hopper 12, topper 16 and the master controller 310. A section of EPROM 351 stores a control program for the hopper/topper controller 328. The preferred form of control program is set forth in the Microfiche Appendix discussed, supra.

Figure 40A:
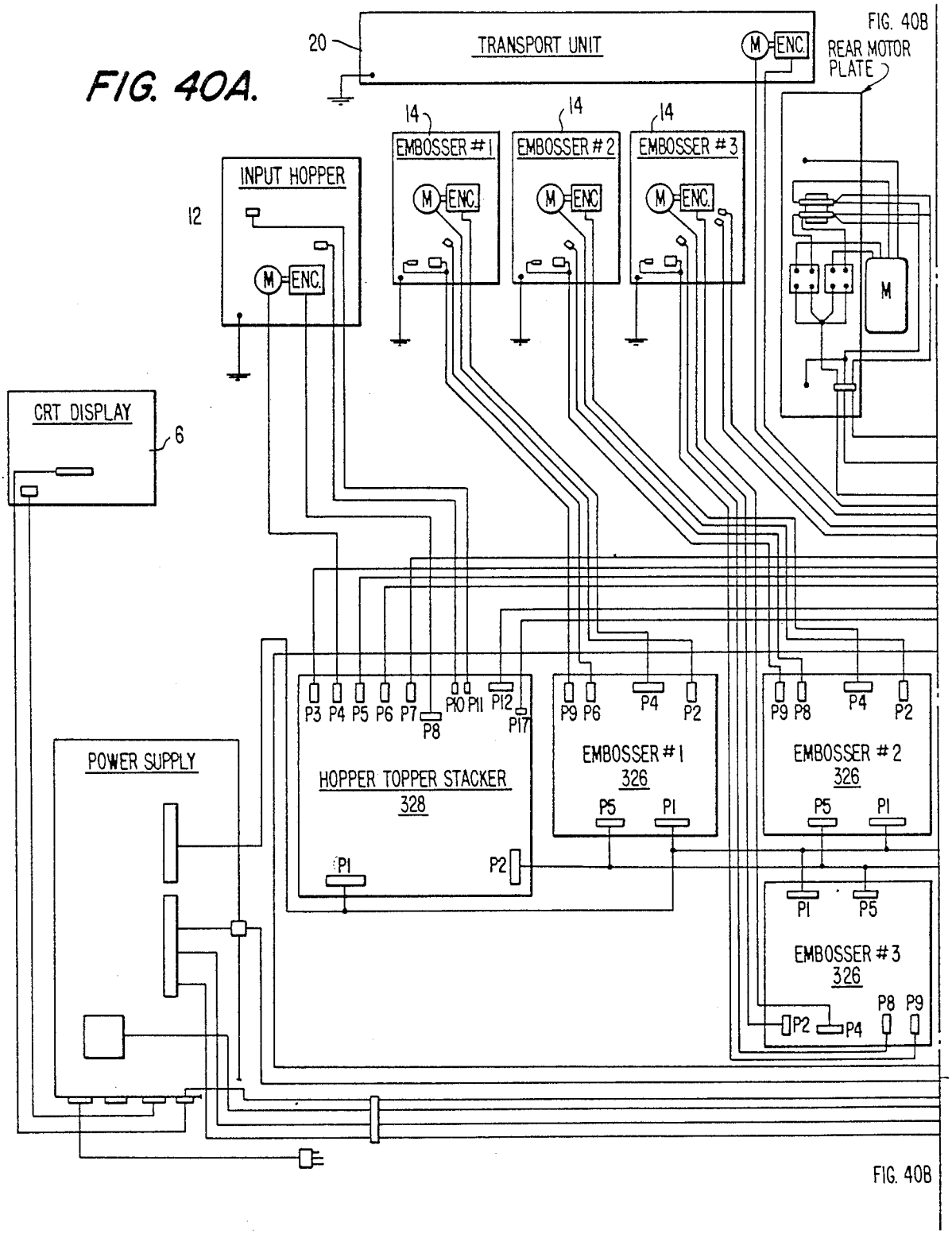
FIGS. 40A–B are diagrams of the electrical connections between the major electrical components of the present invention.
Figures 40A, 40B:
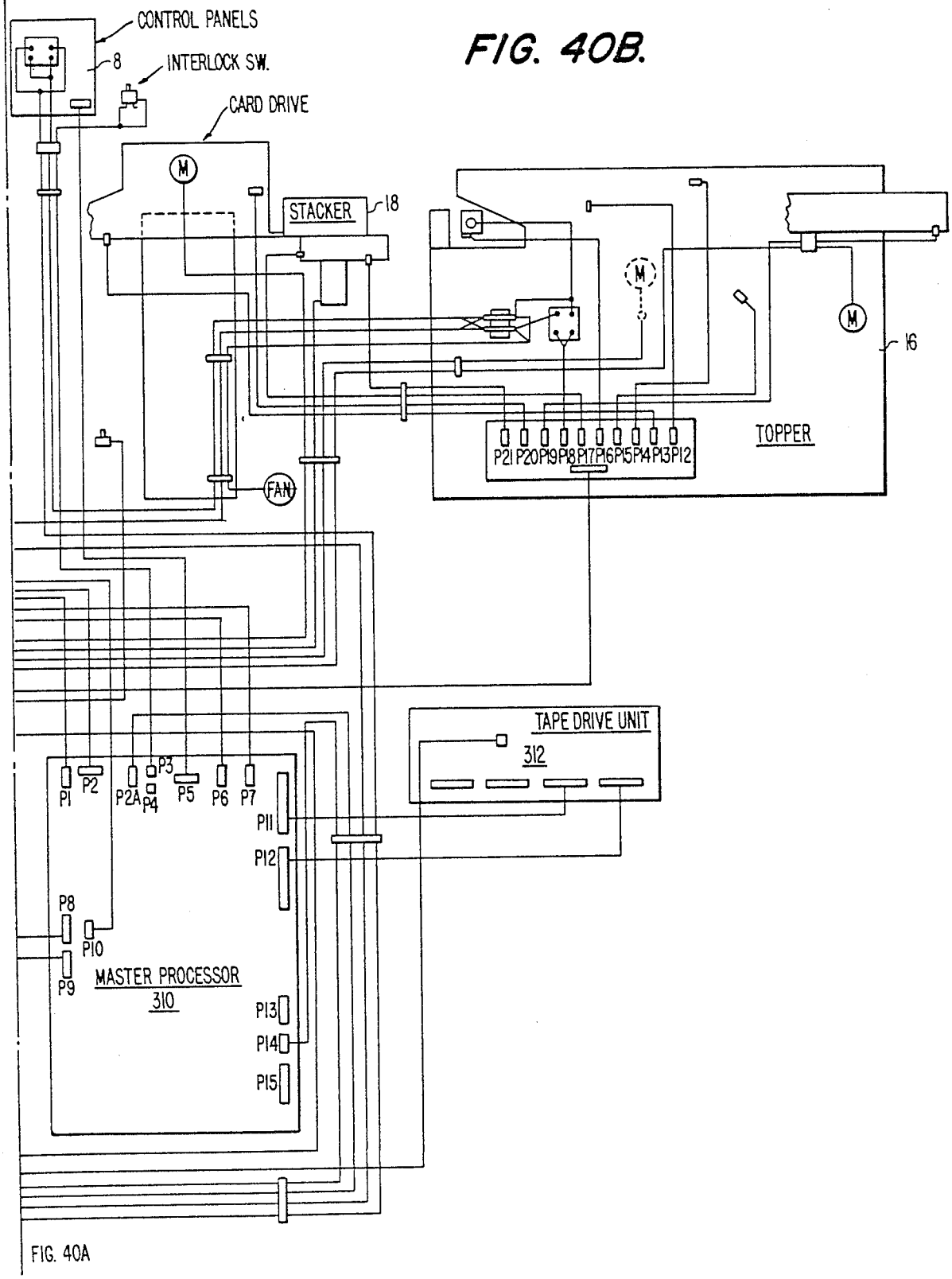
Figure 41A:
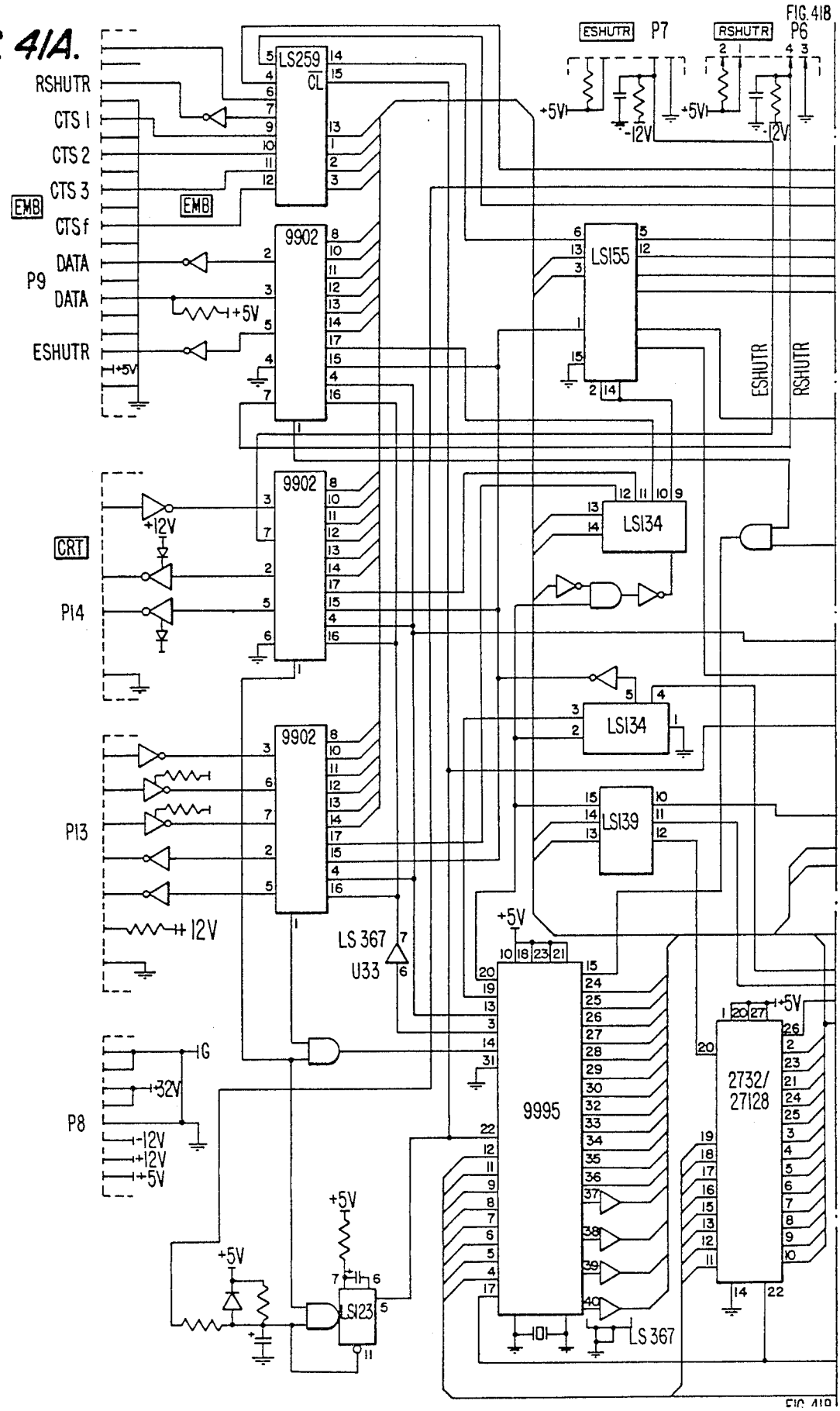
FIGS. 41A–C and 42A–B illustrate the preferred form of the master controller of the present invention.
Figures 41A, 41B, 41C:
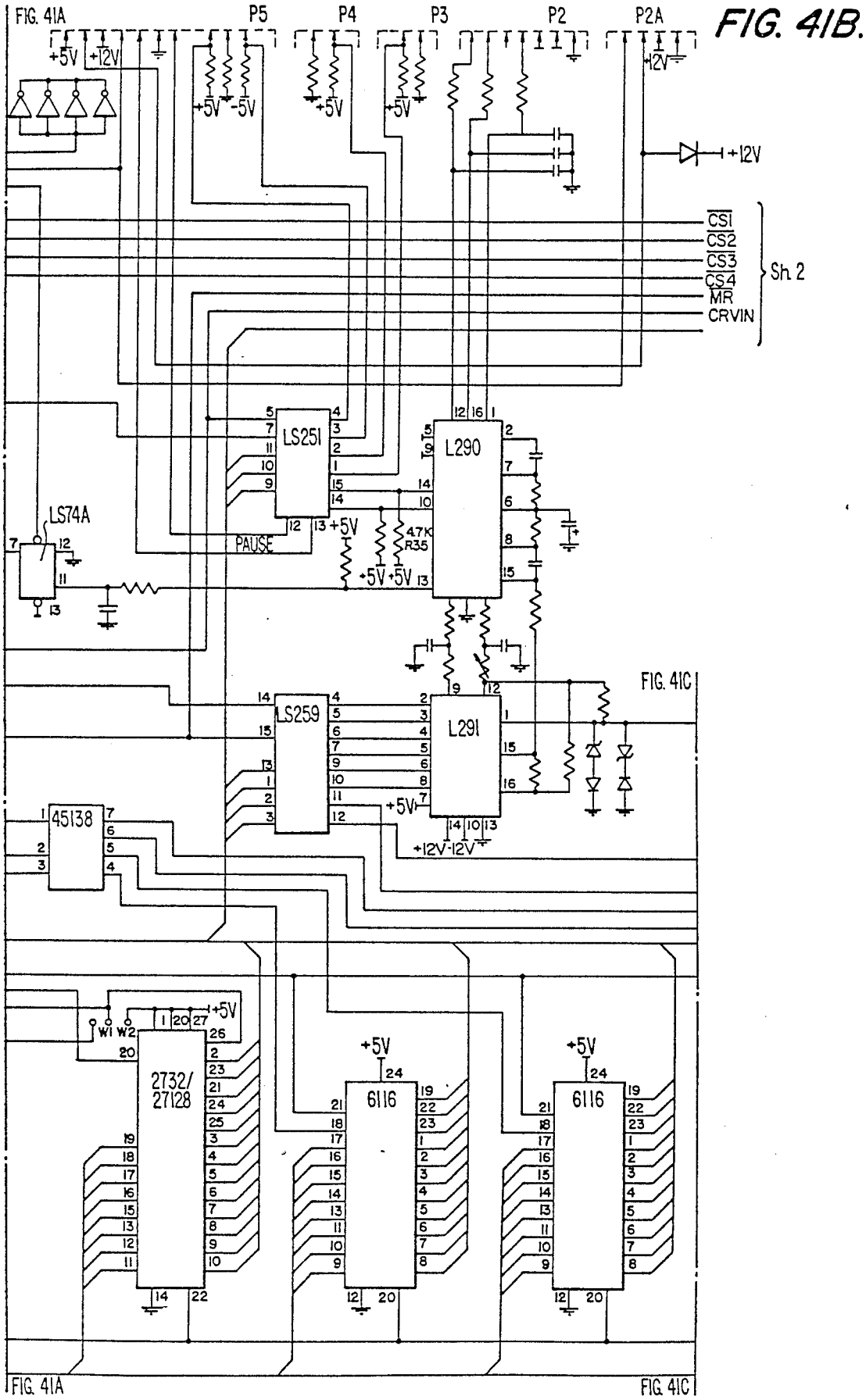
Figure 41C:
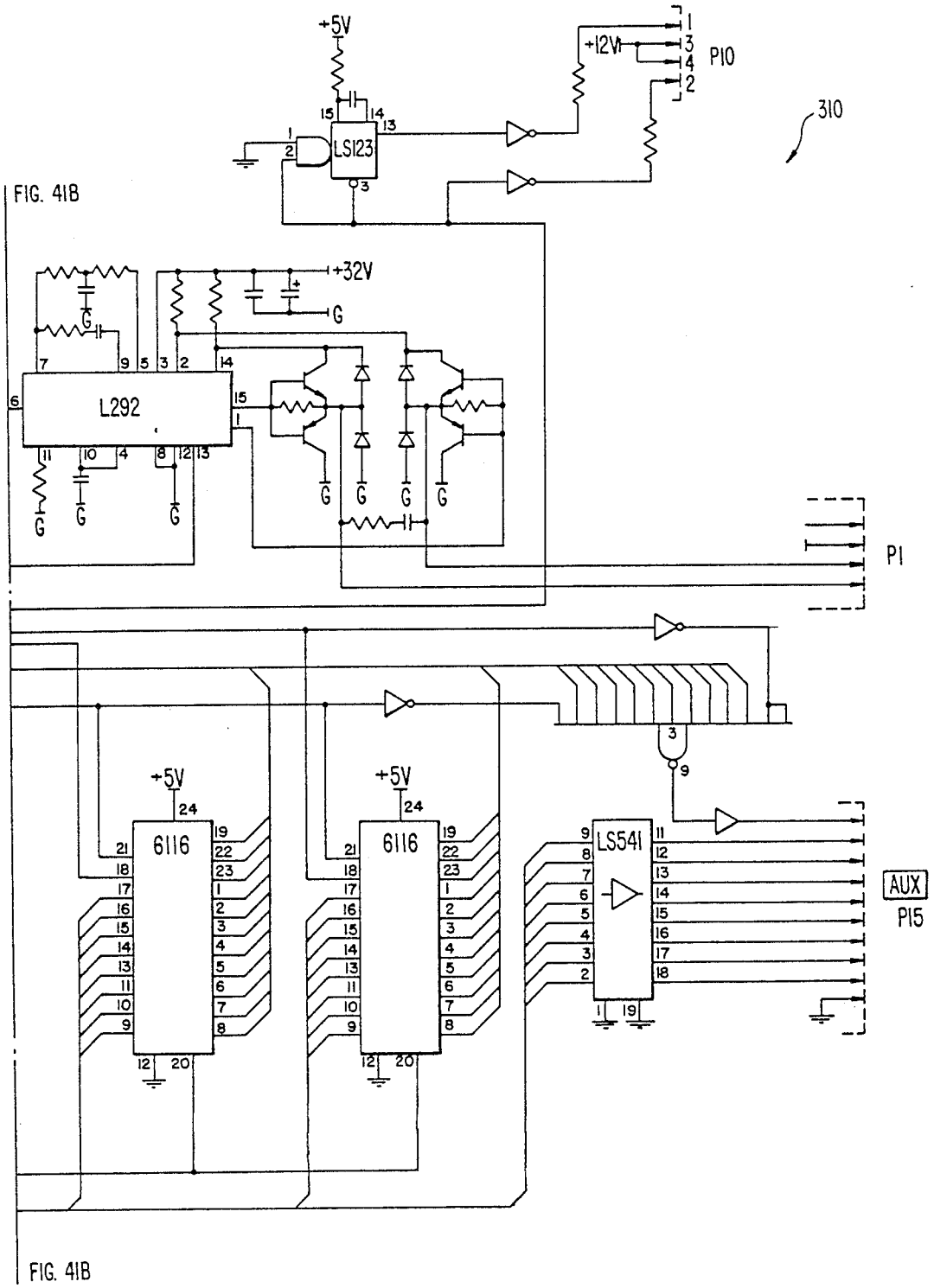
Figure 42A:
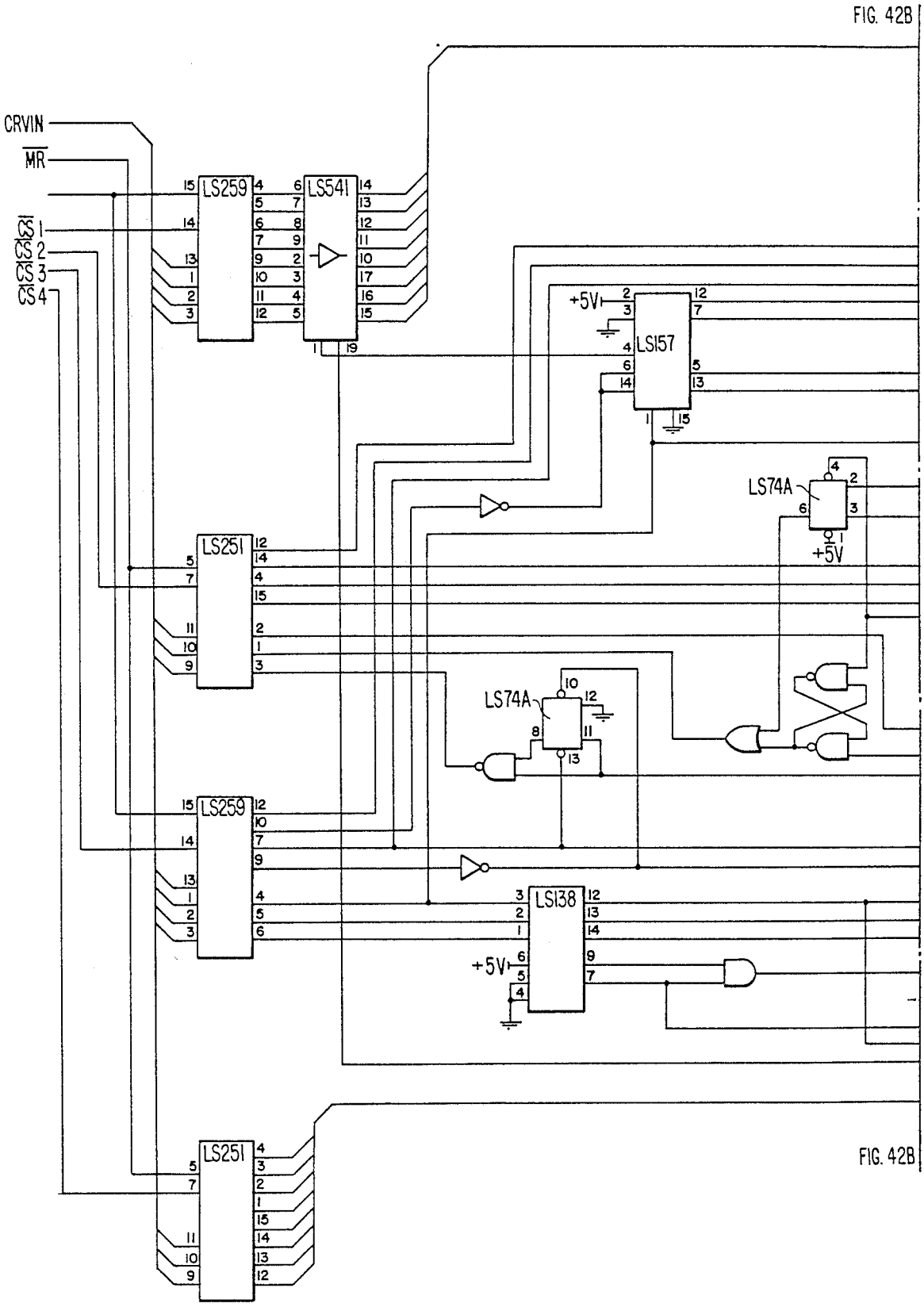
Figure 42B:
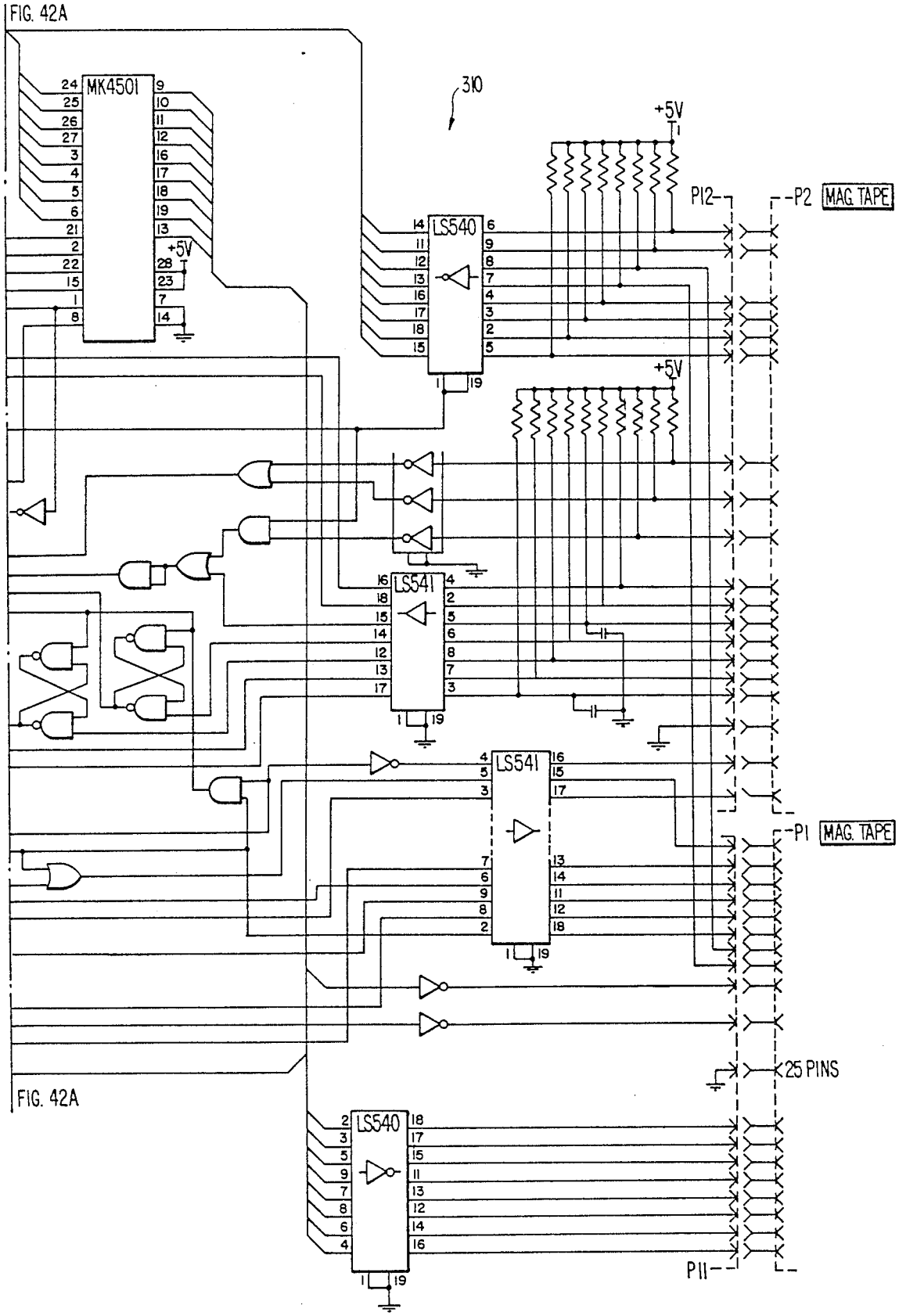

FIGS. 40A-B illustrate the preferred form of electrical interconnections of the circuit boards implementing the major components of the present invention. Identical parts are identified herein with the same reference numerals in the preceding figures.

FIGS. 41A-C and 42A-B illustrate an electrical schematic of the preferred form of the master controller 310. Integrated circuits are identified by their conventional part number.

Figure 43A:
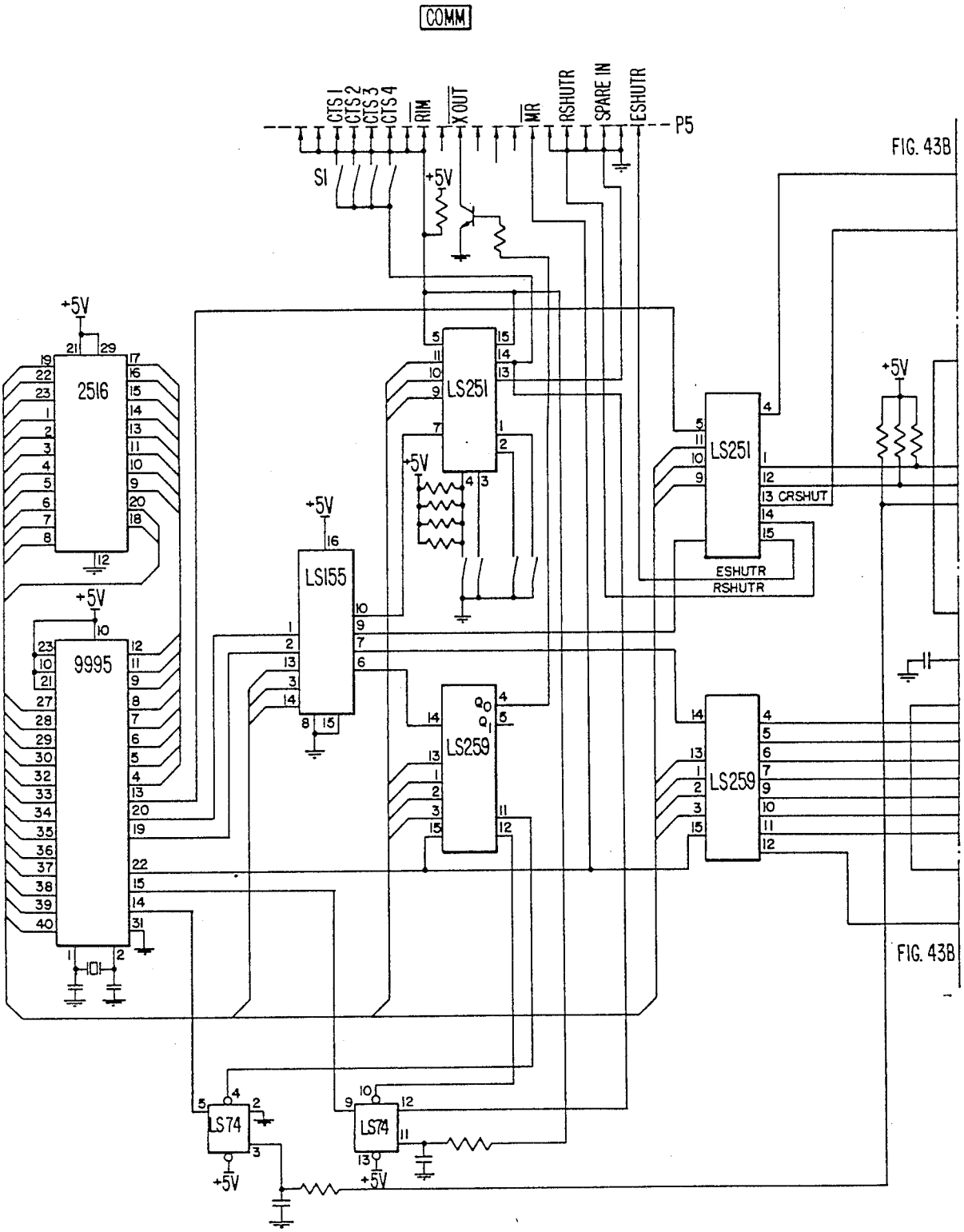
FIGS. 43A–B illustrate the preferred form of the controller for the embosser units of the present invention.
Figure 43B:
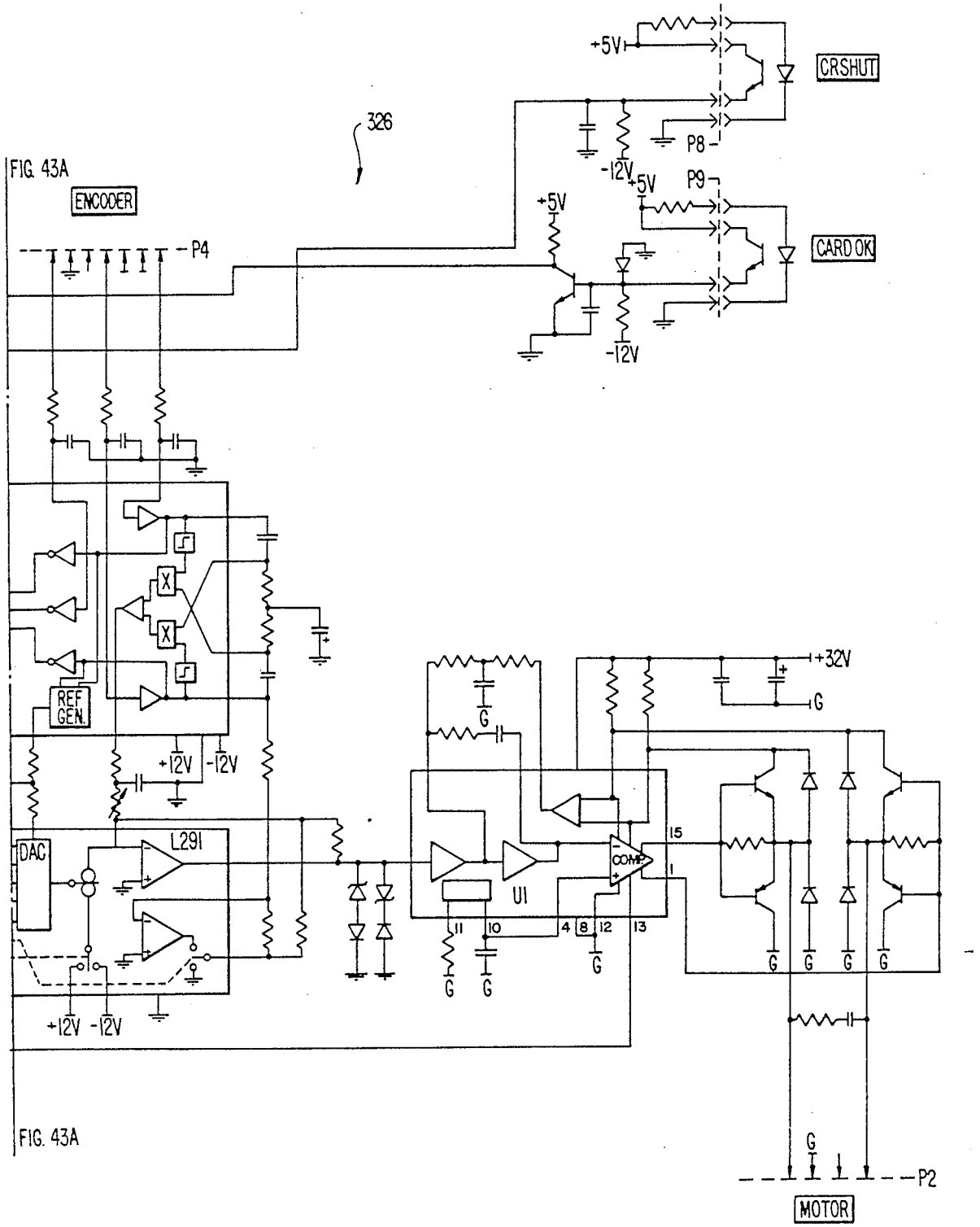

FIGS. 43A-B illustrate an electrical schematic of the preferred form of the embosser controller 326. Integrated circuits are identified by their conventional part numbers.

Figures 44A, 44B:
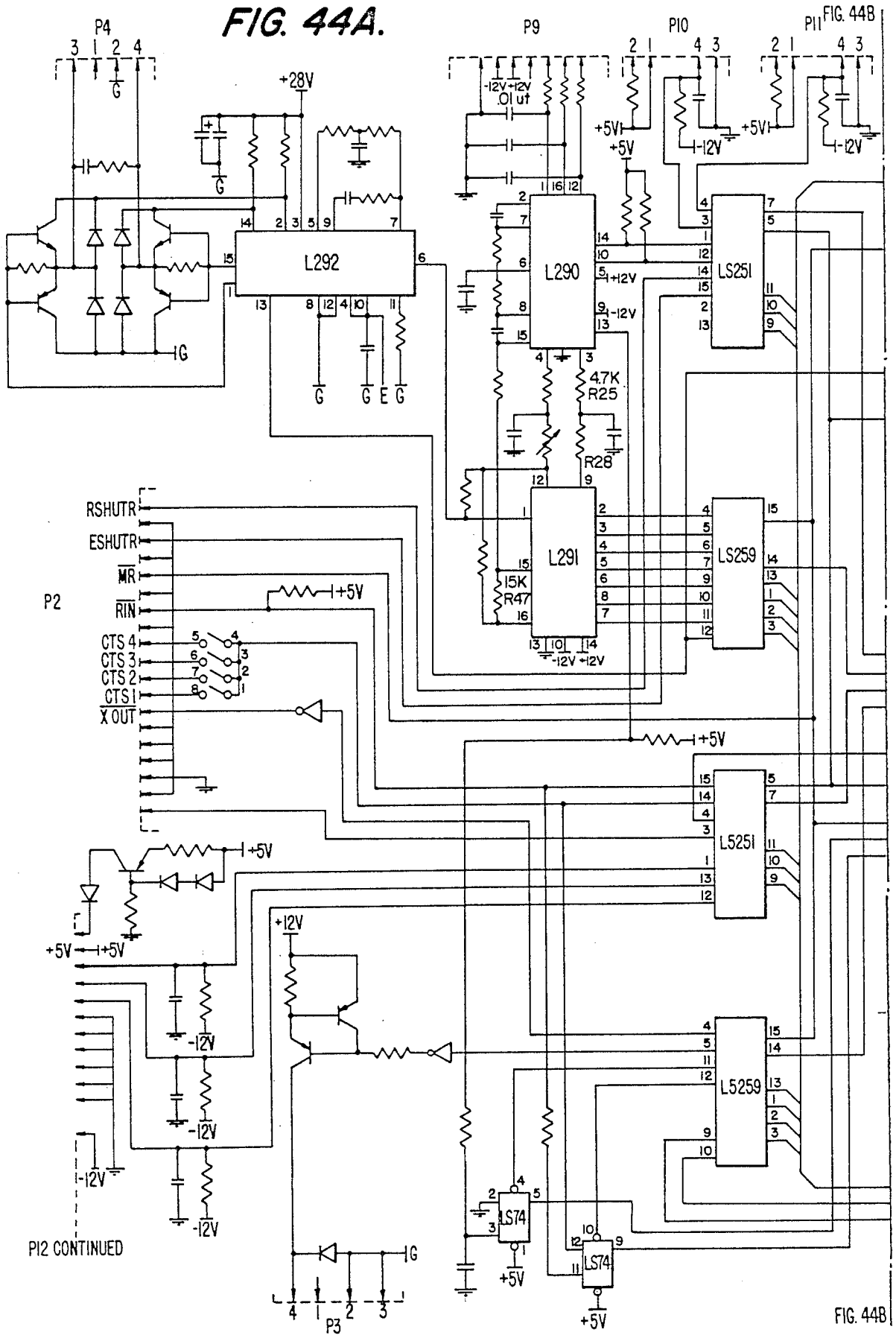
FIGS. 44A–B illustrate the preferred form of the controller for the input hopper and topper of the present invention.
Figures 44A, 44B:
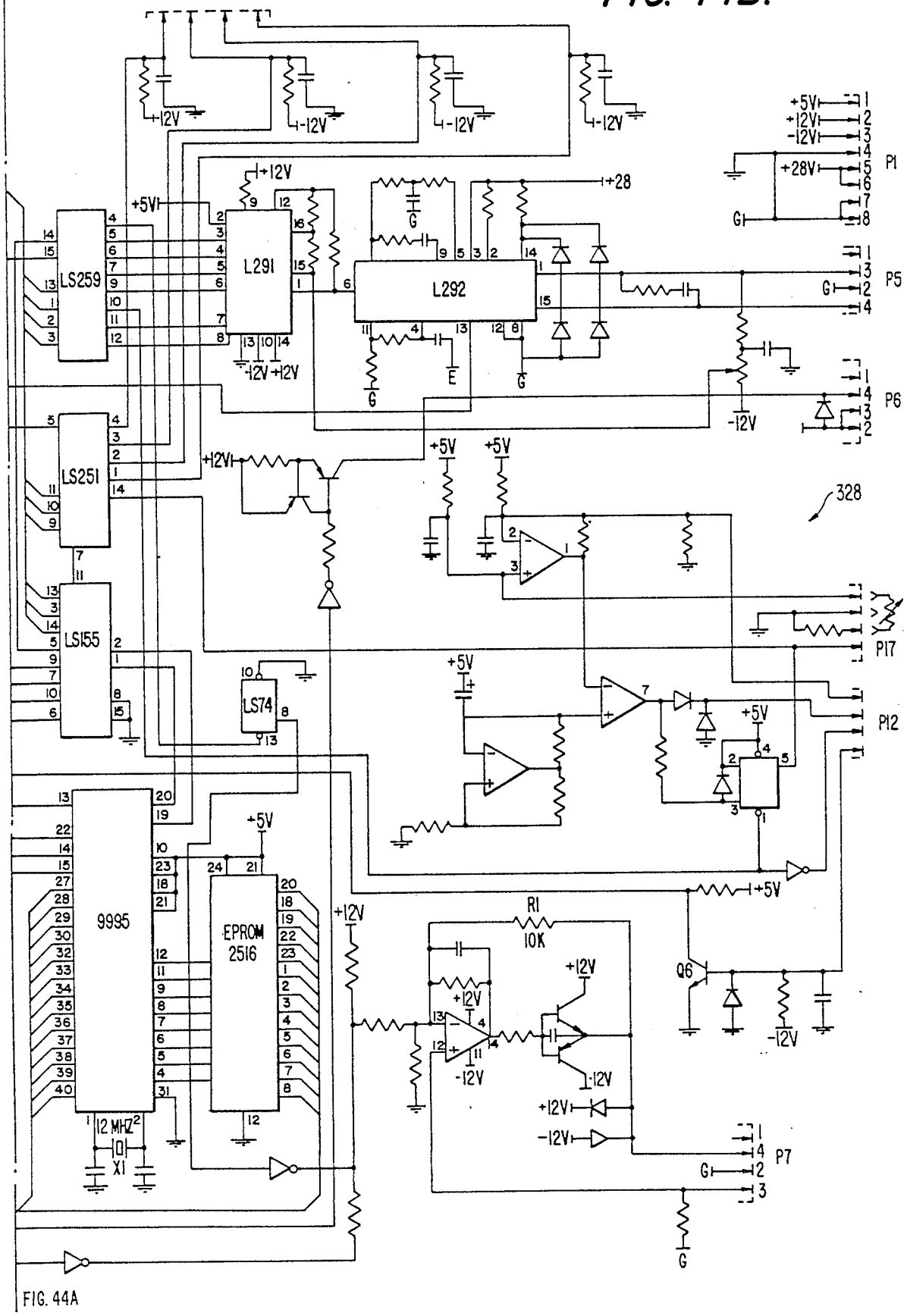

FIGS. 44A-B illustrate an electrical schematic of the preferred form of the hopper/topper controller 328. Integrated circuits are identified by their conventional part numbers.

While the invention has been described in terms of its preferred embodiments, it should be understood that numerous modifications may be made to the invention without departing from its spirit and scope. The system may be used to emboss cards with a plurality of lines with any number of pitches. Furthermore, the system may be used to emboss a plurality of lines with the same pitch in which case the timing for driving the individual embossing units 14 would be produced by cams 130 having the same phase relationship with respect to each other instead of the 90° phase displacement of the cams described, supra, in embossing characters of two different pitches. It should be further understood that the invention may be used for embossing cards other than credit cards and promotional cards such as, but not limited to, metallic identification plates. The invention is not limited to the choice of any particular number of characters to be carried by the punch wheel 66 and die wheels 70. While the timing of the major components of the preferred embodiment described is synchronous with the activation of the embossing units 14, other timing sequences may be used. It is intended that all such modifications and other numerous modifications fall within the scope of the appended claims.

We claim:

1. A topper for applying a topping to embossed cards comprising:

(a) a card transporting means for moving cards from a wait station to a topping station where topping is applied to characters on embossed cards;

(b) a support surface having a first end and a second end, the support surface being rigid with respect to force applied between the first and second ends in a direction which is orthogonal to a surface of the card having the embossed characters;

(c) a flat surface for rigidly supporting a back surface of an embossed card located at the topping station and connected to the first end of the support surface, the back surface being the surface of the embossed card to which topping is not applied;

(d) a heated platen which is movable from a first position remote from the surface of the card which has the embossed characters to be topped to a second position at which a surface of the platen forces a topping bearing foil into contact with the embossed characters to heat fuse the topping to the embossed characters, the platen having a face which contacts the topping bearing foil in the second position and which is substantially parallel to the flat surface in moving from the first position to the second position;

(e) a suspension for supporting the platen including a base having first and second ends, first and second parallel flexible members which have a cross section with an elongated dimension being orthogonal to the direction of motion between the first and second positions and which have first and second ends, the first ends of the first and second flexible members being connected respectively to the first and second ends of the base;

(f) an attachment plate carried by the platen having first and second parallel ends, the first and second ends of the attachment plate being respectively connected to the second ends of the first and second flexible members;

(g) means for moving the platen from the first position to the second position which causes the flexible members to bend while maintaining a substantially parallel relationship with each other and the surface of the platen substantially parallel to the support surface during movement from the first position to the second position, the means for moving the platen having a movable member which is connected to the platen and being connected to the second end of the support surface; and (h) a source for providing the topping bearing foil between the surface of the platen and the support surface.

2. A topper in accordance with claim 1 wherein the flexible members are metallic and function to radiate and conduct heat from the heated platen.

3. A topper in accordance with claim 1 further comprising:

(a) a rotatable support means for a roll of topping bearing foil;

(b) a first foil guide mounted below the heated platen and support surface;

(c) a second foil guide mounted above the platen and set back from the support surface to cause the foil to form an acute angle between the foil and the support surface of the card between the second guide and the card at the time the topping is fixed to the embossed characters of the card by the heated platen; and (d) foil take up means for causing the foil to be unwound from the roll of foil, moved over the first foil guide, past the heated platen and support surface, over the second foil guide and to the take up means.

4. A topper in accordance with claim 1 wherein a slot extends between the first and second foil guides and the support surface on one side of the heated platen to permit a continuous strip of foil to be routed over the guides from the one side and an intermediate section of the support surface is disposed on the other side of the platen.

5. A topper in accordance with claim 4 wherein the intermediate section is narrower than the first and second ends in a direction orthogonal to the direction of motion of the platen in moving from the first position to the second position.

6. A topper in accordance with claim 3 wherein the second foil guide is spring biased in a first position and is pivotable from the first position in a direction toward the second end of the support surface to a second position, the acute angle being greater for the second position of the foil guide than the first position, the foil guide being pivoted toward the second position when the foil take up means is activated to cause the foil to be peeled away from contact with the embossed characters by the increase in the acute angle.

7. A topper in accordance with claim 2 further comprising control means for controlling the means for moving the platen to cause a force to be applied by the platen against the embossed card to be topped which is proportional to the number of characters which are embossed on the embossed card.

8. A topper in accordance with claim 3 wherein the take up means is programmable to set the amount of foil to be taken up after topping each card.

9. A topper in accordance with claim 2 further comprising a transporting means for moving embossed cards from the wait station to the topping station including a channel extending from the remote station to the topping station which engages an edge of an embossed card during movement from the wait station to the topping station and means for engaging an edge opposed to the edge engaged by the channel for moving an embossed card from the remote station to the topping station.

10. A topper in accordance with claim 9 wherein the means for engaging an edge of the card opposed to the edge engaged by the channel for moving an embossed card comprises a plurality of driven rollers having their axes of rotation in a line when contacting an edge of a card disposed above the channel, each driven roller having a peripheral surface which engages the edge of an embossed card being driven from the remote station to the topping station and means for rotating each driven roller.

11. A topping mechanism in accordance with claim 10 wherein the axis of each driven roller has a first position vertically spaced from the channel and a suspension which permits vertical deflection of the axis upward from the first position to a second position to permit cards of varying width to be moved from the remote position to the topping position.

12. A topper in accordance with claim 11 wherein the card transporting means further comprises an additional driven roller which engages a face of an embossed card and an idler roller which engages an opposed face of the embossed card opposite the position of the additional driven roller which moves a card to be embossed from the wait station to a first one of the driven rollers which engages an edge of an embossed card, the additional driven roller and opposed idler roller being upstream from the other driven rollers.

13. A topper for applying a topping to embossed characters of embossed cards each having a number of embossed characters comprising:

(a) a topping station to which cards are moved and at which a topping material is applied to embossed characters;

(b) means for supplying the topping to the topping station;

(c) a heated platen which is moved by a driving means from a first position, at which topping is not applied to the embossed characters of a card at the topping station, to a second position at which the characters are topped by the heated platen by forcing the topping against the characters to cause fusing of the topping to embossed characters; and (d) control means for causing a force to be applied by the driving means to the heated platen during topping which is proportional to the number of characters embossed on the card.

14. A topper in accordance with claim 13 wherein the driving means has two modes of operation in moving the heated platen from the first position to the second position, the first mode being the moving of the heated platen from the first position to a reference position and the second mode being the moving of the heated platen from the reference position to the second position during which the force proportional to the number of embossed characters on the card is applied.

15. A topper in accordance with claim 14 wherein the driving means comprises:

(a) an electric motor; and (b) an eccentric drive driven by the electric motor including a link which couples the eccentric drive to the heated platen, rotation of the eccentric drive causing the heated platen to be driven from the first position to the second position.

16. A topper in accordance with claim 14 wherein the control means causes the driving means to be stalled so that the heated platen remains in the second position for a time sufficient to fuse the topping to embossed characters on a card.

17. A topper in accordance with claim 13 wherein the control means comprises a register for storing the number of characters which is embossed on the card being topped.

18. A topper for applying topping to embossed characters of embossed cards comprising:

(a) a topping station to which cards are moved and at which a topping material is applied to embossed characters, the topping station having a surface against which a card rests when topping is applied to the embossed characters;

(b) means for supplying the topping to the topping station;

(c) a heated platen which is movable by a driving means from a first position, at which topping is not applied to the embossed characters of a card at the topping station, to a second position at which the characters are topped by the heated platen forcing the topping against the characterss to cause fusing of the topping to the embossed characters; and (d) means for suspending the heated platen, for movement between the first position and the second position and back to the first position, from a base located remote from the driving means while maintaining a face of the platen substantially parallel to the surface against which the card rests during topping at the second position and including first and second flexible members coupled to the heated platen and to the base with the members bending during movement of the heated platen.

19. A topper in accordance with claim 18 further comprising means for conducting and radiating heat away from the driving means.

20. A topper in accordance with claim 19 wherein the first and second flexible members the means for conducting and radiating heat away from the driving means.

21. A topper in accordance with claim 20 further comprising means, disposed between the heated platen and the driving means, for isolating the driving means from heat generated by the heated platen means.

22. A topper in accordance with claim 21 wherein the means for isolating comprises a plastic member for attaching a heating element to another portion of the heated platen.

23. A topper in accordance with claim 18 wherein the first and second flexible members are parallel when the heated platen is in the first position and have a cross section with an elongated dimension orthogonal to the direction of motion between the first and second positions, the flexible members bending upon movement between the first and second positions with opposed surfaces remaining substantially parallel.

24. A topper in accordance with claim 23 wherein the cross section of each of the flexible members has a width which is parallel to the direction of motion between the first and second positions.

25. A topper in accordance with claim 23 further comprising an attachment plate, carried by the heated platen having first and second parallel ends, the first and second ends of the attachment plate being respectively connected to the first and second flexible members at a point remote from the base.

26. A topper in accordance with claim 18 further comprising a support surface, having first and second ends which is rigid with respect to a force applied between first and second ends in a direction orthogonal to the surface against which the card rests when topping is applied, the first end being connected to the driving means and the second end being connected to the surface against which the card rests.

* * * * *